US008024995B2

(12) United States Patent
Dayton et al.

(10) Patent No.: US 8,024,995 B2
(45) **Date of Patent: *Sep. 27, 2011**

(54) SYSTEMS AND METHODS OF A POWER TOOL SYSTEM WITH INTERCHANGEABLE FUNCTIONAL ATTACHMENTS POWERED BY A DIRECT ROTATIONAL DRIVE

(75) Inventors: Douglas C. Dayton, Harvard, MA (US); Sung K. Park, Chestnut Hill, MA (US); Mark R. Florence, Newton, MA (US)

(73) Assignee: Umagination Labs, L.P., Newton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/783,694

(22) Filed: May 20, 2010

(65) Prior Publication Data

US 2010/0288520 A1 Nov. 18, 2010

Related U.S. Application Data

(63) Continuation of application No. 12/027,204, filed on Feb. 6, 2008, now Pat. No. 7,743,683, which is a continuation-in-part of application No. 11/838,697, filed on Aug. 14, 2007, now Pat. No. 7,926,141, said application No. 12/027,204 is a continuation-in-part of application No. 11/935,296, filed on Nov. 5, 2007, now abandoned, which is a continuation-in-part of application No. 11/972,663, filed on Jan. 11, 2008, now Pat. No. 7,913,345.

(60) Provisional application No. 60/952,938, filed on Jul. 31, 2007, provisional application No. 60/985,573, filed on Nov. 5, 2007, provisional application No. 61/020,471, filed on Jan. 11, 2008, provisional application No. 60/837,993, filed on Aug. 15, 2006.

(51) Int. Cl.
*B25F 3/00* (2006.01)

(52) U.S. Cl. ..... 81/52; 173/216; 173/217

(58) Field of Classification Search ..... 81/52, 53.1, 81/53.12, 57.13, 57.32; 173/29, 46, 52, 214, 173/216, 217; 294/19.1, 23, 24
See application file for complete search history.

(56) References Cited

U.S. PATENT DOCUMENTS 1,819,800 A * 8/1931 Turner ..... 15/230.19

(Continued)

FOREIGN PATENT DOCUMENTS

CA 1242852 10/1988

(Continued)

OTHER PUBLICATIONS

"U.S. Appl. No. 11/834,908, Final Office Action mailed Apr. 3, 2009", , 8 pgs.

(Continued)

*Primary Examiner* — David B Thomas
(74) *Attorney, Agent, or Firm* — Strategic Patents, P.C.

(57) ABSTRACT

In embodiments of the present invention, a method and system of a power tool system may comprise mounting a functional module to a mounting plate of a power head, the power head configured to mount various functional modules, attaching the power head to a power base for powering the functional module, powering the functional module by directing power from the power base through a direct rotational drive of the power head, and controlling the multi-functional power tool system using a control disposed in the power base.

12 Claims, 53 Drawing Sheets

U.S. PATENT DOCUMENTS

| | | | | |
|---|---|---|---|---|
| 1,875,529 | A | 9/1932 | Vandervoort | |
| 2,539,003 | A | 1/1951 | Agustoni | |
| 3,751,749 | A | 8/1973 | Wilson | |
| 3,800,358 | A | 4/1974 | Ryan | |
| 3,952,239 | A | 4/1976 | Owings et al. | |
| 3,973,179 | A | 8/1976 | Weber et al. | |
| 4,050,003 | A | 9/1977 | Owings et al. | |
| 4,114,938 | A | 9/1978 | Strader et al. | |
| 4,121,320 | A | 10/1978 | Feiner | |
| 4,168,559 | A | 9/1979 | Henson | |
| 4,202,068 | A | 5/1980 | Lester et al. | |
| 4,204,292 | A | 5/1980 | Lester et al. | |
| 4,238,866 | A | 12/1980 | Taylor | |
| 4,502,806 | A | 3/1985 | Albertson et al. | |
| 4,549,611 | A | 10/1985 | Mills | |
| 4,757,786 | A | 7/1988 | Ellegard | |
| 4,810,855 | A | 3/1989 | Dassi et al. | |
| 4,848,818 | A | 7/1989 | Smith | |
| 4,958,397 | A | 9/1990 | Ryan | |
| 4,989,323 | A | 2/1991 | Casper et al. | |
| 5,149,230 | A | 9/1992 | Nett | |
| 5,265,341 | A | 11/1993 | Kikuchi et al. | |
| 5,311,641 | A | 5/1994 | Matsuura et al. | |
| 5,379,846 | A | 1/1995 | Wagster et al. | |
| 5,416,944 | A | 5/1995 | Eriksson | |
| 5,544,417 | A | 8/1996 | Atos et al. | |
| 5,577,286 | A | 11/1996 | Smith et al. | |
| 5,615,970 | A | 4/1997 | Reekie et al. | |
| 5,626,377 | A | 5/1997 | Carroll, Jr. et al. | |
| 5,692,417 | A | 12/1997 | Irpino | |
| 5,709,136 | A | 1/1998 | Frenkel | |
| 5,718,014 | A | 2/1998 | deBlois et al. | |
| 5,802,724 | A | 9/1998 | Rickard et al. | |
| 5,809,653 | A | 9/1998 | Everts et al. | |
| 5,855,067 | A | 1/1999 | Taomo et al. | |
| 5,926,961 | A | 7/1999 | Uhl | |
| 5,989,357 | A | 11/1999 | Vilhauer et al. | |
| 6,089,331 | A | 7/2000 | Christ | |
| 6,153,838 | A | 11/2000 | Wadge | |
| 6,170,579 | B1 | 1/2001 | Wadge | |
| 6,176,322 | B1 | 1/2001 | Wadge | |
| 6,181,032 | B1 | 1/2001 | Marshall et al. | |
| 6,185,782 | B1 | 2/2001 | Hall | |
| 6,206,107 | B1 | 3/2001 | Wadge | |
| 6,237,177 | B1 | 5/2001 | Richardson | |
| 6,263,979 | B1 | 7/2001 | Dyke et al. | |
| 6,263,980 | B1 | 7/2001 | Wadge | |
| 6,264,211 | B1 | 7/2001 | Granado | |
| D447,035 | S | 8/2001 | Netzler | |
| D447,037 | S | 8/2001 | Netzler | |
| D447,038 | S | 8/2001 | Netzler | |
| 6,286,611 | B1 | 9/2001 | Bone | |
| 6,301,788 | B1 | 10/2001 | Webster | |
| 6,352,127 | B1 | 3/2002 | Yorde | |
| 6,374,447 | B1 | 4/2002 | Armbruster et al. | |
| 6,459,955 | B1 | 10/2002 | Bartsch et al. | |
| 6,463,824 | B1 | 10/2002 | Prell et al. | |
| 6,488,511 | B1 | 12/2002 | Stewart | |
| 6,553,642 | B2 | 4/2003 | Driessen | |
| 6,634,439 | B2 | 10/2003 | Driessen | |
| 6,640,667 | B1 | 11/2003 | Pomerantz et al. | |
| 6,641,439 | B2 | 11/2003 | Kim | |
| 6,651,347 | B2 | 11/2003 | Uhl | |
| 6,755,597 | B2 | 6/2004 | Bergner et al. | |
| 6,813,797 | B1 * | 11/2004 | Kadinger | 15/104.04 |
| 6,832,531 | B1 | 12/2004 | Marquardt | |
| 6,851,254 | B1 | 2/2005 | Dalfors | |
| 6,923,094 | B1 | 8/2005 | Marquardt | |
| 6,964,077 | B2 * | 11/2005 | Kadinger et al. | 15/104.03 |
| 7,014,546 | B1 | 3/2006 | Birk | |
| 7,021,399 | B2 | 4/2006 | Driessen | |
| 7,114,824 | B2 | 10/2006 | Picone | |
| 7,121,598 | B2 | 10/2006 | Pourtier et al. | |
| 7,124,882 | B1 * | 10/2006 | Jadydy | 206/234 |
| 7,152,328 | B2 | 12/2006 | Champlin | |
| 7,191,677 | B2 * | 3/2007 | Barkdoll | 74/396 |
| 7,234,743 | B2 | 6/2007 | Robinson | |
| 7,255,024 | B2 | 8/2007 | Johnson et al. | |
| 7,334,503 | B1 | 2/2008 | Newman | |
| 7,354,408 | B2 | 4/2008 | Muchisky | |
| 7,356,867 | B1 * | 4/2008 | Beiermann | 15/23 |
| 7,363,673 | B2 | 4/2008 | Schonewille et al. | |
| 7,484,300 | B2 | 2/2009 | King et al. | |
| 7,743,683 | B2 | 6/2010 | Dayton et al. | |
| 7,913,345 | B2 | 3/2011 | Dayton et al. | |
| 7,926,141 | B2 | 4/2011 | Dayton et al. | |
| 2004/0003503 | A1 | 1/2004 | McDonald | |
| 2004/0074025 | A1 | 4/2004 | Blaustein et al. | |
| 2004/0255414 | A1 * | 12/2004 | Tulipana | 15/104.04 |
| 2005/0111214 | A1 | 5/2005 | Zeiler | |
| 2005/0243553 | A1 | 11/2005 | Picone | |
| 2007/0000138 | A1 | 1/2007 | Baskar et al. | |
| 2007/0050991 | A1 | 3/2007 | Mooney et al. | |
| 2007/0144310 | A1 * | 6/2007 | Pozgay et al. | 81/57.26 |
| 2007/0240892 | A1 | 10/2007 | Brotto et al. | |
| 2008/0047085 | A1 * | 2/2008 | Kolarevic et al. | 15/179 |
| 2008/0092311 | A1 | 4/2008 | Munn et al. | |
| 2008/0098553 | A1 | 5/2008 | Dayton et al. | |
| 2008/0104780 | A1 | 5/2008 | Dayton et al. | |
| 2008/0155769 | A1 | 7/2008 | Schonewille et al. | |
| 2008/0173138 | A1 | 7/2008 | Dayton et al. | |
| 2008/0189870 | A1 | 8/2008 | Dayton et al. | |
| 2008/0216869 | A1 | 9/2008 | Dayton et al. | |
| 2008/0250570 | A1 | 10/2008 | Dayton et al. | |

FOREIGN PATENT DOCUMENTS

| | | | |
|---|---|---|---|
| WO | WO-9857006 | A1 | 12/1998 |
| WO | WO-2005089020 | A1 | 9/2005 |
| WO | WO-2008/021848 | A3 | 2/2008 |
| WO | WO-2008021848 | A2 | 2/2008 |
| WO | WO-2008022167 | A2 | 2/2008 |
| WO | WO-2008022167 | A3 | 2/2008 |
| WO | WO-2009/059268 | A1 | 5/2009 |
| WO | WO-2009/061749 | A2 | 5/2009 |
| WO | WO-2009/061749 | A3 | 7/2010 |

OTHER PUBLICATIONS

"U.S. Appl. No. 11/834,908, Non-Final Office Action mailed Sep. 22, 2009", , 10 Pgs.

"U.S. Appl. No. 11/834,908, Final Office Action mailed Mar. 22, 2010", , 9.

"U.S. Appl. No. 11/834,908 Non-Final Office Action mailed Oct. 1, 2008", OARN , 13 Pgs.

"U.S. Appl. No. 11/838,697, Non-Final Office Action mailed Jan. 27, 2010", , 17.

"U.S. Appl. No. 11/935,296 Non-Final Office Action mailed Sep. 19, 2008", OARN , 10 Pgs.

"U.S. Appl. No. 12/027,204, Non-Final Office Action mailed Sep. 1, 2009", , 8.

"U.S. Appl. No. 12/027,204, Notice of Allowance mailed Apr. 21, 2010", , 6.

"U.S. Appl. No. 12/027,204, Non-Final Office Action mailed Dec. 23, 2008", , 11 pgs.

"U.S. Appl. No. 11/838,697, Final Office Action mailed Aug. 5, 2010", , 11.

"Gutter Scutter", http://robofesta.open.ac.uk/report2/ see Fig 29.

"The iRobot Looj", http://store.irobot.com/family/index.isp?categoryld=2878870.

"The Stihl Kombisystem and Yard Boss Website", http://www.stihlusa.com/multitask/.

ISA, "International Search Report and Written Opinion", For US Patent Application No. PCT/US07/75954, mailed on Apr. 11, 2008 Mar. 3, 2008.

ISA, "International Search Report and Written Opinion", For US Patent Application No. PCT/US08/82179, mailed on Apr. 9, 2009 Apr. 8, 2009.

ISR, "International Search Report and Written Opinion", For US Patent Application No. PCT/US08/82383, mailed on Apr. 27, 2009 Apr. 27, 2009.

* cited by examiner

1600

1900

2300

SYSTEMS AND METHODS OF A POWER TOOL SYSTEM WITH INTERCHANGEABLE FUNCTIONAL ATTACHMENTS POWERED BY A DIRECT ROTATIONAL DRIVE

CROSS-REFERENCE TO RELATED APPLICATIONS

This application is a continuation of U.S. patent application Ser. No. 12/027,204 filed Feb. 6, 2008, which is hereby incorporated by reference in its entirety, and which claims the benefit of the following provisional applications, each of which is hereby incorporated by reference in its entirety: U.S. Provisional Appl. No. 60/952,938, filed Jul. 31, 2007; U.S. Provisional Appl. No. 60/985,573, filed Nov. 5, 2007; and U.S. Provisional Appl. No. 61/020,471, filed Jan. 11, 2008.

Application Ser. No. 12/027,204 is a continuation-in-part of the following U.S. patent applications, each of which is hereby incorporated by reference in its entirety: U.S. application Ser. No. 11/838,697, filed Aug. 14, 2007 which claims the benefit of U.S. Provisional Appl. No. 60/837,993, filed Aug. 15, 2006; U.S. application Ser. No. 11/935,296, filed Nov. 5, 2007; and U.S. application Ser. No. 11/972,663, filed Jan. 11, 2008.

BACKGROUND

1. Field

The present invention generally relates to systems and methods for a multi-functional power tool system, and in particular, a gutter cleaning system.

2. Description of the Related Art

Tools are often designed to carry out a single function, and thus, an individual may need to purchase and maintain multiple tools, such as a tool for each task they may want to complete, where a tool may facilitate completion of the task. Further, some tasks are prohibitively dangerous for a user wishing to complete the task by themselves, such as gutter cleaning from the top of a ladder. A need exists for a tool that is capable of carrying out a single function, such as gutter cleaning, or multiple functions and may be operated at a distance from the user.

SUMMARY

Provided herein is a multi-functional power tool system operable at a distance from a user, comprising an interchangeable functional module and a power base for mounting and powering the functional module. The tool may enable use of a single base piece that may provide power, handling, and the like, to which modules with different functions may be attached.

In an aspect, a method and system of a power tool system includes providing a power base for mounting and powering a functional module comprising an end effecter, the power base configured to mount various functional modules, assembling the power tool system by mounting the functional module to a mounting plate of the power base, and controlling the power tool system using a control disposed in the power base. In the system and method, the power base may include a power head, a pole, and a control module. The power head may include a gearbox connected to an output shaft of a power head gear motor to provide the rotational torque of the gear shaft at the proper orientation and rpm required by an end effecter of a functional module. The gear may be at least one of a planetary cluster, worm and worm gear, bevel gear, internal gear, spur gear, and right angle gear. The mechanical mechanism connected to the output of the gearbox may provide the appropriate motion to the end effecter. The mechanism may be at least one of a crankshaft and connecting rod, a bell crank to provide reciprocating motion, a geneva wheel to provide intermittent motion, and a mechanical modifier of the rotational motion. An electrical mechanism connected to the output of the gearbox may provide the appropriate motion to the end effecter. The electrical mechanism may be at least one of a solenoid or servo motor to effect on/off functions, a limit switch to stop and start aspects of the mechanical system within the tool, a sensor for controlling an end effecter of a functional module or for responding to the environment, a laser and a vision system. The power head may include a power take-off coupling, wherein the coupling provides a connection for a functional module to at least one of a gear motor and an electrical control element. The coupling may include an automatic speed selection feature that engages a speed selector mechanism to automatically match the output speed of the power head to the ideal input speed of the functional module. The selector mechanism may include a mechanically activated pushrod that moves a speed select lever of the power head to the chosen speed automatically by positioning a selector rod to the right length. The selector mechanism may include a sensor on the power head connection plate that identifies the functional module and makes the speed selection in the gearbox electromechanically. The gear motor may be operably connected to a power take-off coupling to provide a power input from the gear motor to a functional module. The system and method may include disposing a pole between the power head and the control module. The pole may include connectors on each end of the pole or pole segment to provide at least one of an electrical and mechanical connection between the power head and control module. The pole may be at least one of telescoping, segmented, and off-the-shelf. The segmented pole may include coaxial connectors on either end of the pole segment to provide power from the control module to the power base. The pole may be threaded on each end to connect to corresponding threads on the power base and the control module. A wire connecting the control module to the power head may be disposed through, around, or along the pole. In the system and method, power may be provided to the power tool system by at least one of a battery, a solar panel, an internal combustion engine, and an electrical cord. In the system and method, the mounting plate may utilize a quick release connection. In the system and method, the functional module may comprise a connection plate, the tool body, and the end effecter. Elements of the functional module may be common for a family of functional modules such that only the end effecter is removed to mount a different tool. In the system and method, the functional module may include at least one of a motor, speed gearing, and torque gearing. The motor may transfer power to a gearbox via a coupling and a gearbox output shaft passes the conditioned power to the tool mechanism of the functional module.

In an aspect of the invention, a system and method of a power tool system for operating a spray can may include providing a power base for mounting and powering a functional module for holding and actuating a spray can nozzle, the power base configured to mount various functional modules, assembling the power tool system by mounting the functional module to a mounting plate of the power base, and controlling the power tool system using a control disposed in the power base. In the system and method, the functional module may connect the spray can by a clamp configured to grip the diameter of the can. The clamp may be at least one of a band clamp, a C-clamp, a clamshell clamp, a closed ring, a sticky foam or viscoelastic polymer band, and a magnetic band. In the system and method, the functional module includes a connection plate, a tool body, and an end effecter. In the system and method, the power base includes a power head, a pole, and a control module. In the system and method, the functional module connects to the power head of the power tool system by a connection plate that registers and couples the power output shaft of the power head to the input drive shaft of the functional module. In the system and method, activation of the spray can nozzle may be accomplished by depressing a nozzle plate against the spray can nozzle as it hinges from a connection point on the tool body. The activation force may be provided by a friction cam that is activated by the rotational force applied by the input drive shaft, driving the nozzle plate downward when torque is applied by activation of the power head motor by the user and depressing the aerosol nozzle thus dispensing the spray can contents. The activation force may be provided by a short-stroke power out solenoid that is activated by electrical current applied by the power system of the power tool system and conducted through the electrical contact to the solenoid. The stroke of the solenoid rod on the back beam of the nozzle plate may be enough to drive the front beam of the nozzle plate downward onto the spray nozzle, that force being enough to depress the spray nozzle but not enough to overwhelm the mechanical system when the nozzle reaches the stop point and the stroke of the solenoid is at its end. The nozzle plate may be held in the open position by a spring. The spring may be at least one of torsion, mechanical, pneumatic, hydraulic, and magnetic. When the nozzle reaches the stop point, the input shaft may rotate freely inside the cam with the limiting torque being adjustable by a friction collar and a friction collar adjusting screw so that the correct balance is obtained.

In an aspect of the invention, a system and method of a power tool system for operating a hedge trimmer tool may include providing a power base for mounting and powering a functional module comprising a sickle bar knife for generating a shearing motion, the power base configured to mount various functional modules, assembling the power tool system by mounting the functional module to a mounting plate of the power base, and controlling the power tool system using a control disposed in the power base. In the system and method, the sickle bar knife may include a row of blades that passes by another row of blades in close proximity to create a shearing motion between the knife edges. In the system and method, the power base may include a power head, a pole, and a control module. The hedge trimmer tool attachment may connect to the power head of the power tool system by a connection plate that registers and couples the power output shaft of the power head to the input drive shaft of the hedge trimmer tool attachment. The power head may include a gear motor. The gear motor may drive the input shaft of the hedge trimmer tool which may drive a gearbox that creates reciprocating motion which activates the sickle bar knife of the hedge trimmer tool. The input shaft may include a right angle bevel gear that engages a similar bevel gear at ninety degrees orientation so that the power shaft rotates at identical rpm in a vertical orientation relative to the long axis of the sickle bar cutter. Mounted to the top of the power shaft in the horizontal plane of the sickle bar cutter may be a flywheel with an eccentric crank pin that orbits the vertical axis of the power shaft at the same rpm as the power shaft. The crank pin may engage in a cross slot in the movable blade and as it moves in its orbit creates a reciprocating motion of the sickle bar movable blade. In the system and method, the moving set of blades may be trapped between the stationary blade that forms the chassis of the sickle bar and a top frame that is attached with high precision to the stationary blade to permit the movable blade freedom to move on the longitudinal axis with high precision.

In an aspect of the invention, a system and method of a power tool system for operating a paint roller tool may include providing a power base for mounting and powering a functional module comprising a pump assembly, hose and paint roller head, the power base configured to mount various functional modules, assembling the power tool system by mounting the functional module to a mounting plate of the power base, and controlling the power tool system using a control disposed in the power base. In the system and method, the power base may include a power head, a pole and a control module. The paint roller tool attachment may connect to the power head of the power tool system by a connection plate that registers and couples the power output shaft of the power head to the input drive shaft of the paint roller tool attachment. The paint roller tool may include a power coupling that engages the power output shaft of the power head. The output shaft may be coupled to a pressure pump that increases the pressure of the paint within the manifold supply housing and ensures that the pressure in the paint distribution manifold is sufficient to evenly distribute the paint along the length of the paint roller. In the system and method, the power head may include a gear motor. In the system and method, the painting roller head attaches to the power head of the power tool system. In the system and method, the pump assembly engages the lid attachment recess of a paint can. In the system and method, the pump assembly may utilize a siphon paint delivery tube that extends below the lid attachment of a paint can to take paint from the lowest point of the paint can so it will work until the paint is exhausted. In the system and method, wherein the pump may be self-priming and will push the paint up the paint delivery tube that coils on or beside the pole of the power tool system. In the system and method, wherein the functional module includes a connection plate, tool body, and end effecter. The tool body may include a connection for a paint delivery tube and a distribution manifold that distributes paint evenly along the length of the roller. The roller may include a paint spray shield that protects the user and environment from splatter as the paint is applied. In the system and method, the pump may be powered by at least one of a battery, a rechargeable battery, a standard 110 VAC line current with a standard plug and electric cable, a generator, fossil fuels, biofuels, and solar power. In the system and method, the components of the power tool system may disassemble for clean-up or disposal.

In an aspect of the invention, a system and method of a power tool system for operating a tree saw tool may include providing a power base for mounting and powering a functional module comprising a tree saw, the power base configured to mount various functional modules, assembling the power tool system by mounting the functional module to a mounting plate of the power base, and controlling the power tool system using a control disposed in the power base. In the system and method, the power base may include a power head, a pole and a control module. The tree saw tool attachment may connect to the power head of the power tool system by a connection plate that is registered to resolve the torque load and couples the power output shaft of the power head to the input drive shaft of the tree saw tool attachment. The input shaft may be connected to a right angle bevel gear that drives a similar mating bevel gear at ninety degrees on a vertical output shaft. A flywheel may be affixed to the top of the output shaft, wherein the flywheel comprises a crankpin attached at the outer perimeter. A connecting rod may pivot upon the crankpin that in turn is connected by another pivot connection to the end of the piston shaft. The flywheel may rotate the connecting rod's pivot-attached end at the crankpin describing a circle, the diameter of which is the stroke of the piston rod pivot-attached at the other end and wherein for every rotation of the flywheel, the piston rod makes one forward and one backward stroke. At the far end of the piston may be a chuck that captures the end of the saw blade. In the system and method, on either side of the saw blade may be a blade guard element, both of which are combined together on a hinge pin to create a rigid element and that is spring-loaded upward to the closed position to protect against impingement on the blade. In the closed position, the front of the blade guard may have a mouth-like opening that when pushed against a cylindrical object will force open the blade guard admitting the branch object and capturing it between the guard and the saw blade. In the system and method, on either side of the saw blade may be a blade guard, both of which are combined together on a hinge pin to create a rigid element and that is spring-loaded downward to the closed position to protect against impingement on the blade. In the closed position the blade guard may form a hook that can be hooked over a tree branch to support the weight of the power tool system head assembly at an end. The spring-loaded blade guard moves upward out of the way while the cut progresses and snaps back into place to protect the saw blade when the cut is complete. In the system and method, the tree saw tool may include a power coupling that engages the power output shaft of the power head. In the system and method, the functional module may include a connection plate, tool body, and end effecter. The body of the tree saw tool may include a mechanism that converts the rotational input from the power head into reciprocating motion that drives the saw blade. The tree saw tool may include a mechanism that converts the rotational input from the power head into reciprocating motion that drives a piston arm and at the end there is a releasable chuck that holds a saw blade. The body of the tree saw tool may include a right angle drive gearbox and a mechanism that converts the rotational input from the power head into reciprocating motion that drives a releasable chuck that holds the saw blade. In the system and method, the tree saw blade may be protected by a hinged and spring-loaded blade guard that opens when forced against the tree branch and holds the blade in alignment as the cutting takes place.

In an aspect of the invention, a system and method of a multi-functional power tool system may include providing a power base for mounting and powering a functional module, the power base configured to mount various functional modules, assembling the multi-functional power tool system by mounting the functional module to a mounting plate of a power head of the power base, powering the functional module by the direct rotational drive of the power head, and controlling the multi-functional power tool system using a control disposed in the power base. In the system and method, the functional module may be at least one of a cleaning module, a gutter cleaning module, a holding and fastening module, a finishing and painting module, an inspection module, and a landscape/garden module. The cleaning module may be at least one of a microvacuum module, a vacuum head, a brush, a crevice nozzle, a rotating feather duster, a turbine dusting blower, a power window cleaner with fluid dispensing head powered roller with squeegee, a sweeper, a scrub brush, a liquid pump, a degreaser pump, rotary circular brushes, rotary buffing and polishing pads, and a shoe shiner. The cleaning module may include a brush or pad that is one-piece molded to a circular drive platform or assembled as a component system. The gutter cleaning module may be at least one of a gutter-cleaning device with impellers, a counter-rotating brush gutter cleaner, a downspout cleaning brush, a vibratory micro-needle for ice removal, an auger brush, an auger tool with impellers, and an auger tool with teeth. The holding and fastening module may be at least one of a dual suction cup flat panel gripper with remote actuate and release, a light bulb changer with rotary head, a drill/driver with remote interchangeable bits, a power nailer/stapler, a wire/cord stapler, and two-arm gripper. The finishing and painting module may be at least one of a powered paint roller with remote paint supply, a paint sprayer with paint cup, a paint can sprayer, a two-drum wall sander, and an orbital ¼ sheet sander. The inspection module may be at least one of a digital wireless video/still camera with remote viewing screen, a remote viewing screen, an infrared thermal imager, a moisture detector, a mold detector, and a radon detector. The landscape/garden module may be at least one of a pruning shear, an insecticide spray can actuator, a remote actuated hose nozzle, a remote actuated watering can, a fruit picker, a weed whacker, an edger, a broadcast spreader, a leaf blower, a snow remover, a mulcher, a composter, a trimmer, an aerator, a reel mower, a reciprocating scythe, a rake, and a rotary blade mower. In the system and method, the power base may include a power head and a control module. In the system and method, the mounting plate may utilize a quick release connection. In the system and method, the functional module may be connected to the rotational drive of the power head by a mechanical attachment mechanism. The mechanical attachment may include at least one of a three-jaw chuck with a chuck key, a keyless three jaw chuck, a detent-action hex chuck, a chuck with reduction gearing, an in-line planetary gearhead, a ninety degree hex shaft chuck with a spring-release ball-detent retention of the hex shaft of the tool within the chuck itself, and a ninety degree hex shaft chuck with a ball detent retention of the hex shaft of the tool within the chuck itself. The functional module may include a hex shaft for attaching to the right-angle drive of the direct coupled hex chuck. The functional module may attach to an adjustable angle drive utilizing a ring bevel gear coupling a double bevel gear on the input and output shaft. The mechanical attachment may be coupled to the power tool system power head by a connection plate that provides registration features to align mechanical components and resist torque couples and slip free engagement of the power output shaft to the input shaft of the mechanical attachment. An in-line gearbox assembly may be attached to the power head by a connection plate that provides registration features to align mechanical components and resist torque couples and slip free engagement of the power output shaft to the input shaft of the mechanical attachment.

In an aspect of the invention, a system and method of a power tool system for washing windows may include providing a power base for mounting and powering a window washing functional module, the power base configured to mount various functional modules, assembling the window washing power tool system by mounting the window washing functional module to a mounting plate of a power head of the power base, and controlling the window washing power tool system using a control disposed in the power base. In the system and method, the window washing functional module may include a rotating scrubbing brush, a washing fluid dispensing system and a squeegee. In the system and method, the power head may include a rotating joint that allows a user to adjust the angle of the window washing tool to the window plane. In the system and method, the window washing functional module may attach to the power head by a connection plate that provides registration features to align mechanical components and resist torque couples and provides slip-free engagement of the power output shaft to the input shaft of the window washing tool assembly. In the system and method, the rotational power provided by the power head may be transferred via a gear train in the body of the functional module to turn a brush with the geartrain connecting to the horizontal rotational axis of the brush. In the system and method, washing fluid may be dispensed onto the window via distribution tubes and spray heads by an electrical pump internal to the body of the functional module. In the system and method, the user may squeegee the glass clean with the built-in squeegee that can be activated to the forefront use condition by an electrical input from the power base. In the system and method, the rotational power provided by the power head may be transferred via the input shaft to a right angle input bevel gear that meshes with an identical output bevel gear at right angles to the input gear that drives a horizontal transfer shaft. Either of the bevel gears may be of a different pitch diameter to provide a gear reduction or increase as required by the output rotational speed desired for the brush. At least one end of the transfer shaft may have an affixed timing gear that transfers the power to another timing gear affixed to the end of the brush's central shaft. At least one end of the transfer shaft may have an affixed ninety degree bevel gear that transfers the power to another ninety degree bevel gear affixed to the end of the brush's central shaft. In the system and method, a flexible shaft drive may affix on one end to the transfer shaft and transfer the power to the brush through an attachment to the end of the brush's central shaft. The system and method may include supplying cleaning fluid to the window surface via a fluid reservoir and pump system, wherein cleaning fluid is dispensed by an electrical pump to the window surface. The fluid reservoir may be refillable by a fluid channel with a fluid-proof cap. The pump may pull washing fluid from the reservoir via a conveyance tube and pressurize the fluid as it pumps it into the distribution tube by which it is conveyed to at least one of the spray nozzles and the brush. In the system and method, the squeegee may be mounted on an armature with a pivot on or near the rotational axis of the brush. The squeegee armature may be activated to the forefront use condition by a control disposed in the power base to provide translation of and appropriate force and direction so that the squeegee blade moves forward to a foremost contact point to facilitate the movement of the window washing assembly to squeegee the fluid and dirt from the window surface.

In an aspect of the invention, a system and method of a power tool system for gripping may include providing a power base for mounting and powering a functional module comprising a gripper with a hub, the tool body, and a connection plate, the power base configured to mount various functional modules, assembling the power tool system by mounting the gripping functional module to a mounting plate of a power head of the power base, and controlling the power tool system using a control disposed in the power base. In the system and method, the gripper may include a gripping side and an attaching side, the gripper having a flexible shape. The flexible shape may be formed by a plurality of fingers, the fingers being compliant. The gripper may include a polymer disposed on the gripping side. The polymer may be a low viscosity viscoelastic polymer. In the system and method, a connection plate may register and couple the power output shaft of the power head to the input drive shaft of the gripper. In the system and method, the power head may include a gear head, the gear head being adapted to receive an input torque at a first speed and to rotate the gripper with an output torque at a second speed, the first speed being greater than the second speed. In the system and method, an input shaft of the functional module may be attached to a worm that engages a worm gear on a transverse vertical shaft that rotates at a greatly reduced rpm and in turn is attached to a right angle bevel gear. The right angle bevel gear may be mated with an identical bevel gear attached to an output shaft at ninety degrees to drive the torque limiting slip-clutch, wherein the output shaft connects to the driving bevel gear and to a slip-clutch cage as a single rotating unit. Internal to the slip-clutch cage may be a split friction sleeve that creates an adjustable friction connection between the slip-clutch cage and an internal drive sleeve. The adjustable friction may be applied by set screws that apply inward pressure on the split sleeve. The drive sleeve may be affixed to the output hex shaft of a quick-release hex chuck of the functional module by a hex bore in the drive sleeve that resolves the torque load transferred to the drive sleeve. The quick-release hex chuck may be retained by a retainer washer, keeping the assembly contained within the body of the functional module. The gear head may include a torque-limiting clutch that is adapted to limit the output torque. The torque-limiting clutch may be an adjustable friction clutch. In the system and method, the power head may include an electric motor gear head adapted to rotate the gripper, a pole having a first end and a second end, the electric motor gear head being disposed on the first end, the second end being adapted to attach to a remote power base, and a wire having a first end and a second end, the first end of the wire being connected to the electric motor gear head, and the second end of the wire being adapted to connect to an electrical connector of the remote power base. The pole may be a segmented pole. The pole may be a telescoping pole. The electric motor gear head may include a torque-limiting clutch that is adapted to limit a torque of the electric motor gear head. The torque-limiting clutch may be an adjustable friction clutch. In the system and method, the system may be adapted to change a light bulb. In the system and method, the hub may include a hex shaft that couples to a hex chuck of the functional module. In the system and method, the hub of the gripper may attach to the tool body with a quick release mechanism.

In an aspect of the invention, a method and system of a reciprocating tree saw power tool may comprise a power base for powering a reciprocating tree saw attachment, the power base configured to power various other functional modules; a mounting plate of the power base for associating the reciprocating tree saw attachment with the power base; and a control module disposed in the power base for controlling the reciprocating tree saw attachment. In the method and system, a power head may be associated with the power base, the power head may comprise a motor operably connected to a power take-off coupling to provide a power input from the motor to the reciprocating tree saw attachment. In the method and system, the control module may comprise at least one of an energy storage facility, a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The method and system may further comprise a pole disposed between a power head and a control module of the power base, wherein the pole is at least one of telescoping, coaxially segmented, and off-the-shelf.

In an aspect of the invention, a clamping nailer/stapler power tool system may comprise a power base for powering a clamping nailer/stapler attachment, the power base configured to power various other functional modules; a mounting plate of the power base for associating the clamping nailer/ stapler attachment with the power base; and a control module disposed in the power base for controlling the clamping nailer/stapler attachment. In the method and system, a power head may be associated with the power base, the power head may comprise a motor operably connected to a power take-off coupling to provide a power input from the motor to the clamping nailer/stapler attachment. In the method and system, the control module may comprise at least one of an energy storage facility, a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The method and system may further comprise a pole disposed between a power head and a control module of the power base, wherein the pole is at least one of telescoping, coaxially segmented, and off-the-shelf.

In an aspect of the invention, a bulb planting auger power tool system may comprise a power base for powering a bulb planting auger attachment, the power base configured to power various other functional modules; a mounting plate of the power base for associating the bulb planting auger attachment with the power base; and a control module disposed in the power base for controlling the bulb planting auger attachment. In the method and system, a power head may be associated with the power base, the power head may comprise a motor operably connected to a power take-off coupling to provide a power input from the motor to the bulb planting auger attachment. In the method and system, the control module may comprise at least one of an energy storage facility, a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The method and system may further comprise a pole disposed between a power head and a control module of the power base, wherein the pole is at least one of telescoping, coaxially segmented, and off-the-shelf.

In an aspect of the invention, a sickle bar hedge trimmer power tool system may comprise a power base for powering a sickle bar hedge trimmer attachment, the power base configured to power various other functional modules; a mounting plate of the power base for associating the sickle bar hedge trimmer attachment with the power base; and a control module disposed in the power base for controlling the sickle bar hedge trimmer attachment. In the method and system, a power head may be associated with the power base, the power head may comprise a motor operably connected to a power take-off coupling to provide a power input from the motor to the sickle bar hedge trimmer attachment. In the method and system, the control module may comprise at least one of an energy storage facility, a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The method and system may further comprise a pole disposed between a power head and a control module of the power base, wherein the pole is at least one of telescoping, coaxially segmented, and off-the-shelf.

In an aspect of the invention, an inspection camera power tool system may comprise a power base for powering an inspection camera attachment, the power base configured to power various other functional modules; a mounting plate of the power base for associating the inspection camera attachment with the power base; and a control module disposed in the power base for controlling the inspection camera attachment. In the method and system, a power head may be associated with the power base, the power head may comprise a motor operably connected to a power take-off coupling to provide a power input from the motor to the inspection camera attachment. In the method and system, the control module may comprise at least one of an energy storage facility, a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The method and system may further comprise a pole disposed between a power head and a control module of the power base, wherein the pole is at least one of telescoping, coaxially segmented, and off-the-shelf.

In an aspect of the invention, a vacuum cup bulb changer power tool system may comprise a power base for powering a vacuum cup bulb changer attachment, the power base configured to power various other functional modules; a mounting plate of the power base for associating the vacuum cup bulb changer attachment with the power base; and a control module disposed in the power base for controlling the vacuum cup bulb changer attachment. In the method and system, a power head may be associated with the power base, the power head may comprise a motor operably connected to a power take-off coupling to provide a power input from the motor to the vacuum cup bulb changer attachment. In the method and system, the control module may comprise at least one of an energy storage facility, a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The method and system may further comprise a pole disposed between a power head and a control module of the power base, wherein the pole is at least one of telescoping, coaxially segmented, and off-the-shelf.

In an aspect of the invention, a method of a gutter cleaning system may comprise providing a housing configured to fit into a gutter; disposing at least one impeller at an end of the housing; driving the impeller with an impeller drive facility, the impeller drive facility being disposed within the housing; and attaching the housing to a placement facility for guiding the housing along the gutter. In the method, the impeller may be removably connected, may be rotating, or may be configured to remove debris from a gutter. In the method, the impeller drive facility includes a transmission. In the method, the housing may include an energy storage facility. In the method, the method may further comprise providing a control facility associated with the gutter cleaning system, wherein the control facility provides control of the gutter-cleaning system. The control facility may be at least one of a remote control facility, a manual control disposed on the housing, and a manual control disposed on the placement facility. The remote control facility may include a wireless communication facility. In the method, the method may further comprise providing an impeller chute for housing a portion of the impeller, wherein debris may be rotated against the chute by the impeller prior to ejection from the gutter. In the method, the method may further comprise disposing debris tines at one or both ends of the housing to loosen and lift matted debris from the bottom and sides of the gutter into the impeller. The debris tines may be formed from at least one of metal, wood, plastic, and molded elastomer. The debris tines may be coated with a solid debris removal solvent. In the method, the impeller may be formed from at least one of a molded elastomer, neoprene, rubber, plastic, and an electrostatic cloth, or may be at least one of a helical-bristled brush, a flexible paddle, a full stiff bristle brush, a spiral stiff bristle brush, a wire brush, a dethatching brush, an alternating paddle brush, a flexible bucket, a multiply-vaned impeller, a counter-rotating brush, and an alternating flexible blade. In the method, the method may further comprise attaching a support guide to the housing to support the housing in the gutter. In the method, the method may further comprise disposing a vision system on at least one of the housing, an impeller, and a placement facility for facilitating a visualization of the gutter. The vision system may comprise a solid state camera, a camera lens, and a video signal electronics module. The vision system may comprise a mirror. In the method, the method may further comprise disposing a moisture sensor on the housing for detecting prohibitive levels of moisture in a gutter. In the method, the method may further comprise providing at least one of an on-board tool or attachment, a downspout cleaning tool, an air hose attachment, a water hose attachment, a vacuum facility, and a weed whacker attachment. The vacuum facility may provide a vacuum through at least one of the impellers, the impeller vane attachment point, the housing, and a vacuum hose attachment. In the method, the impeller drive facility may be at least one of a reversing gear motor, an electric motor, a gasoline- or biofuel-powered internal combustion engine, and a solar-powered motor. In the method, the housing may be formed from at least one of metal, plastic, molded elastomer, weather-resistant materials, water-resistant materials, solvent-resistant materials, temperature-resistant materials, shock-resistant materials, and breakage-resistant materials. In the method, the method may further comprise connecting an energy storage facility to the impeller drive facility for providing power. The energy storage facility may be at least one of a battery, a gasoline fuel or biofuel tank, a power cord, and a solar panel. The battery may be at least one of rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, and nickel oxyhydroxide. In the method, the method may further comprise disposing on the housing at least one of a timer, a digital clock, a thermometer, a radio, an MP3 player, a weather station, a light, a fan, and a storage area. In the method, the method may further comprise disposing on the placement facility at least one of a timer, a digital clock, a thermometer, a radio, an MP3 player, a weather station, a light, a fan, and a storage area. In the method, attaching may be facilitated by at least one of a nut and bolt, a screw, a nail, a rivet, a magnet, an adhesive, a hook-and-loop, an interference locking system, a threaded connection, a sliding attachment, a hinge, a clamp, a tab, a spring-loaded attachment, a sleeve attachment, a snap-fit connection, a ball closure, discrete interlocks, a clasp, a clip, a zipper, a snap, a gasket, an O-ring type closure, a hook-and-eye, and a spring-locking hinge.

In another aspect of the invention, a gutter cleaning system may comprise a housing configured to fit into a gutter; at least one impeller disposed at an end of the housing; an impeller drive facility for driving the impeller, the impeller drive facility being disposed within the housing; and a placement facility attached to the housing for guiding the housing along the gutter. In the system, the impeller may be removably connected, a rotating impeller, or configured to remove debris from a gutter. In the system, the impeller drive facility may include a transmission and the housing may include an energy storage facility. In the system, the system may further comprise a control facility associated with the gutter cleaning system, wherein the control facility provides control of the gutter-cleaning system. The control facility may be at least one of a remote control facility, a manual control disposed on the housing, and a manual control disposed on the placement facility. The remote control facility may include a wireless communication facility. In the system, the system may further comprise an impeller chute for housing a portion of the impeller, wherein debris may be rotated against the chute by the impeller prior to ejection from the gutter. In the system, the system may further comprise debris tines disposed at one or both ends of the housing to loosen and lift matted debris from the bottom and sides of the gutter into the impeller. The debris tines may be formed from at least one of metal, wood, plastic, and molded elastomer. The debris tines may be coated with a solid debris removal solvent. In the system, the impeller may be formed from at least one of a molded elastomer, neoprene, rubber, plastic, and an electrostatic cloth, or may be at least one of a helical-bristled brush, a flexible paddle, a full stiff bristle brush, a spiral stiff bristle brush, a wire brush, a dethatching brush, an alternating paddle brush, a flexible bucket, a multiply-vaned impeller, a counter-rotating brush, and an alternating flexible blade. In the system, the system may further comprise a support guide attached to the housing to support the housing in the gutter. The system may further comprise a vision system disposed on at least one of the housing, an impeller, and a placement facility for facilitating a visualization of the gutter. The vision system may comprise a solid state camera, a camera lens, and a video signal electronics module. The vision system may comprise a mirror. The system may further comprise a moisture sensor disposed on the housing for detecting prohibitive levels of moisture in a gutter. The system may further comprise at least one of an on-board tool or attachment, a downspout cleaning tool, an air hose attachment, a water hose attachment, a vacuum facility, and a weed whacker attachment associated with the housing. The vacuum facility may provide a vacuum through at least one of the impellers, the impeller vane attachment point, the housing, and a vacuum hose attachment. In the system, the impeller drive facility may be at least one of a reversing gear motor, an electric motor, a gasoline- or biofuel-powered internal combustion engine, and a solar-powered motor. In the system, the housing may be formed from at least one of metal, plastic, molded elastomer, weather-resistant materials, water-resistant materials, solvent-resistant materials, temperature-resistant materials, shock-resistant materials, and breakage-resistant materials. The system may further comprise an energy storage facility connected to the impeller drive facility for providing power. The energy storage facility may be at least one of a battery, a gasoline fuel or biofuel tank, a power cord, and a solar panel. The battery may be at least one of rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, and nickel oxyhydroxide. The system may further comprise disposing on the housing at least one of a timer, a digital clock, a thermometer, a radio, an MP3 player, a weather station, a light, a fan, and a storage area. The system may further comprise disposing on the placement facility at least one of a timer, a digital clock, a thermometer, a radio, an MP3 player, a weather station, a light, a fan, and a storage area. In the system, attaching may be facilitated by at least one of a nut and bolt, a screw, a nail, a rivet, a magnet, an adhesive, a hook-and-loop, an interference locking system, a threaded connection, a sliding attachment, a hinge, a clamp, a tab, a spring-loaded attachment, a sleeve attachment, a snap-fit connection, a ball closure, discrete interlocks, a clasp, a clip, a zipper, a snap, a gasket, an O-ring type closure, a hook-and-eye, and a spring-locking hinge.

In another aspect of the invention, a method of a gutter cleaning system may comprise providing a housing configured to fit into a gutter; disposing at least one impeller at an end of the housing; driving the impeller with an impeller drive facility, the impeller drive facility being disposed within a power base; and attaching the housing to the power base for guiding the housing along the gutter. In the method, the power base may comprise a power head and a control module. The power head may comprise at least one of a motor, a gearbox, a gearset, a ring bevel gear, a pivot axis, a power take-off coupling for providing power from the motor to the functional module, the mounting plate, a pin mount, a pin lock mechanism for engagement of the module connection, a connection point with detent release, an articulated extensible pin actuator driven by an electrical solenoid to effect on/off selection of module functions, an axial push/pull solenoid body, an articulated sliding pin actuator driven by an electrical slide solenoid to effect analog mechanical input for module functions, a slide solenoid body, an electrical connector for data inputs to module functions, and a switch adaptable to different functional requirements of the various modules. The motor may be operably connected to a power take-off coupling to provide a power input from the motor to a functional module. The control module may comprise at least one of an energy storage facility, a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The battery may be rechargeable. The control switch may be at least one of a power switch, a module trigger, a module modulation switch, a speed control, a telescoping pole control, and a pivot control. The method may further comprise disposing a pole between the power head and the control module. The pole may be at least one of telescoping, segmented, collapsible, and off-the-shelf. The segmented pole may comprise coaxial connectors on either end of the pole segment to provide power from the control module to the power base. The pole may be threaded on each end to connect to corresponding threads on the power base and the control module. The connection between the pole segments, the pole and the power head, the pole and the control module, or the power head and the control module may be at least one of a threaded connection, a snap-fit connection, a magnetic attachment, an interference locking system, a tab, a ball closure, discrete interlocks, a clasp, a clip, a zipper, a snap, a gasket, an O-ring type closure, a hook-and-loop, a hook-and-eye, and a spring-locking hinge. A wire connecting the control module to the power head may be disposed through, around, or along the pole. The energy storage facility may be at least one of a battery, a solar panel, a gasoline- or biofuel-powered internal combustion engine, and an electrical cord. The mounting plate may utilize a quick release connection. The method may further comprise attaching a support guide to the housing to support the housing in a gutter. The method may further comprise disposing on the housing at least one of a timer, a digital clock, a thermometer, a radio, an MP3 player, a weather station, a light, a fan, and a storage area. The method may further comprise disposing on the power base at least one of a timer, a digital clock, a thermometer, a radio, an MP3 player, a weather station, a light, a fan, and a storage area. In the method, attaching may be facilitated by at least one of a nut and bolt, a screw, a nail, a rivet, a magnet, an adhesive, a hook-and-loop, an interference locking system, a threaded connection, a sliding attachment, a hinge, a clamp, a tab, a spring-loaded attachment, a sleeve attachment, a snap-fit connection, a ball closure, discrete interlocks, a clasp, a clip, a zipper, a snap, a gasket, an O-ring type closure, a hook-and-eye, and a spring-locking hinge. In the method, the impeller may be removably connected, a rotating impeller, or configured to remove debris from a gutter. In the method, the impeller drive facility may include a transmission. In the method, the housing may include an energy storage facility. The method may further comprise providing a control facility associated with the gutter cleaning system, wherein the control facility provides control of the gutter-cleaning system. The control facility may be at least one of a remote control facility, a manual control disposed on the housing, and a manual control disposed on the power base. The method may further comprise providing an impeller chute for housing a portion of the impeller, wherein debris may be rotated against the chute by the impeller prior to ejection from the gutter. The method may further comprise debris tines disposed at one or both ends of the housing to loosen and lift matted debris from the bottom and sides of the gutter into the impeller. The debris tines may be formed from at least one of metal, wood, plastic, and molded elastomer, or may be coated with a solid debris removal solvent. The impeller may be formed from at least one of a molded elastomer, neoprene, rubber, plastic, and an electrostatic cloth, or may be at least one of a helical-bristled brush, a flexible paddle, a full stiff bristle brush, a spiral stiff bristle brush, a wire brush, a dethatching brush, an alternating paddle brush, a flexible bucket, a multiply-vaned impeller, a counter-rotating brush, and an alternating flexible blade. The method may further comprise disposing a vision system on at least one of the housing, an impeller, and a placement facility for facilitating a visualization of the gutter. The vision system may comprise a solid state camera, a camera lens, and a video signal electronics module, or may comprise a mirror. The method may further comprise disposing a moisture sensor on the housing for detecting prohibitive levels of moisture in a gutter. The method may further comprise providing at least one of an on-board tool or attachment, a downspout cleaning tool, an air hose attachment, a water hose attachment, a vacuum facility, and a weed whacker attachment. The vacuum facility may provide a vacuum through at least one of the impellers, the impeller vane attachment point, the housing, and a vacuum hose attachment. In the method, the impeller drive facility may be at least one of a reversing gear motor, an electric motor, a gasoline- or biofuel-powered internal combustion engine, and a solar-powered motor. In the method, the housing may be formed from at least one of metal, plastic, molded elastomer, weather-resistant materials, water-resistant materials, solvent-resistant materials, temperature-resistant materials, shock-resistant materials, and breakage-resistant materials. The battery may be at least one of rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, and nickel oxyhydroxide.

In another aspect of the invention, a gutter cleaning system may comprise a housing configured to fit into a gutter; at least one impeller disposed at an end of the housing; an impeller drive facility for driving the impeller, the impeller drive facility being disposed within a power base; and a power base attached to a housing for providing power to the impeller drive facility. In the system, the power base may comprise a power head and a control module. The power head may comprise at least one of a motor, a gearbox, a gearset, a ring bevel gear, a pivot axis, a power take-off coupling for providing power from the motor to the functional module, the mounting plate, a pin mount, a pin lock mechanism for engagement of the module connection, a connection point with detent release, an articulated extensible pin actuator driven by an electrical solenoid to effect on/off selection of module functions, an axial push/pull solenoid body, an articulated sliding pin actuator driven by an electrical slide solenoid to effect analog mechanical input for module functions, a slide solenoid body, an electrical connector for data inputs to module functions, and a switch adaptable to different functional requirements of the various modules. The motor may be operably connected to a power take-off coupling to provide a power input from the motor to a functional module. The control module may comprise at least one of an energy storage facility, a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The battery may be rechargeable. The control switch may be at least one of a power switch, a module trigger, a module modulation switch, a speed control, a telescoping pole control, and a pivot control. The system may further comprise a pole disposed between the power head and the control module. The pole may be at least one of telescoping, segmented, collapsible, and off-the-shelf. The segmented pole may comprise coaxial connectors on either end of the pole segment to provide power from the control module to the power base, or may be threaded on each end to connect to corresponding threads on the power base and the control module. The connection between the pole segments, the pole and the power head, the pole and the control module, or the power head and the control module may be at least one of a threaded connection, a snap-fit connection, a magnetic attachment, an interference locking system, a tab, a ball closure, discrete interlocks, a clasp, a clip, a zipper, a snap, a gasket, an O-ring type closure, a hook-and-loop, a hook-and-eye, and a spring-locking hinge. A wire connecting the control module to the power head may be disposed through, around, or along the pole. The energy storage facility may be at least one of a battery, a solar panel, a gasoline- or biofuel-powered internal combustion engine, and an electrical cord. The mounting plate may utilize a quick release connection. The system may further comprise attaching a support guide to the housing to support the housing in a gutter. The system may further comprise disposing on the housing at least one of a timer, a digital clock, a thermometer, a radio, an MP3 player, a weather station, a light, a fan, and a storage area, or disposing on the power base at least one of a timer, a digital clock, a thermometer, a radio, an MP3 player, a weather station, a light, a fan, and a storage area. In the system, attaching may be facilitated by at least one of a nut and bolt, a screw, a nail, a rivet, a magnet, an adhesive, a hook-and-loop, an interference locking system, a threaded connection, a sliding attachment, a hinge, a clamp, a tab, a spring-loaded attachment, a sleeve attachment, a snap-fit connection, a ball closure, discrete interlocks, a clasp, a clip, a zipper, a snap, a gasket, an O-ring type closure, a hook-and-eye, and a spring-locking hinge. In the system, the impeller may be removably connected, a rotating impeller, or configured to remove debris from a gutter. In the system, the impeller drive facility may include a transmission. In the system, the housing may include an energy storage facility. The system may further comprise a control facility associated with the gutter cleaning system, wherein the control facility provides control of the gutter-cleaning system. The control facility may be at least one of a remote control facility, a manual control disposed on the housing, and a manual control disposed on the power base. The system may further comprise an impeller chute for housing a portion of the impeller, wherein debris may be rotated against the chute by the impeller prior to ejection from the gutter. The system may further comprise debris tines disposed at one or both ends of the housing to loosen and lift matted debris from the bottom and sides of the gutter into the impeller. The debris tines may be formed from at least one of metal, wood, plastic, and molded elastomer, or may be coated with a solid debris removal solvent. In the system, the impeller may be formed from at least one of a molded elastomer, neoprene, rubber, plastic, and an electrostatic cloth, or at least one of a helical-bristled brush, a flexible paddle, a full stiff bristle brush, a spiral stiff bristle brush, a wire brush, a dethatching brush, an alternating paddle brush, a flexible bucket, a multiply-vaned impeller, a counter-rotating brush, and an alternating flexible blade. The system may further comprise a vision system disposed on at least one of the housing, an impeller, and a placement facility for facilitating a visualization of the gutter. The vision system may comprise a solid state camera, a camera lens, a video signal electronics module, a mirror, and the like. The system may further comprise a moisture sensor disposed on the housing for detecting prohibitive levels of moisture in a gutter. The system may further comprise at least one of an on-board tool or attachment, a downspout cleaning tool, an air hose attachment, a water hose attachment, a vacuum facility, and a weed whacker attachment associated with the housing. The vacuum facility may provide a vacuum through at least one of the impellers, the impeller vane attachment point, the housing, and a vacuum hose attachment. In the system, the impeller drive facility may be at least one of a reversing gear motor, an electric motor, a gasoline- or biofuel-powered internal combustion engine, and a solar-powered motor. The housing may be formed from at least one of metal, plastic, molded elastomer, weather-resistant materials, water-resistant materials, solvent-resistant materials, temperature-resistant materials, shock-resistant materials, and breakage-resistant materials. In the system, the battery may be at least one of rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, and nickel oxyhydroxide.

In another aspect of the invention, a method of a multi-functional power tool system may comprise providing a power base for mounting and powering a functional module, the power base configured to mount various functional modules; assembling the multi-functional power tool system by mounting the functional module to a mounting plate of the power base; and controlling the multi-functional power tool system using a control disposed in the power base. In the method, the functional module may be at least one of a cleaning module, a gutter cleaning module, a holding and fastening module, a finishing and painting module, an inspection module, and a landscape/garden module. The cleaning module may be at least one of a microvacuum module, a vacuum head, a brush, a crevice nozzle, a rotating feather duster, a turbine dusting blower, a power window cleaner with fluid dispensing head powered roller with squeegee, a sweeper, a scrub brush, a liquid pump, a degreaser pump, a shoe shiner, a module suitable for cleaning all or part of a vehicle, and so on. The gutter cleaning module may be at least one of a gutter-cleaning device with impellers, a counter-rotating brush gutter cleaner, a downspout cleaning brush, a vibratory micro-needle for ice removal, an auger brush, an auger tool with impellers, and an auger tool with teeth. The holding and fastening module may be at least one of a dual suction cup flat panel gripper with remote actuate and release, a light bulb changer with rotary head, a drill/driver with remote interchangeable bits, a power nailer/stapler, a wire/cord stapler, two-arm gripper, a gripper suitable for grabbing a variety of household objects, and so on. The finishing and painting module may be at least one of a powered paint roller with remote paint supply, a paint sprayer with paint cup, a paint can sprayer, a two-drum wall sander, and an orbital ¼ sheet sander. The inspection module may be at least one of a digital wireless video/still camera with remote viewing screen, a remote viewing screen, an infrared thermal imager, a moisture detector, a mold detector, and a radon detector. The landscape/garden module may be at least one of a pruning shear, an aerosol spray can actuator, a remote actuated hose nozzle, a remote actuated watering can, a fruit picker, a weed whacker, an edger, a broadcast spreader, a leaf blower, a snow remover, a mulcher, a composter, a trimmer, an aerator, a reel mower, a reciprocating scythe, a rake, and a rotary blade mower. In the method, the power base may comprise a power head and a control module. The power head may comprise at least one of a motor, a gearbox, a gearset, a ring bevel gear, a pivot axis, a power take-off coupling for providing power from the motor to the functional module, the mounting plate, a pin mount, a pin lock mechanism for engagement of the module connection, a connection point with detent release, an articulated extensible pin actuator driven by an electrical solenoid to effect on/off selection of module functions, an axial push/pull solenoid body, an articulated sliding pin actuator driven by an electrical slide solenoid to effect analog mechanical input for module functions, a slide solenoid body, an electrical connector for data inputs to module functions, and a switch adaptable to different functional requirements of the various modules. The motor may be operably connected to a power take-off coupling to provide a power input from the motor to a functional module. The control module may comprise at least one of a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The battery may be rechargeable. The control switch may be at least one of a power switch, a module trigger, a module modulation switch, and a speed control. The method may further comprise disposing a pole between the power head and the control module. The pole may be at least one of telescoping, segmented, and off-the-shelf. The segmented pole may comprise coaxial connectors on either end of the pole segment to provide power from the control module to the power base. The pole may be threaded on each end to connect to corresponding threads on the power base and the control module. The connection between the pole segments, the pole and the power head, the pole and the control module, or the power head and the control module may be at least one of a threaded connection, a snap-fit connection, a magnetic attachment, an interference locking system, a tab, a ball closure, discrete interlocks, a clasp, a clip, a zipper, a snap, a gasket, an O-ring type closure, a hook-and-loop, a hook-and-eye, and a spring-locking hinge. A wire connecting the control module to the power head may be disposed through, around, or along the pole. Power may be provided to the power tool by at least one of a battery, a solar panel, an internal combustion engine, and an electrical cord. In the method, the mounting plate may utilize a quick release connection. The method may further comprise a support guide disposed on the housing for supporting the housing in a gutter. The method may further comprise disposing on the housing at least one of a timer, a digital clock, a thermometer, a radio, an MP3 player, a weather station, a light, a fan, and a storage area. The method may further comprise disposing on the power base at least one of a timer, a digital clock, a thermometer, a radio, an MP3 player, a weather station, a light, a fan, and a storage area. In the method, mounting may be facilitated by at least one of a nut and bolt, a screw, a nail, a rivet, a magnet, an adhesive, a hook-and-loop, an interference locking system, a threaded connection, a sliding attachment, a hinge, a clamp, a tab, a spring-loaded attachment, a sleeve attachment, a snap-fit connection, a ball closure, discrete interlocks, a clasp, a clip, a zipper, a snap, a gasket, an O-ring type closure, a hook-and-eye, and a spring-locking hinge. In the method, the function of the functional module may be adjusted by at least one of a user's manual adjustment and a control facility.

In another aspect of the invention, a multi-functional power tool system may comprise a power base for mounting and powering a functional module, the power base configured to mount various functional modules; a functional module mounted to a mounting plate of the power base; and a control disposed in the power base for controlling the functional module. In the system, the functional module may be at least one of a cleaning module, a gutter cleaning module, a holding and fastening module, a finishing and painting module, an inspection module, and a landscape/garden module. The cleaning module may be at least one of a microvacuum module, a vacuum head, a brush, a crevice nozzle, a rotating feather duster, a turbine dusting blower, a power window cleaner with fluid dispensing head powered roller with squeegee, a sweeper, a scrub brush, a liquid pump, a degreaser pump, and a shoe shiner. The gutter cleaning module may be at least one of a gutter-cleaning device with impellers, a counter-rotating brush gutter cleaner, a downspout cleaning brush, a vibratory (ultrasonic) micro-needle for ice removal, an auger brush, an auger tool with impellers, and an auger tool with teeth. The holding and fastening module may be at least one of a dual suction cup flat panel gripper with remote actuate and release, a light bulb changer with rotary head, a drill/driver with remote interchangeable bits, a power nailer/stapler, a wire/cord stapler, and a two-arm gripper. The finishing and painting module may be at least one of a powered paint roller with remote paint supply, a paint sprayer with paint cup, a paint can sprayer, a two-drum wall sander, and an orbital ¼ sheet sander. The inspection module may be at least one of a digital wireless video/still camera with remote viewing screen, a remote viewing screen, an infrared thermal imager, a moisture detector, a mold detector, and a radon detector. The landscape/garden module may be at least one of a pruning shear, an aerosol spray can actuator, a remote actuated hose nozzle, a remote actuated watering can, a fruit picker, a weed whacker, an edger, a broadcast spreader, a leaf blower, a snow remover, a mulcher, a composter, a trimmer, an aerator, a reel mower, a reciprocating scythe, a rake, and a rotary blade mower. In the system, the power base may comprise a power head and a control module. In the system, the power head may comprise at least one of a motor, a gearbox, a gearset, a ring bevel gear, a pivot axis, a power take-off coupling for providing power from the motor to the functional module, the mounting plate, a pin mount, a pin lock mechanism for engagement of the module connection, a connection point with detent release, an articulated extensible pin actuator driven by an electrical solenoid to effect on/off selection of module functions, an axial push/pull solenoid body, an articulated sliding pin actuator driven by an electrical slide solenoid to effect analog mechanical input for module functions, a slide solenoid body, an electrical connector for data inputs to module functions, and a switch adaptable to different functional requirements of the various modules. In the system, the motor may be operably connected to a power take-off coupling to provide a power input from the motor to a functional module. In the system, the control module may comprise at least one of an energy storage facility, a battery, a battery connection base, a latch for securing and removing the battery, a handle, a control switch, a toggle switch to control analog modulation of the link to the module, an on/off actuation switch to control digital functions in a module, and an I/O connector to facilitate computer programming of onboard power base or module functions. The battery may be rechargeable. The control switch may be at least one of a power switch, a module trigger, a module modulation switch, and a speed control. The system may further comprise a pole disposed between the power head and the control module. The pole may be at least one of telescoping, segmented, and off-the-shelf. The segmented pole may comprise coaxial connectors on either end of the pole segment to provide power from the control module to the power base. The pole may be threaded on each end to connect to corresponding threads on the power base and the control module. The connection between the pole segments, the pole and the power head, the pole and the control module, or the power head and the control module may be at least one of a threaded connection, a snap-fit connection, a magnetic attachment, an interference locking system, a tab, a ball closure, discrete interlocks, a clasp, a clip, a zipper, a snap, a gasket, an O-ring type closure, a hook-and-loop, a hook-and-eye, and a spring-locking hinge. A wire connecting the control module to the power head may be disposed through, around, or along the pole. Power may be provided to the system by at least one of a battery, a solar panel, an internal combustion engine, and an electrical cord. The mounting plate may utilize a quick release connection. The system may further comprise a support guide disposed on the housing for supporting the housing in a gutter. The system may further comprise at least one of a timer, a digital clock, a thermometer, a radio, an MP3 player, a weather station, a light, a fan, and a storage area disposed on the housing. The system may further comprise at least one of a timer, a digital clock, a thermometer, a radio, an MP3 player, a weather station, a light, a fan, and a storage area disposed on the power base. In the system, the functional module may be mounted with at least one of a nut and bolt, a screw, a nail, a rivet, a magnet, an adhesive, a hook-and-loop, an interference locking system, a threaded connection, a sliding attachment, a hinge, a clamp, a tab, a spring-loaded attachment, a sleeve attachment, a snap-fit connection, a ball closure, discrete interlocks, a clasp, a clip, a zipper, a snap, a gasket, an O-ring type closure, a hook-and-eye, and a spring-locking hinge. In the system, the function of the functional module is adjusted by at least one of a user's manual adjustment and a control facility.

In another aspect of the invention, a cleaning power tool system may comprise a power base for mounting and powering a functional module, the power base configured to mount various functional modules; a cleaning module mounted to a mounting plate of the power base; and a control disposed in the power base for controlling the cleaning module. The cleaning module may be at least one of a microvacuum module, a vacuum head, a brush, a crevice nozzle, a rotating feather duster, a turbine dusting blower, a power window cleaner with fluid dispensing head powered roller with squeegee, a sweeper, a scrub brush, a liquid pump, a degreaser pump, and a shoe shiner.

In another aspect of the invention, a gutter cleaning power tool system may comprise a power base for mounting and powering a functional module, the power base configured to mount various functional modules; a gutter cleaning module mounted to a mounting plate of the power base; and a control disposed in the power base for controlling the gutter cleaning module. In the system, the gutter cleaning module may be at least one of a gutter-cleaning device with impellers, a counter-rotating brush gutter cleaner, a downspout cleaning brush, a vibratory micro-needle for ice removal, an auger brush, an auger tool with impellers, and an auger tool with teeth.

In another aspect of the invention, a holding and fastening power tool system may comprise a power base for mounting and powering a functional module, the power base configured to mount various functional modules; a holding and fastening module mounted to a mounting plate of the power base; and a control disposed in the power base for controlling the holding and fastening module. In the system, the holding and fastening module may be at least one of a dual suction cup flat panel gripper with remote actuate and release, a light bulb changer with rotary head, a drill/driver with remote interchangeable bits, a power nailer/stapler, a wire/cord stapler, and a two-arm gripper.

In another aspect of the invention, a finishing and painting power tool system may comprise a power base for mounting and powering a functional module, the power base configured to mount various functional modules; a finishing and painting module mounted to a mounting plate of the power base; and a control disposed in the power base for controlling the finishing and painting module. In the system, the finishing and painting module may be at least one of a powered paint roller with remote paint supply, a paint sprayer with paint cup, a paint can sprayer, a two-drum wall sander, a floor sander, and an orbital ¼ sheet sander.

In another aspect of the invention, an inspection power tool system may comprise a power base for mounting and powering a functional module, the power base configured to mount various functional modules; an inspection module mounted to a mounting plate of the power base; and a control disposed in the power base for controlling the inspection module. In the system, the inspection module may be at least one of a digital wireless video/still camera with remote viewing screen, a remote viewing screen, an infrared thermal imager, a moisture detector, a mold detector, and a radon detector.

In another aspect of the invention, a landscape/garden power tool system may comprise a power base for mounting and powering a functional module, the power base configured to mount various functional modules; a landscape/garden module mounted to a mounting plate of the power base; and a control disposed in the power base for controlling the landscape/garden module. In the system, the landscape/garden module may be at least one of a pruning shear, an aerosol spray can actuator, a remote actuated hose nozzle, a remote actuated watering can, a fruit picker, a weed whacker, an edger, a broadcast spreader, a leaf blower, a snow remover, a mulcher, a composter, a trimmer, an aerator, a reel mower, a reciprocating scythe, a rake, and a rotary blade mower.

In one aspect, a light bulb changing tool that is disclosed herein includes a gripper having a gripping side and an attaching side, the gripper having a flexible shape; an attachment point disposed on the attaching side; and a polymer disposed on the gripping side. The attachment point may be adapted to attach to a gear head. The polymer may be a low viscosity viscoelastic polymer. The flexible shape may be formed by a plurality of fingers, the fingers being compliant. The attachment point may include a gear head, the gear head being adapted to receive an input torque at a first speed and to rotate the gripper with an output torque at a second speed, the first speed being greater than the second speed. The gear head may further include a torque-limiting clutch that is adapted to limit the output torque. The torque-limiting clutch may be an adjustable friction clutch. The attachment point may include an electric motor gear head adapted to rotate the gripper; a pole having a first end and a second end, the electric motor gear head being disposed on the first end, the second end being adapted to attach to a remote power base; and a wire having a first end and a second end, the first end of the wire being connected to the electric motor gear head, and the second end of the wire being adapted to connect to an electrical connector of the remote power base. The pole may be a segmented pole. The pole may be a telescoping pole. The electric motor gear head may include a torque-limiting clutch that is adapted to limit a torque of the electric motor gear head. The torque-limiting clutch may be an adjustable friction clutch.

In one aspect, a vehicle cleaning tool that is disclosed herein includes a rotational arbor; and a gear head adapted to rotate the rotational arbor, wherein the gear head is adapted to couple to a power head having a quick-release connection point. The vehicle cleaning tool may include the power head having the quick-release connection point; a pole having a first end and a second end, the power head being disposed on the first end, the second end being adapted to attach to a remote power base; and a wire having a first end and a second end, the first end of the wire being connected to the power head, and the second end of the wire being adapted to connect to an electrical connector of the remote power base. The pole may be a segmented pole. The pole may be a telescoping pole. The gear head may include a torque-limiting clutch. The torque-limiting clutch may be an adjustable friction clutch.

These and other systems, methods, objects, features, and advantages of the present invention will be apparent to those skilled in the art from the following detailed description of the preferred embodiment and the drawings. All documents mentioned herein are hereby incorporated in their entirety by reference.

BRIEF DESCRIPTION OF THE FIGURES

The invention and the following detailed description of certain embodiments thereof may be understood by reference to the following figures.

DETAILED DESCRIPTION

Figure 1:
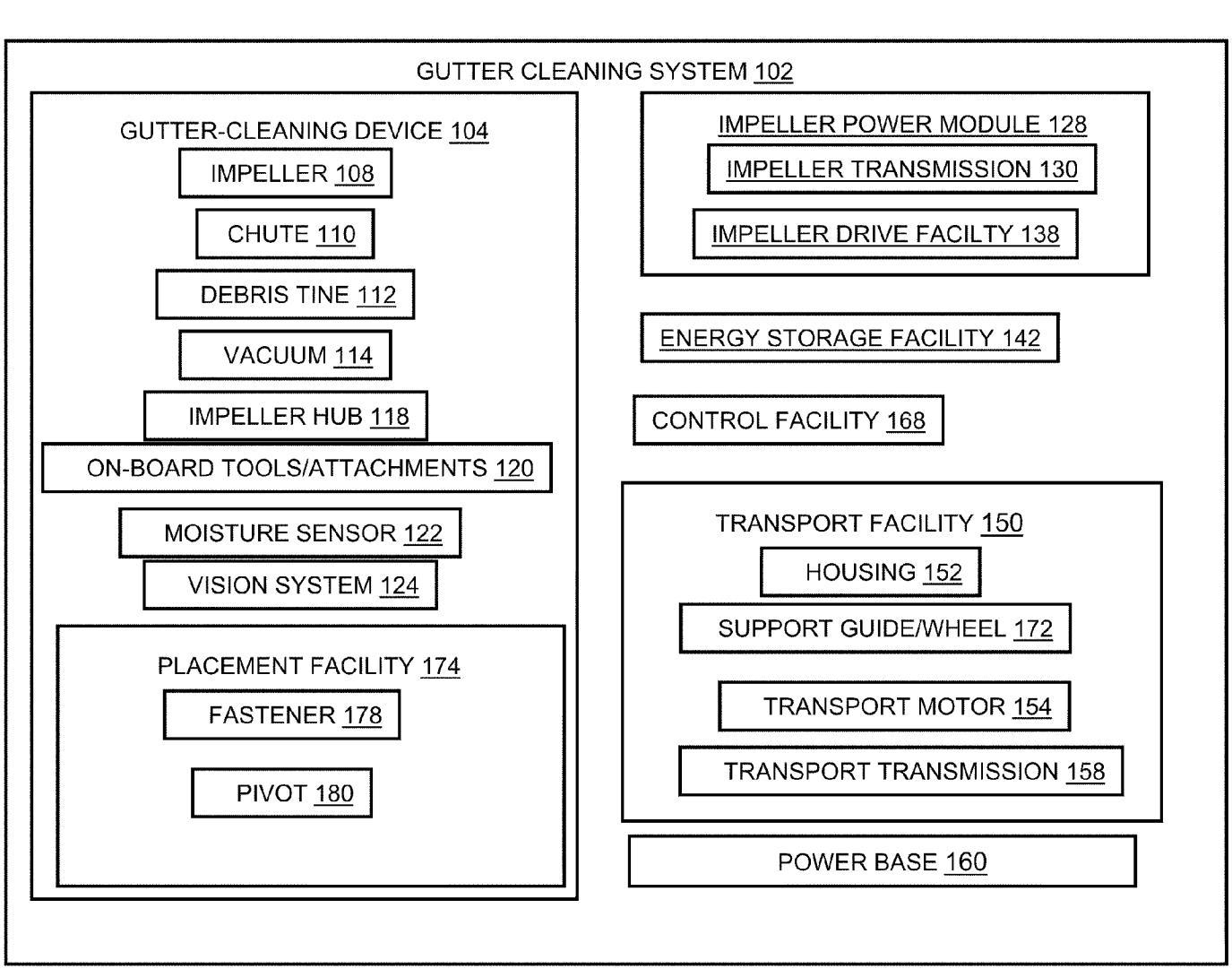
FIG. 1 depicts a gutter cleaning system.

The following description sets out a power tool system comprising a power base for mounting various functional modules, wherein the power base comprises a power head, pole, and control module or handle. Generally, the power base may provide power, handing, and user controls features to a powered tool consisting of the power base and a module that is attached to the power base. When a module is attached to the power base, the power base may provide electrical and/or mechanical power to the module. The power may move and/or light an aspect of the module in a way that is useful in applications. For example, the motion may rotate an element that clears a gutter; grip, twist, and/or release a light bulb; rotate a cleaning head that cleans all or part of a vehicle; and so on. It will be understood that the principles of the present invention have broad application, and may be applied in a wide variety of contexts where a powered tool provides a use to a user. All such variations, contexts, and applications are intended to fall within the scope of this disclosure.

The following description sets out a spray can power tool system, hedge trimmer tool system, paint roller tool system, window washing tool system, tree saw tool system, and light bulb changing tool system.

The following description also sets out a gutter cleaning system. A gutter cleaning system may comprise a gutter-cleaning device and a placement facility, wherein the functional elements of the gutter-cleaning device may be disposed within the gutter-cleaning device, or wherein at least a portion of the functional elements of the gutter-cleaning device are disposed within the power base. The power base may provide the ability to use a single base piece that provides power, handling, and the like, to which modules with different functions may be attached. Thus, the power base may eliminate the need to purchase, store, and maintain multiple power tools for each function that may be accomplished by a particular module. A user may deploy the gutter cleaning system by lifting or lowering a gutter-cleaning device attached to an end of a placement facility or power base into a gutter. A user may maneuver the gutter-cleaning device along the gutter while it disposes of gutter debris using rotating impellers on at least one end of the gutter-cleaning device.

The following description also sets out a holding and fastening system. This system may comprise a gripper suitable for grabbing a variety of household objects and a detachable power base. In embodiments, the gripper may be adapted to grasp and twist a light bulb, allowing a user to install and remove the light bulb from a socket. Such an adaptation may be applied to install and remove a light bulb that is beyond arm's reach; that requires more force to install and remove than the user can comfortably, manually provide; that is damaged in a way that would make manual installation and removal hazardous to the user; and so on. It will be understood that many adaptations of the gripper are possible, that some of these adaptations will be more or less specific to a particular type of household item, and that the principles of the holding and fastening system have broad application. Furthermore, it will be understood that a variety of modules may, from time to time, be individually attached to the power base and that the gripper may be one such module.

The following description also sets out a cleaning system. This system may comprise a module suitable for cleaning all or part of a vehicle and a detachable power base. In embodiments, the module may include a cleaning head that employs a rotary motion to clean all or part of the vehicle. In embodiments, the module may include a vacuum component that generates suction for cleaning all or part of the vehicle. It will be understood that the principles of the cleaning system have broad application, and may be employed in numerous other context where a cleaning system is useful. All such contexts and applications are intended to fall within the scope of this disclosure. Furthermore, it will be understood that a variety of modules may, from time to time, be individually attached to the power base and that the module suitable for cleaning all or part of a vehicle may be one such module.

Throughout this disclosure the phrase "such as" means "such as and without limitation." Throughout this disclosure the phrase "for example" means "for example and without limitation." Throughout this disclosure the phrase "in an example" means "in an example and without limitation." Throughout this disclosure the phrase "in another example" means "in another example and without limitation." Generally, any and all examples may be provided for the purpose of illustration and not limitation.

Referring to FIG. 1, a gutter cleaning system 102 may comprise a gutter-cleaning device 104, an impeller power module 128, an energy storage facility 142, a transport facility 150, and, optionally, a power base 160. The gutter-cleaning device 104 may comprise an impeller 108, a chute 110, a debris tine 112, a vacuum 114, an impeller hub 118, on-board tools or attachments 120, a moisture sensor 122, a vision system 124, a placement facility 174, and the like. An impeller power module 128 may comprise an impeller transmission 130, an impeller drive facility 138, and the like. A transport facility 150 may comprise a housing 152, a wheel 172, and the like. A power base 160 may comprise a control facility 168, an energy storage facility 142, and the like. The cleaning system may comprise a user operated device for cleaning drainage channels, or "gutters" and methods thereof. Gutter cleaning may involve removing debris, such as leaves, bark, twigs, nut shells, nuts, airborne matter, bird's nests, ice, water, foreign objects, and any other matter that may accumulate in a gutter. A user of the gutter cleaning system may deploy a gutter-cleaning device 104 into a gutter with the use of a placement facility 174, such as a guide pole, or a power base 160 and initiate operation of the device 104 using a control facility 168 mounted on the device 104, the placement facility 174, the power base 160, or by a remote control.

Continuing to refer to FIG. 1, the impellers 108 of the device 104 may be configured and disposed to capture debris for removal from the gutter. The impellers 108 may be connected to one or both ends of the gutter-cleaning device 104. In embodiments, the gutter-cleaning device 104 is operable with a single impeller 108 or multiple impellers 108. In some embodiments, an impeller 108 may be attached to the device 104 by an impeller hub 118. The impeller hub 118 may be connected to an impeller drive shaft. In an alternative embodiment, the impeller 108 may connect to an impeller drive shaft or impeller axle directly.

In an embodiment, an impeller chute 110 may be connected to the device 104 and may substantially surround a portion of the impeller 108 to direct debris discharged from the impeller 108 out of the gutter. A battery pack or an energy storage facility 142 may be operably connected to an impeller drive facility 138 to provide power to rotate the impeller 108, impeller hub 118, or impeller drive shaft. As the impeller 108 rotates, the impeller 108 may capture accumulated debris either between impeller vanes, fins, paddles, and the like or against an impeller chute 110 disposed around a portion of the impeller 108. The rotational torque of the impeller 108 may move the captured debris against the surface of the chute 110 or the gutter wall. At the top end of the chute 110 or the gutter, the gutter debris may be discharged at a high enough velocity such that the debris may clear the outside wall of the gutter. Once clear of the gutter, the debris may fall to the ground, may be captured in a disposal bag attached to the gutter, may be captured in a disposal bag attached to the gutter-cleaning device 104, or the like.

Figure 2:
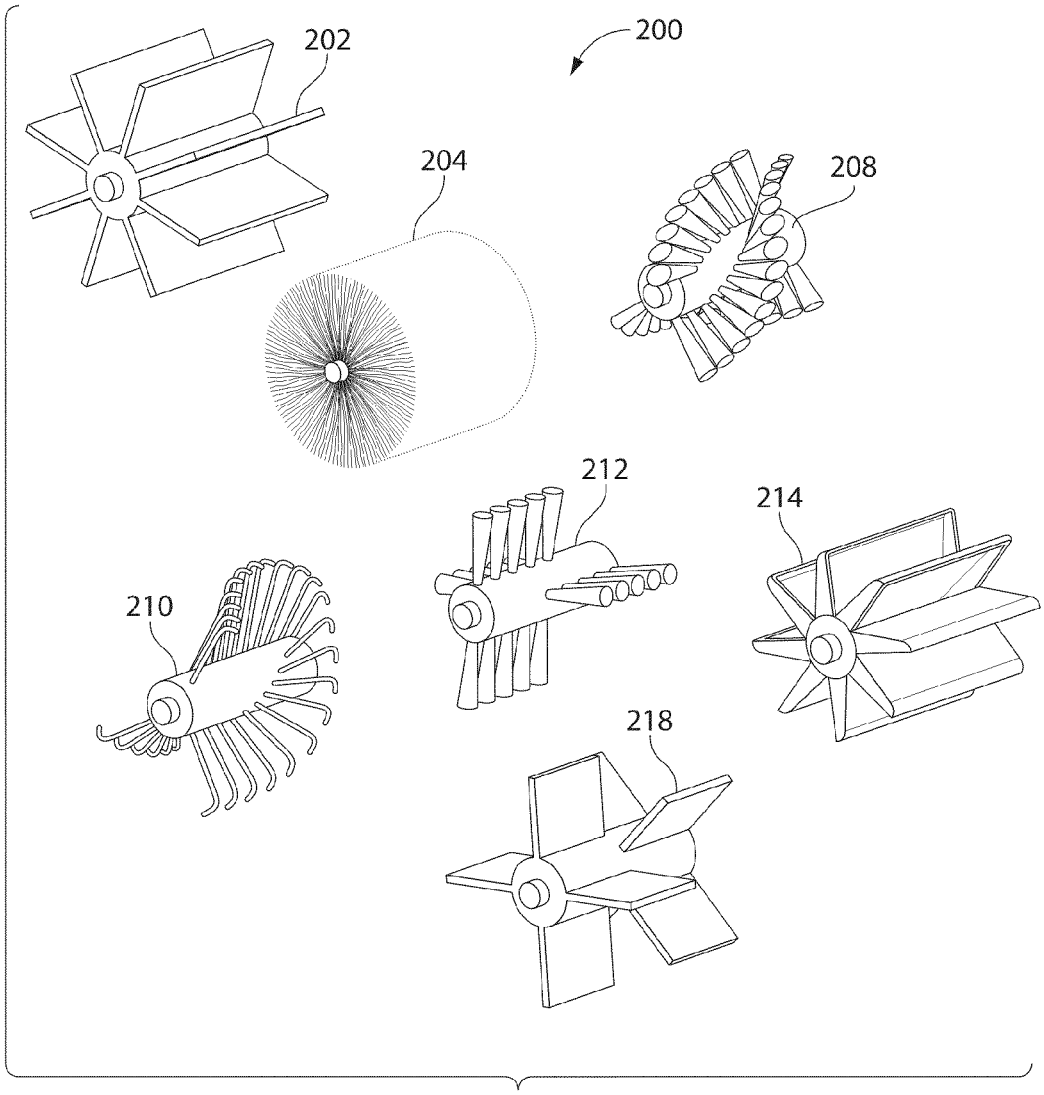
FIG. 2 depicts various impellers.

In an embodiment, the impellers 108 on one or both ends of the device 104 may be detachable and interchangeable with any impeller configuration. Detachability of the impellers 108 may facilitate cleaning, replacement, storage, shipping, disposal, various impeller functions, and the like. In an embodiment, the impellers 108 may comprise many different materials such as molded elastomer, neoprene, rubber, plastic, electrostatic cloth, and the like. Referring to FIG. 2, the impeller 108 may be at least one of a helical-bristled brush, a flexible paddle 202, a full stiff bristle brush 204, a spiral stiff bristle brush 208, a wire brush 210, a dethatching brush 210, an alternating paddle brush 212, a flexible bucket 214, a multiply-vaned impeller, an alternating flexible blade 218, counter-rotating brushes, and the like. In embodiments, a user may be able to swap any impeller 108 for another, such as for example, by disconnecting an impeller 108 from an impeller hub 118 or impeller drive shaft. In other embodiments, the impeller 108 is not removable, may be formed integrally with device 104, may be formed integrally with the impeller drive shaft, and the like.

The impeller 108 may have multiple impeller vanes disposed about a central attachment point. Each impeller vane may be flexible to facilitate deflection under gutter cross braces and movement against the chute 110, gutter walls, and gutter floor. In an embodiment, the impellers 108 may be sized to span the gutter, span portions of debris, or a combination thereof, such as four inches in diameter and three inches in length. In an embodiment, the impellers 108 may be compliant enough such that they deform under pressure, such as to 0.75" inward with one pound of force.

In an embodiment, the impeller 108 may comprise a vacuum facility 114 disposed within the gutter-cleaning device 104 or within the impeller 108, and a vacuum motor disposed within the housing 152, the power base 160, or a separate structure. The vacuum facility 114 may provide suction through the impellers 108, the impeller vane attachment point, the housing 152, and the like in order to loosen debris from the gutter. In an alternative embodiment, the impeller 108 may be replaced with a vacuum hose attachment. As the gutter-cleaning device 104 moves along the gutter, the vacuum 114 attachment may vacuum up debris and remove it from the gutter. Removal may be through a collection hose attached to a collection bag, a yard waste receptacle, a mulching or composting system, and the like.

In embodiment, the chute 110 may facilitate discharge of gutter debris. In an embodiment, the chute 110 may be a housing for at least a portion of the impeller 108. In embodiments, the chute 110 may not protrude above the top line of the gutter-cleaning device 104, may not interfere with gutter cross braces, may be deformable to permit passage under gutter cross braces, and the like. The shape and form factor of the impeller chute 110 may be one factor that may determine the average trajectory of the ejected debris. In an embodiment, as further described herein, the chute 110 may be disposed between two counter-rotating brushes such that counter rotation of the brushes draws gutter debris to the center of the device 104 at the base of a chute 110. The continued rotation of the counter-rotating brushes creates enough force to discharge the debris from the chute 110.

In an embodiment, debris tines 112 may be connected to one or both ends of the gutter-cleaning device 104. The debris tines 112 may be configured and disposed to loosen and lift matted debris from the bottom and sides of the gutter into the impeller 108. The debris tines 112 may be attached to a lower part of the housing 152 or the sides of the housing 152 at the ends of the gutter-cleaning device 104. The debris tines 112 may be formed from almost any material, including metal, wood, plastic, molded elastomer, and the like. To facilitate debris loosening, the debris tines 112 may be coated with a solid debris removal solvent. Before placement of the gutter-cleaning device 104 into the gutter, the solid debris removal solvent may be activated. Activation may be by placing water or some other activating solvent on the debris tines 112, removing a protective overlay, and the like. In an alternative embodiment, debris removal solvent may be disposed within the housing 152. When the impellers 108 may be activated, some solvent may be applied to the gutter surface using a spray, a simple gravity fed system, and the like.

In an embodiment, the impeller drive facility 138 may be configured and disposed to drive the impeller 108 with any necessary rotational speed and torque. The impeller drive facility 138 may be coupled to the impeller 108, impeller hub 118, or impeller drive shaft, and housed within the housing 152, within the impeller hub 118, within the impeller 108, within the power base 160, within the impeller drive shaft, and the like. In some embodiments, the impeller drive facility 138 may comprise a motor or engine and a speed/torque modifying transmission 130. The motor may be any one of a reversing gear motor, an electric motor, a gasoline- or biofuel-powered internal combustion engine, a solar-powered motor, and the like. In an embodiment, the motor may be a 12 Volt DC single speed motor with transfer gearing to an impeller drive shaft. In some embodiments, each impeller 108 may be driven by its own impeller drive facility 138. In any event, each impeller 108 may be independently controlled by a control facility 168, or more than one impeller 108 may be controlled simultaneously. Motor cooling may be on a top surface of the gutter-cleaning device 104 and may minimize fluid entry to the device. In some embodiments, the motor may be mechanically coupled to the impeller transmission 130 such that the rotational output of the drive facility 138 is a rotational input to the impeller transmission 130. The rotational output of the impeller transmission 130 may rotate the impeller 108 about its central axis. In an embodiment, the impeller drive facility 138 may comprise a motor or engine connected directly to an output without any intervening speed/torque modifying transmission 130. In an embodiment, the impeller drive facility 138 may operate at 400 rpm @ 300 in.lbs. of torque. In an embodiment, the impeller drive facility 138 may couple to and drive the support guide/wheel 172.

In an embodiment, the gutter-cleaning device 104 may have a perimeter internal gear disposed in the impeller 108, and a corresponding spur gear attached to a transfer/drive shaft and impeller gear box which may rotate one or more impellers 108. The impeller 108 may have a bearing which attaches to a stationary impeller axle, allowing the impeller 108 to freely rotate about a central axis. As the impeller 108 rotates, a vane on the impeller may enable the removal of debris from a gutter. An impeller drive facility 138 may drive the spur gear and may be powered by an energy storage facility 142.

In an embodiment, the impellers 108 may have a nosecap held on by a clip. The nosecap may be a transparent lens for a vision system 124, as further described herein. Wiring for the vision system 124 may be from the nosecap, through an impeller axle or impeller drive shaft, and to a motor control and communication circuit board.

In an embodiment, the impeller transmission 130 may comprise transfer gear driving. A gear may be coupled to a selector fork with a transfer shaft delivering power to the impeller 108 from the power base 160 with a power take-off coupling.

In an embodiment, a support/guide wheel 172 may be connected to the body of the device 104. In embodiments, the support/guide wheel 172 may be rotatably connected to the body of the device 104. The support/guide wheel 172 may be configured and disposed to ride on the gutter edge while the gutter-cleaning device 104 is inside a gutter, to provide support beneath the gutter-cleaning device 104, and the like. The support/guide wheel 172 may support a portion of the system weight such that the movement of the device 104 is eased along the gutter trough. In embodiments, the support/guide wheel 172 may be a wheel, a hook, a bracket, a track optionally sized to fit over a lip of a gutter, tractor/tread wheels and tracks, finned hemispherical wheels, rubber wheels, vulcanized wheels, and the like. In an embodiment, the support guide/wheel 172 facilitates moving the gutter-cleaning device 104 within the gutter in either direction, such as forwards and backwards. In an embodiment, the support guide/wheel 172 may be attached to an axle. The axles may be located fore and aft and may be transversely connected to one another. The axles may be connected through an impeller drive shaft. The axles may be connected to the device housing 152 and may allow the support guide/wheel 172 to free-wheel. In some embodiments, the support guide/wheel 172 may be connected to a driven axle and may be driven by a transport motor 154 or an impeller drive facility 138.

In an embodiment, the transport drive 154 may be connected to at least one support guide/wheel 172, a snake drive, a worm drive, a crab or walking drive, a scoot-and-compress or accordion drive, a string of beads drive, some other translation mechanism, and the like. The transport drive 154 may be housed within the housing 152 of the gutter-cleaning device 104 or the power base 160. The transport motor 154 may be configured and disposed to provide rotational speed and torque to the support guide/wheel 172 or other translation mechanism in a sufficient amount to drive the gutter-cleaning device 104. The transport motor 154 may comprise a motor or engine and a transmission 158. The motor 154 may be any one of a reversing gear motor, an electric motor, a gasoline- or biofuel-powered internal combustion engine, a solar-powered motor, and the like. In an embodiment, the motor 154 may be a 12 Volt DC single speed motor with transfer gearing to an impeller drive shaft. Motor cooling may be on a top surface of the gutter-cleaning device 104 and may minimize fluid entry to the device. The transmission 174 may be a speed/torque modifying transmission. The transport motor 154 may have a static or variable speed setting. The speed setting may be set in the factory or by a user. For example, the speed may be set to 4 inches per second. In another example, a user may use a control facility 168, as further described herein, to modify the speed from a fast speed to a slow speed. The transport motor 154 may work with the support guide/wheel 172 or alternate translation mechanisms to move the gutter-cleaning device 104 within the gutter in either direction, such as forwards and backwards. In embodiments, the transport motor 154 may also operably connect to the impeller drive shaft to drive the impellers 108. In operation, a user may use the power base 160 or placement facility 174 to place the device 104 in a gutter and allow the transport motor 154 to facilitate movement of the device 104 along the gutter while the user guides the device 104 with the power base 160 or placement facility 174, such as for example, when a gutter cross brace is reached and the device may need to be repositioned on the other side of the cross brace.

In an embodiment, the housing 152 may be formed from any suitable material, such as metal, plastic, molded elastomer, and the like. In an embodiment, the housing 152 materials may be weather-resistant, water-resistant, solvent-resistant, temperature-resistant, shock-resistant, breakage-resistant, and the like. All of the components of the gutter-cleaning device 104, including at least the housing 152, impellers 108, debris tines 112, on-board tools/attachments 120, transport facility 150, placement facility 174, energy storage facility 142, control facility 168, power base 160, and the like may be easy to clean, may withstand all manners of environmental phenomena and exposure, may withstand falls from the gutter onto a surface, such as concrete, asphalt, stone, grass, roofing, and the like. The housing 152 may provide weight to the gutter-cleaning device 104 such that the device may exert any necessary force or torque on the impeller 108 to detach debris. In some embodiments, the gutter-cleaning device 104 may be light enough to be lifted the height of the gutter for placement within the gutter. The housing 152 may be sized to house the internal components of the gutter-cleaning device 104. The cross sectional dimensions of the housing 152 and gutter-cleaning device 104 may be limited by the size of a gutter, such as no more than 2.75" high and 3.0" wide.

In an embodiment, a moisture sensor 122 disposed on the housing 152 of the device 104 may sense when water levels may be prohibitive to operation of the gutter-cleaning device 104. The moisture sensor 122 may generate an audible alert, a visual alert, a vibratory alert, a power shut-down mode, or any combination thereof if the detected moisture levels are prohibitive to operation of the device 104.

In an embodiment, the housing 152, placement facility 174, or power base 160 may comprise additional functionality, such as any one of a timer, a digital clock, a thermometer, a radio, an MP3 player, a weather station, a light, a fan, a storage area, and the like. The additional functionality may be powered by an energy storage facility 142.

Continuing to refer to FIG. 1, an energy storage facility 142 may be disposed within the housing 152 or the power base 160 of the gutter-cleaning device 104 and electrically connected to the impeller drive facility 138 and/or transport facility 150. The energy storage facility 142 may be a battery. The battery may be rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, nickel oxyhydroxide, and the like. For example, a battery pack may supply 12 Volts DC at 2.2 Amp Hr. The rechargeable battery may comprise a recharging or docking station. The battery may be removable for docking or the entire device 104 may be docked. In an embodiment, the docking station may be disposed at the end of a gutter. In this example, the gutter-cleaning device 104 may dock once a cleaning cycle is complete, if the battery is low, if directed to dock by a user, and the like. In an embodiment, at least one of an audible, visual, or vibratory alert may indicate that the battery power or energy storage facility level is low. In an embodiment, the energy storage facility 142 may be a gasoline fuel or biofuel tank. The energy storage facility 142 may be a solar panel. In embodiments, the energy storage facility 142 may be a power cord to enable drawing power directly from a power outlet through a power cord. In any event, the energy storage facility 142 may be configured to be easily and quickly interchangeable for recharging, refilling, re-energizing and the like outside of the gutter cleaning system 100.

In an embodiment, the gutter-cleaning device 104 may comprise a control facility 168. In an embodiment, the control facility 168 may be disposed on the gutter-cleaning device 104, a power base 160, a placement facility 174, and the like. The control facility 168 may be a button, a lever, a switch, a dipswitch, a keypad switch, a rotary switch, a slide switch, a toggle, a rocker switch, a knife switch, a knob, a pull cord, a touch sensitive input, a remote control and remote control input, a key, a magnetic switch, a proximity sensor, a mercury tilt switch, and the like. The control facility 168 may be a device power switch, an additional functionality power or control switch, a speed control, a direction of travel control, a direction of rotation control, a module trigger, a module modulation switch, a module speed control, a telescoping control, a head pivot control, and the like. The control facility 168 may comprise a data input for device programming. The control facility 168 may be configured and disposed to control the impeller 108 actuation, wheel 172 actuation, and the like. The wireless control facility 168 may control power delivery from the energy storage facility 142 to the impeller drive facility 138 and transport motor 154. The control facility 168 may allow a user to change the direction of the device 104 in a gutter, change the speed of movement of the device 104, change the speed of the impellers 108, change the direction of rotation of the impellers 108, operate an on board tool/attachment 120, a vacuum 114, a moisture sensor 122, a vision system 124, and the like. The control facility 168 may have a low battery alert, such as an audible alert, a visible alert, a vibration alert, and the like.

In an embodiment, a gutter-cleaning device 104 may comprise a vision system 124. The vision system 124 may comprise a solid state camera, a camera lens, a video signal electronics module, and the like. The solid state camera may be mounted in the front of an impeller 108 or impeller hub 118, optionally on a center axis. A camera lens may be mounted directly in front of the solid state camera and may be configured and disposed to focus an image for the solid state camera. The camera lens may also protect the solid state camera from being damaged by debris. The solid state camera and the video signal electronics module may interact to enable wireless transmission of a video signal. Images may be transmitted to a signal reception device. Having seen the images, a user may modify, continue, or cease the operation of the device 104. For example, if the images indicate that the gutter still has debris to clear, the user may continue to operate the gutter-cleaning device 104 in at least those portions of the gutter that still retain debris. In an embodiment, the vision system 124 may comprise a mirror disposed on the device 104 or on the placement facility 174 or power base 160 and oriented in such a way as to provide a user of the system 102 an indication of the contents of the gutter on either side of the device 104.

In an embodiment, the gutter-cleaning device 104 may comprise on-board tools or attachments 120. The on-board tool 120 may be a downspout cleaning tool. When the device 104 reaches a downspout, it may deploy a cleaning tool, such as a weighted brush, into the downspout to clear it of debris. The cleaning tool 102 may run the length of the downspout and may be collected at the base of the downspout. In an embodiment, the tool 120 may be magnetic such that should the tool 120 get stuck in the downspout, it may be removed by dragging it down the spout using a magnetic force from the outside of the downspout. The device 104 may be directed to deploy the tool 120 by a control facility 168, through programming, through detection of the downspout using a vision system 142 or some other detection mechanism, and the like. In embodiments, the downspout cleaning tool may be an impeller 108 that may be oriented vertically to clean at least a top portion of the downspout. The impeller 108 may be present within the housing 152 and may emerge when directed to do so by a control facility 168, through programming, through detection of the downspout using a vision system 142 or some other detection mechanism, and the like. In an alternative embodiment, the impeller may re-orient itself from the usual horizontal position at the end of the device 104 to a vertical position in order to clean the top portion of the downspout.

In an embodiment, the on-board tool 120 may be an air hose attachment. The air hose attachment may attach on one end to an air compressor and on the other end to an impeller 108, an impeller hub 118, the housing 152, the debris tines 112, and the like. Air discharged through the air hose attachment may facilitate loosening and removal of debris.

In an embodiment, the on-board tool 120 may be a water hose attachment. The air hose attachment may attach on one end to a pressurized water supply and on the other end to an impeller 108, an impeller hub 118, the housing 152, the debris tines 112, and the like. Water discharged through the water hose attachment may facilitate loosening and removal of debris.

In an embodiment, the placement facility 174 may be a handle, a grip, a pole, a telescoping pole, a segmented pole, a collapsible pole, and the like. The device 104 may have a point of attachment that may be compatible with a placement facility 174. For example, the device may have a threaded connection and the placement facility 174 may have a threaded end. The point of attachment may include a fastener 178, which may permit the removable or permanent attachment of the placement facility 174 or power base 160 to the device 104 in multiple orientations. For example, the fastener 178 may attach the device 104 to the placement facility 174 or power base 160 in an orientation permitting downward operation, upward operation, horizontal operation, and the like. The fasteners 178 may be disposed on a top, bottom, or side surface of the device 104. In embodiments, the fastener 178 may be a nut and bolt, a screw, a nail, a rivet, a magnet, an adhesive, a hook-and-loop, an interference locking system, a threaded connection, a sliding attachment, a hinge, a clamp, a tab, a spring-loaded attachment, a sleeve attachment, a snap-fit connection, a ball closure, discrete interlocks, a clasp, a clip, a zipper, a snap, a gasket, an O-ring type closure, a hook-and-eye, a spring-locking hinge, and the like. A locking pivot 180 may be connected to the body of the device 104 and to the upper end of the placement facility 174 or power base 160. The pivot 180 may be configured and disposed to permit a varying angle of the device 104 with respect to the placement facility 174, power base 160, gutter, user, and the like. The upper end of the placement facility 174 or power base 160 may be connected to the pivot 180. The placement facility 174 may be configured to allow the user to adapt its length to a wide range of roof/gutter heights, such as by telescoping, adding additional segments, allowing greater reach, and the like.

In some embodiments, the placement facility 174 or power base 160 and the device 104 may be formed as a single unit. For example, the device 104 may be integral with the placement facility 174 or power base 160.

In an embodiment, the gutter-cleaning device 104 may be connected to a power base 160. The power base 160 may allow for at least one element of the gutter cleaning device 104, such as an impeller transmission 130, an impeller drive facility 138, an energy storage facility 142, a transport motor 154, a transport transmission 158, transfer gears, power take-off couplings, control facility 168, and the like to be disposed within the power base 160, as further described herein. In embodiments, a fastener 178 may permit the permanent or removable attachment of the device 104 to the power base 160, as previously described herein. For example, the power base 160 may include a control facility 168, an ergonomic grip area, and an energy storage facility 142. In embodiments, the control facility 168 may be the only element not disposed within a gutter-cleaning device 104.

In operation, a process for using the system 102 may comprise the stages described below. The process, however, is exemplary only and not limiting. The process may be altered, such as by having stages added, removed, rearranged, and the like. A user may deploy the gutter-cleaning system 102 by lifting the device 104 attached to one end of a placement facility or power base 160 to rest in a gutter with a support guide/wheel 172 resting on an outer edge, a floor, or a wall of a gutter. The user may turn the system 102 on with the control facility 168. The user may maneuver the device 104 up and down the length of the gutter while it disposes of accumulated gutter debris. When cross braces may be encountered in the gutter, the forward and aft protruding impellers may clean under the brace but the user may have to lift the device 104 to the other side of the brace to continue cleaning. The connection point of the placement facility 174 or power base 160 may comprise a mirror to provide the user with an indication of the contents of the gutter on either side of the device 104. Once the gutter cleaning is completed, the user may turn off the system 102 with the control facility 168 or the system 102 may power down automatically after a pre-determined length of time, if a prohibitive level of moisture is detected, if the impellers become disengaged or stuck, and the like. The user may then lift or lower the system 102 of the gutter.

Figure 3:
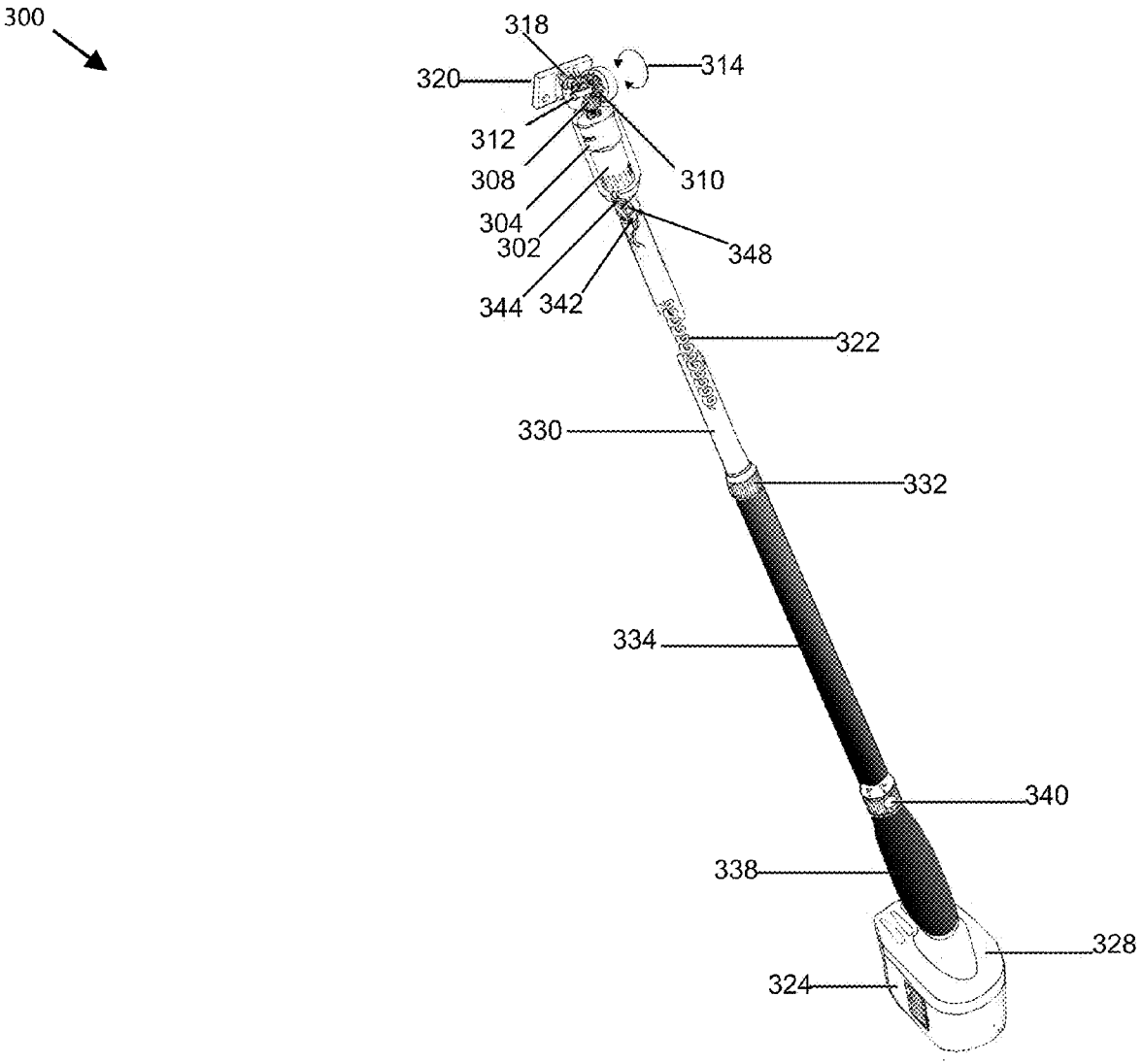
FIG. 3 depicts a power base with a telescoping pole.

Referring to FIG. 3, by positioning certain functional elements within the power base 300, the power base 300 may be operable with a wide range of functional modules, including a gutter cleaning device as described above. For example, the power base 300 may provide power to a module while the module retains all of the powertrain elements necessary for function. In another example, the power base 300 may comprise a motor that receives power through the power base 300. A power take-off coupling may then facilitate driving functional elements within a module using the motor disposed in the power base 300. For example, the power base 300 may have an integrated telescoping pole to facilitate handling, placing, operating, storing and the like of a functional module. In other embodiments, the pole may be static, non-telescoping, collapsible, segmented and the like. The power base 300 may comprise a head, containing a motor 302, gearbox 304, gearset 308, ring bevel gear 310, pivot axis 314, power take-off coupling 318, mounting plate 320, and the like, connected to a pole 330 of the power base 300.

Continuing to refer to FIG. 3, the power base 300 may comprise a motor 302 for powering an attached functional module, such as a gutter-cleaning device. For example, the motor 302 may be a high torque DC motor, a reversing gear motor, an electric motor, a gasoline- or biofuel-powered internal combustion engine, a solar-powered motor, and the like. The motor 302 may be operably connected to a gearbox 304. The gearbox 304 may be a speed reduction gearbox with speed selection. The gearbox 304 may be operably connected to a bevel gearset 308 with a head pivot at a rotational axis of the ring bevel gear 310. The pivot axis of the head 312 may rotate 314, permitting use of various modules at various shaft angles. The pivot 312 may be locked at any particular orientation. The gearset 308 may be operably connected to a power take-off coupling 318 for providing power from the power base 300 to the functional modules. A functional module may be mounted to the power base 300 through a mounting plate 320. The mounting plate 320 may have a quick release connection for various modules, thus facilitating interchangeability of the functional modules. Alternatively, the mounting plate 320 may allow a module to be affixed in a more permanent fashion, such as by screws. The functional module may be attached to the mounting plate 320 by any attachment means, such as by a screw, a nut and bolt, a nail, a rivet, an interference locking system, a threaded connection, a sliding attachment, a hinge, a clamp, a tab, a spring-loaded attachment, a sleeve attachment, and the like. The mounting plate 320 may be configured to provide support for the attached module while allowing the module to be electrically connected to the power base 300. Power for the power base 300 may be provided by an energy storage facility, such as a battery 324, a solar panel, a gasoline or biofuel tank, an electrical cord, and the like. For example, a battery 324 may be removably connected to the power base 300 through a battery connection base 328. The battery 324 may be rechargeable. The battery 324 is shown in FIG. 3 at an end of the power base 300 opposite from the head, however, the battery may be disposed anywhere along the pole 330. An electrical conductor 322 may connect the battery 324 to the motor 302 through, around, or alongside the pole 330. An electrical connector 342 of the power base 300 may be adapted to provide suitable electrical power and, optionally, control signals for driving the motor 302. The motor 302 may include a wire 344 with a first end and a second end, the first end being attached to the motor 302 and the second end 348 being adapted to connect to the electrical connector 342. The pole 330 may be a rigid telescoping pole with one or multiple segments. The pole 330 may include a quick release coupling 332 to adjust the telescoping pole segments. The pole 330 orientation may be modified to facilitate placement of the functional module at a desired location. The pole 330 may be housed within a lower pole segment 334 from which it may telescope outwards. The lower pole segment 334 may have a high friction hand grip surface. The lower pole segment 334 may comprise a handle 338. The handle 338 may be a separate component of the lower pole segment 334 or may be integral to it. The handle 338 may have a high friction hand grip surface, similar to or distinct from that of the lower pole segment 334. The handle 338 may be ergonomically shaped. A control switch 340 may be disposed on the lower pole segment 334. The control switch 340 may turn power on or off to the motor 302. The control switch 340 may be a power switch, a module trigger, a module modulation switch, a module speed control, a telescoping control, a head pivot control, and the like.

Figure 4:
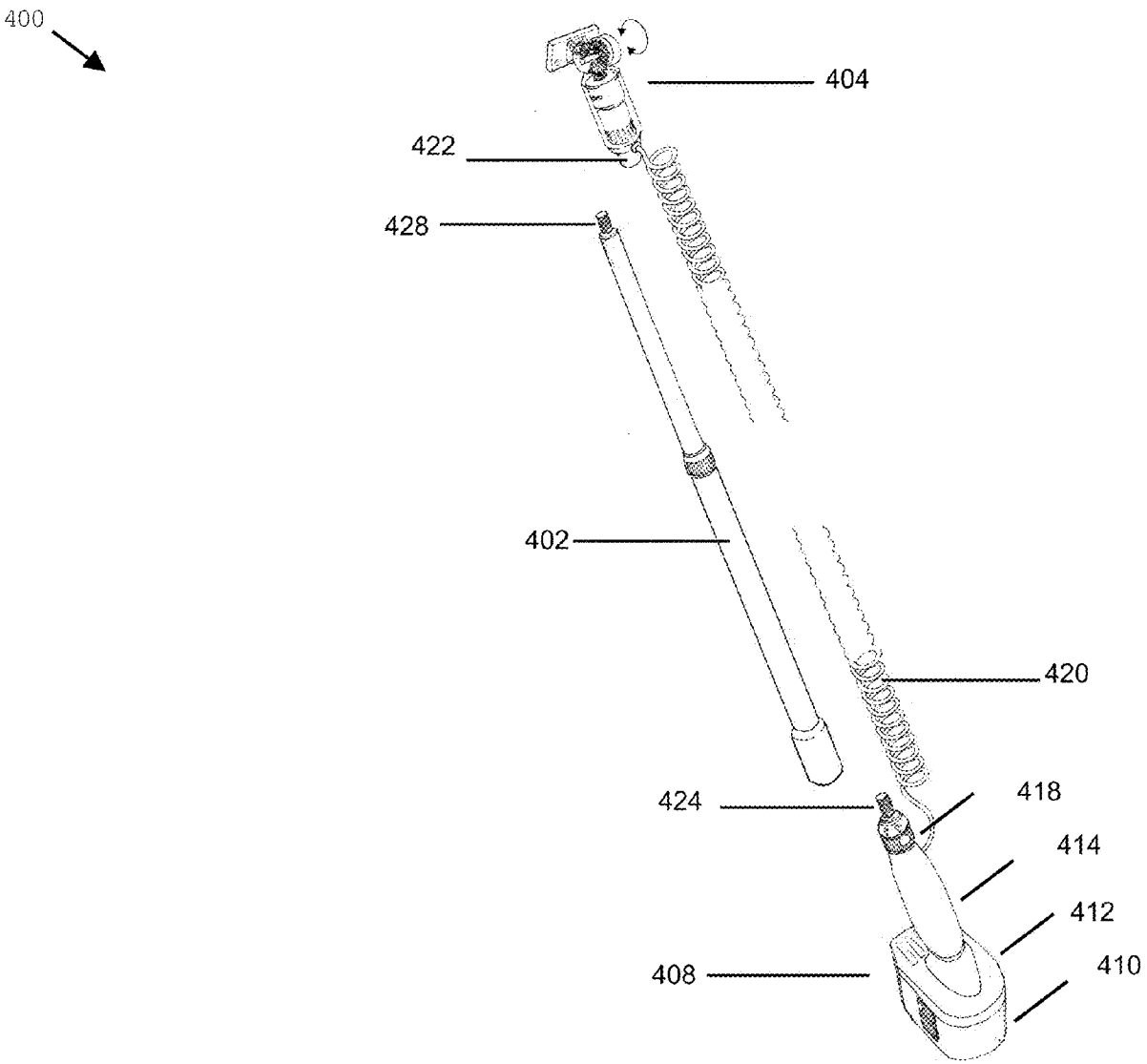
FIG. 4 depicts a power base with an off-the-shelf pole.

Referring to FIG. 4, a power base 400 for attachment of various functional modules, such as a gutter cleaning module, may be a power head 404 assembled with a separately purchased pole 402. The power head 404 may comprise a motor, gearbox, gearset, ring bevel gear, pivot axis, power take-off coupling, mounting plate, and the like. The power head 404 may be operably connected to a control module 408 by a wire 420 or some other electrical connection. The control module 408 may comprise a battery 410 which may provide power to the power base 400. Alternatively, the control module 408 may comprise other power means, such as a solar panel, an internal combustion engine, an electrical cord, and the like. The battery 410 may be removably connected to the power base 400 through a battery connection base 412. The control module 408 may comprise a handle 414. The handle 414 may have a high friction hand grip surface. A control switch 418 may be disposed on the control module 408. The control switch 418 may turn power on or off to the power head 404. The control switch 418 may be a power switch, module trigger, module modulation switch, speed control, a head pivot control, and the like. The power head may have a thread connection 422 for connecting to a complementary thread connection 424 on the control module 408. The thread connections 422, 424 may be either male or female. The thread connections 422, 424 may be industry standard connections, such as those used on a painting pole. Alternatively, the power head 404 may be attached to the control module 408 through any attachment means, such as a nut and bolt, a screw, a nail, a rivet, a magnet, an adhesive, a hook-and-loop, an interference locking system, a threaded connection, a sliding attachment, a hinge, a clamp, a tab, a spring-loaded attachment, a sleeve attachment, a snap-fit connection, a ball closure, discrete interlocks, a clasp, a clip, a zipper, a snap, a gasket, an O-ring type closure, a hook-and-eye, a spring-locking hinge, and the like. In an alternative to a direct attachment of the power head 404 to the control module 408, both the power head 404 and control module 408 may be attached to opposite ends of a pole 402, such as a painting pole, broom stick, some other off-the-shelf pole, and the like. For example, the power head 402 may have a female thread connection 422 to receive a male thread connection 428 from a pole 402. In the example, a control module 408 male thread connection 424 may connect with a female thread connection of the pole 402. The wire 420 connecting the power head 402 to the control module 408 may be disposed along the side of the pole, may coil around the pole, may thread through the center of the pole, and the like.

Figure 5:
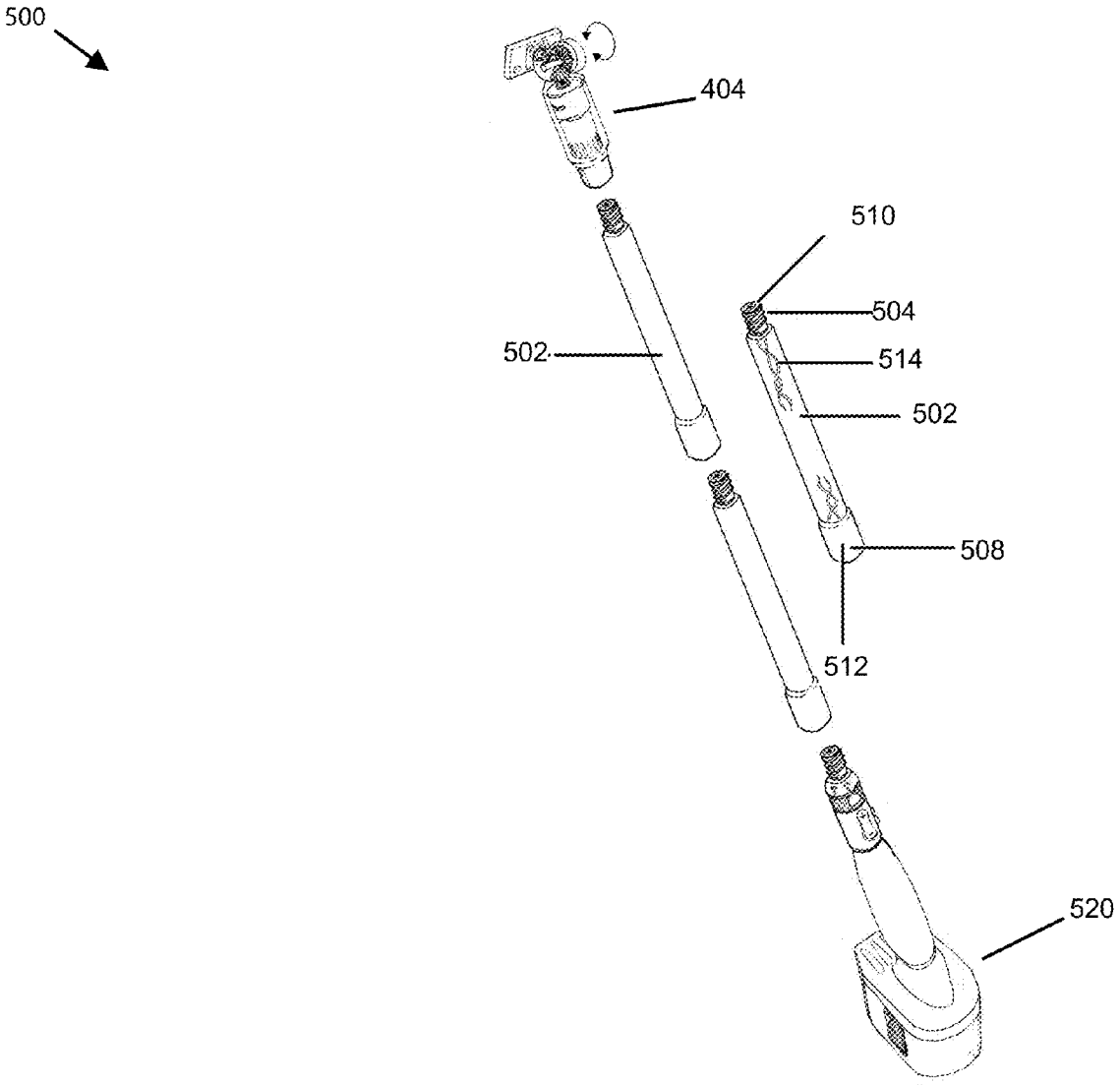
FIG. 5 depicts a power base composed of pole segments

Referring to FIG. 5, a power base 500 for attachment of various functional modules, such as a gutter cleaning module, may comprise a segmented pole 502 with integrated electrical conductors and end electrical connections. The pole segments 502 may facilitate packaging and storage of the power base 500. The pole segments 502 may have connections on either end such that one end of the pole segment may have a connection complementary to an end of another pole segment 502. For example, the pole segments 502 may have a male thread connection 504 and a female thread connection 508 on either end of the pole segment 502. The thread connections 504, 508 may have coaxial connectors 510, 512 disposed within the connections 504, 508 to provide a continuous electrical connection between pole segments 502. An electrical conductor 514 internal to the pole segment may provide an electrical connection between the coaxial connectors 510, 512. When a pole segment 502 is connected to another pole segment 502, they may form a continuous electrical connection through the coaxial connectors 510, 512. In an embodiment, the power head 404 may be connected directly to the control module 520 through the threaded connections 504, 508. Alternatively, one or more pole segments 502 may be connected in between the power head 404 and control module 520.

Figure 6A:
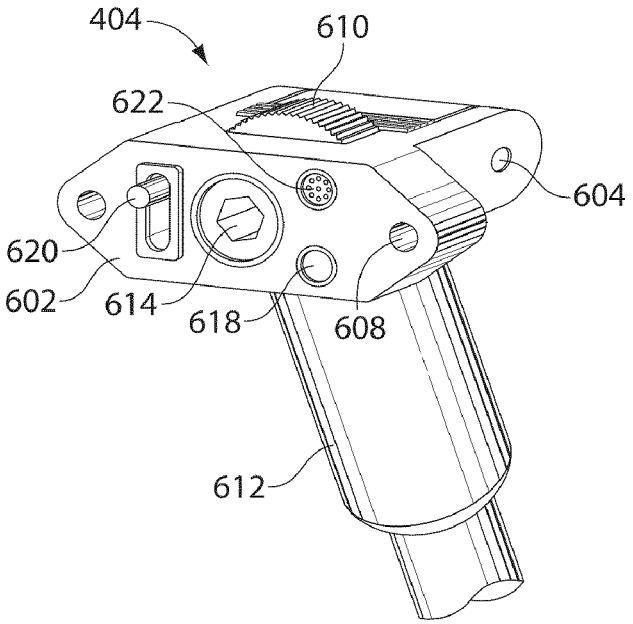
FIGS. 6A and B depict front and back views of the power head.

Referring to FIG. 6, two views of the power head 404 are depicted. Referring first to FIG. 6A, a view of the mounting side of the power head is depicted. A functional module, such as a gutter cleaning device, may attach to the power head 404 at a power head mounting plate 602 and the entire power head 404 may be repositioned through pivoting at a power head pivot axis 604. In an embodiment, pivoting may be controlled by a control facility. In an embodiment, the mount may be a pin mount. The functional module pin mount may attach to a connection point 608 for the pin mount. The connection point 608 may be detent released by a spring latch actuated by a quick release button 610. The power head may comprise a motor/gearbox pod 612 for operating a functional module. The motor/gearbox pod 612 may be operably connected to a power take-off coupling 614 to provide a power input from the motor 612 to a functional module. In this way, any functional module may be attached to the power head 404 as the motor 612 may not be specifically paired with a functional module, but rather, may be operable with many different functional modules. In an embodiment, the power head 404 may comprise an articulated extensible pin actuator 618 driven by an electrical solenoid to effect on/off selection of module functions. In an embodiment, the power head 404 may comprise an articulated sliding pin actuator 620 driven by an electrical slide solenoid to effect analog mechanical input for module functions. In an embodiment, the power head 404 may comprise an electrical connector for data inputs to module functions.

Figure 6B:
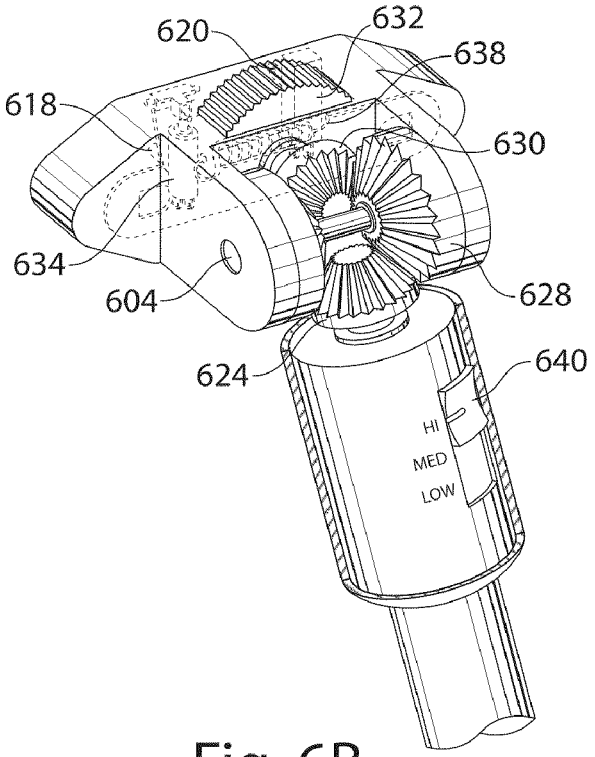

Referring now to FIG. 6B, the side of the power head 404 opposite from the mounting plate 602 is depicted. In an embodiment, the power head 404 may comprise a bevel gearset with head pivot functionality at a rotational axis of the ring bevel gear 628. A power take-off coupling 630 may allow for power input to modules. A slide solenoid body 632 may be electrically connected to and drive the articulated sliding pin actuator 620. An axial push/pull solenoid body 634 may be electrically connected to and drive the articulated extensible pin actuator 618. In an embodiment, a pin lock mechanism 638 may be disposed on the power head for engagement of the module connection. A manual speed change switch 640 on the gearbox 612 may be adaptable to different functional requirements of the various modules. For example, the switch 640 may control speed, direction, intensity, duration, timing, and the like.

Figure 7:
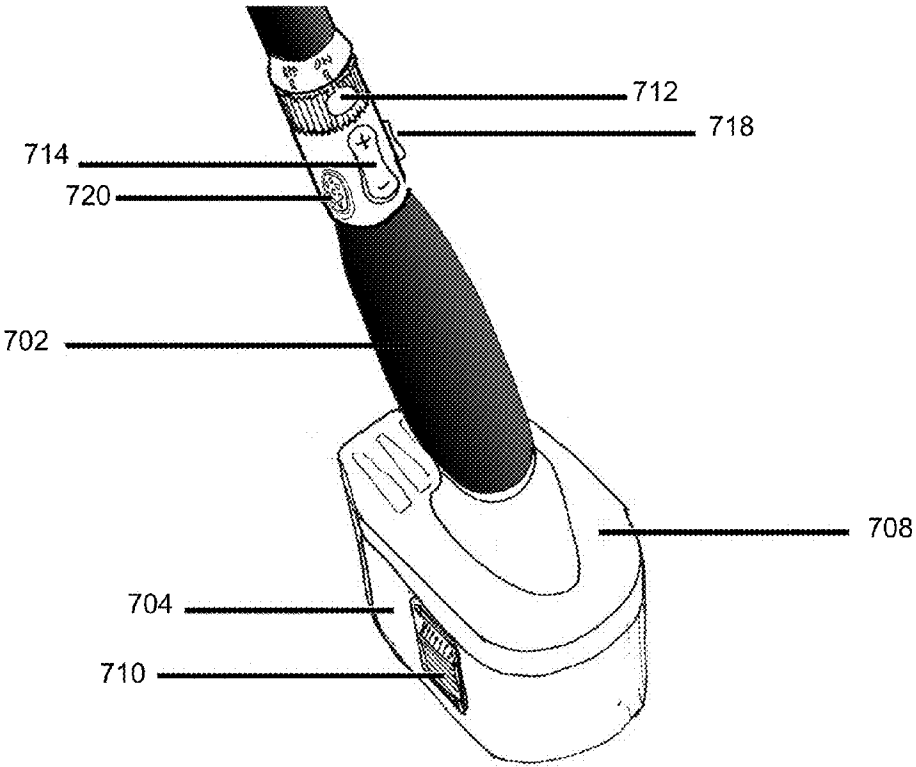
FIG. 7 depicts the control module.

Referring to FIG. 7, an enlarged view of the control module 700 is depicted. The control module 700 may have a handle 702. The handle 702 may have a high friction hand grip surface. The control module 700 may house a removable rechargeable battery 704 attachable to the control module 700 through a battery connection base 708. The battery 704 may be removable with a latch 710 for recharging. In other embodiments, the control module 700 may comprise any energy storage facility, such as a gasoline or biofuel tank, a solar panel, a power cord, and the like. In an embodiment, the control module 700 may comprise control switches 712 for Power ON/OFF of the power head motor. In an embodiment, the control module 700 may comprise a toggle switch 714 to control analog modulation of the link to the module. In an embodiment, the control module 700 may comprise an on/off actuation switch 718 to control digital functions in a module. In an embodiment, the control module 700 may comprise an I/O connector 720 to facilitate computer programming of onboard power base or module functions. In an embodiment, the control module 700 may comprise a timer, a digital clock, a thermometer, a radio, an MP3 player, a weather station, a light, a fan, a storage area, and the like. In an embodiment, the control module 700 may comprise a power meter. The power meter may indicate a level of power remaining in the energy storage facility. The power meter may indicate a low power alert. The alert may be an audible alert, a visual alert, a vibration, or any combination thereof.

Figure 31:
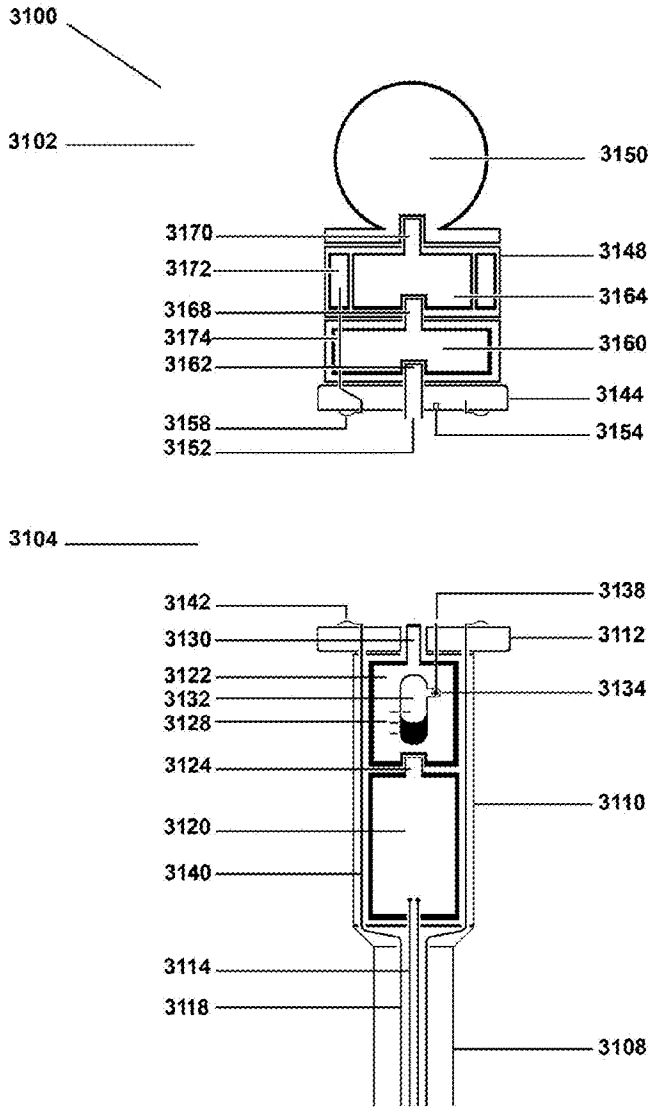
FIG. 31 depicts the internal components of a power head and tool attachment.

Referring now to FIG. 31, the power tool system 3100 may be a tool system comprising a power base module 3104 of handle or control module, pole, and power head 3110 facilitating attachment of a wide range of tool attachments 3102. The base component comprises a pole 3108 and a detachable power head 3110 comprising a connection plate 3112 facilitating the attachment of a wide range of tools 3102. In an embodiment, the power head 3110 may be configured to provide primary mechanical power to the tool attachment 3102. The power head 3110 may be attached to the pole 3108 which may convey electrical power from an energy storage facility, such as a battery compartment, in the handle via conductors 3114, 3118 that may be routed inside or outside the pole. These electrical conductors 3114, 3118 may be controlled by switches in the handle or control module and may carry either power 3114 to the motor that may be of relatively high voltage and current, or electrical signals 3118 that provide informational content to electronics mechanisms that control the tool attachments 3102. The power head 3110 may comprise a high torque motor 3120 connected 3124 to a gearbox 3122 that may provide power to the tool attachments 3102 via a power take off shaft 3130. The gearbox may have multiple speeds 3128 with a selector mechanism 3132 that may be attached to a mechanical linkage 3134 that may have a connection at the tool attachment connection plate 3138. The electrical signals 3114, 3118 may be passed through wires 3140 that bypass the gear motor to contacts 3142 on the mating connection plate 3112 that may engage mating contacts 3158 on the connection plate 3144 of the tool attachment 3102.

The tool attachment 3102 may comprise three parts: the connection plate 3144, the tool body 3148 and the end effecter 3150 that accomplishes the work. The tool connection plate 3144 may engage mating features of the power head connection plate 3112 to provide positive mechanical and electrical locking of the opposing features. The connection plate 3144 may have a mating torque coupling 3152 to engage a power take off shaft 3130 of the power head. The coupling 3152 may also have an automatic speed selection feature 3154 that engages the speed selector mechanism 3138 to automatically match the output speed of the power head to the ideal input speed of the tool attachment. This selector mechanism 3134, 3138 is shown as a mechanical activated pushrod that may move the speed select lever 3132 of the power head to the chosen speed automatically, such as by a feature 3154 in the connection plate that positions the selector rod 3134 to the right length. This selector function may also be created electromechanically, such as with a sensor on the power head connection plate 3144 that identifies the tool attachment and makes the speed selection in the gearbox electromechanically via solenoids, servos, and the like. Each tool attachment 3102 may have a similar or different requirement for mechanical and electrical inputs to function appropriately and within each tool attachment 3102 may comprise specific mechanical gearing and mechanisms to actuate the end effecter 3150 according to its functional requirement. The tool attachment may have a transfer gearbox 3160 connected 3162 to the output shaft 3152, 3130 of the power head gear motor to provide the rotational torque of the gear shaft at the proper orientation and rpm required by the end effecter 3150. These gears may be a planetary cluster, worm and worm gear, bevel gears, internal gears, spur gears, right angle gears, and the like. There may be a mechanical mechanism 3164 connected to the output 3168 of the gearbox that provides the appropriate motion to the end effecter, such as a crankshaft and connecting rod or a bell crank to provide reciprocating motion, a geneva wheel to provide intermittent motion or any other mechanical modifier of the rotational motion that suits the requirement and is transmitted 3170 to the end effecter. The tool attachment may also require motions, sensing or other outputs that may be better provided by electronic components 3172 rather than mechanical components. Such electronic components may be interactively connected to the power head via internal wiring 3174 and may include solenoids or servo motors to effect on/off functions, limit switches to stop and start aspects of the mechanical system within the tool, sensors of many types for controlling the end effecter or responding to the environment, lasers and photo/optics of all kinds such as vision systems.

Figure 32:
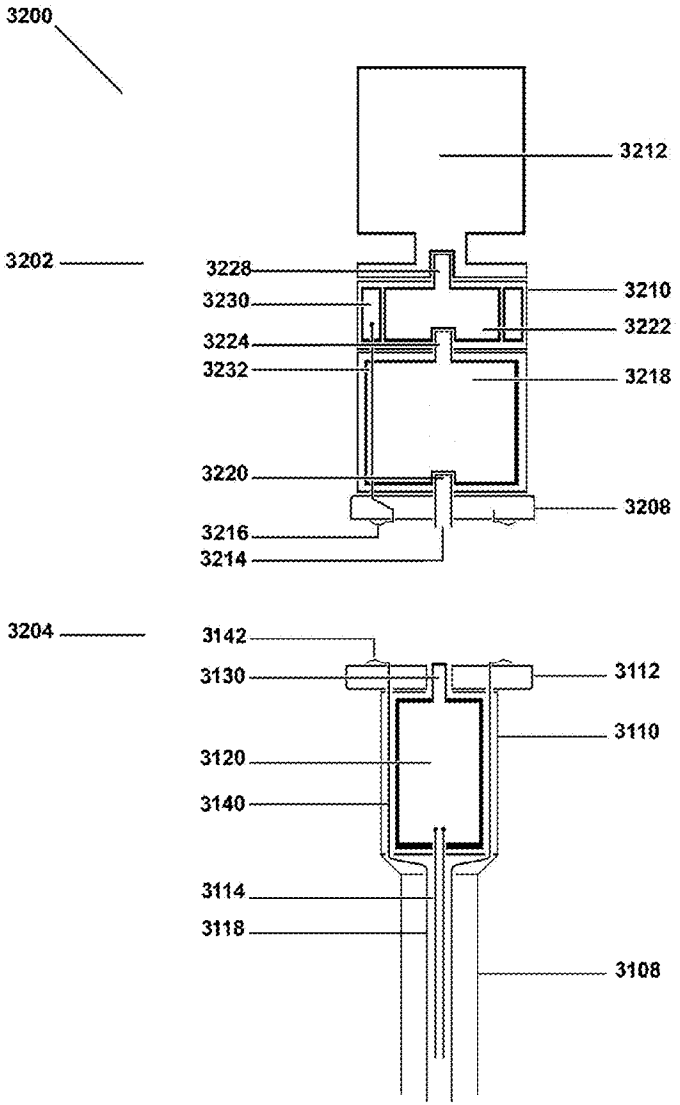
FIG. 32 depicts the internal components of a power head and tool attachment.

Referring now to FIG. 32, the power tool system 3200 is a tool system comprising a power base module 3204 of handle or control module, pole and power head facilitating attachment of a wide range of tool attachments 3202. Because the power tool system 3200 may require the user to deploy the tool at a considerable height, the overall weight of the extended tool and power head may be critical to ease of use. Thus, optimizing the distribution of heavy components such as motors, gearsets and other metal mechanisms may be important.

The power base component 3204 comprises a pole 3108 and a detachable power head 3110 which has a connection plate 3112 that permits the attachment of a wide range of tools 3202. In this embodiment, the power head 3110 may be configured to provide primary mechanical power to the tool attachment. The power head 3110 may be attached to the pole 3108 which conveys electrical power from an energy storage facility, such as a battery compartment, in the handle via conductors 3114, 3118 that are routed inside or outside the pole 3108. These electrical conductors are controlled by switches in the handle or control module and can carry either power 3114 to the motor(s) that is of relatively high voltage and current, or electrical signals 3118 that provide informational content to electronics mechanisms that control the tool attachments. The power head 3110 may comprise a high torque motor 3120 that provides power to the tool attachments 3202 via a power take off shaft 3130. The electrical signals may be passed through wires 3140 that bypass the motor to contacts 3142 on the mating connection plate 3112 that will engage mating contacts 216 on the connection plate 3208 of the tool attachment 3202.

The tool attachment 3202 comprises three parts that are the connection plate 3208, the tool body 3210 and the end effecter 3212 that accomplishes the work. The tool connection plate 3208 may engage mating features of the power head connection plate 3112 to provide positive mechanical and electrical locking of the opposing features. The connection plate may have a mating torque coupling 3214 that engage the power take off shaft 3130 of the power head. Because each tool 3202 may have unique requirements for torque and speed, it may be efficient to place all of the speed/torque gearing 3218 resident within the tool body 3210 itself and relieve the power head of the weight of gearing that may not be required by a light duty tool. Each tool attachment 3202 may have unique requirements for mechanical and electrical inputs to function appropriately and within the tool there may be required additional mechanical gearing and mechanisms to actuate the end effecter 3212 according to its functional requirement. The tool attachments may have a speed/torque control gearbox 3218 connected 3220 to the output shaft 3214, 3130 of the power head motor 3120 to provide the rotational torque of the gearshaft at the proper orientation and rpm required by the end effecter. These gears may be a planetary cluster, a worm and worm gear, bevel gears, internal gears, spur gears, right angle gears, and the like. There may also be a mechanical mechanism 3222 connected to the output 3224 of the gearbox that may provide the appropriate motion to the end effecter such as a crankshaft and connecting rod, a bell crank to provide reciprocating motion, a geneva wheel to provide intermittent motion or any other mechanical modifier of the rotational motion that suits the requirement and is transmitted 3228 to the end effecter.

The tool attachment may also require motions, sensing or other outputs that may be better provided by electronic components 3230 rather than mechanical components. Such electronic components may be interactively connected to the power head via internal wiring 3232 and may include solenoids or servo motors to effect on/off functions, limit switches to stop and start aspects of the mechanical system within the tool, sensors of many types for controlling the end effecter or responding to the environment, lasers and photo/optics of all kinds such as vision systems, and the like.

Figure 33:
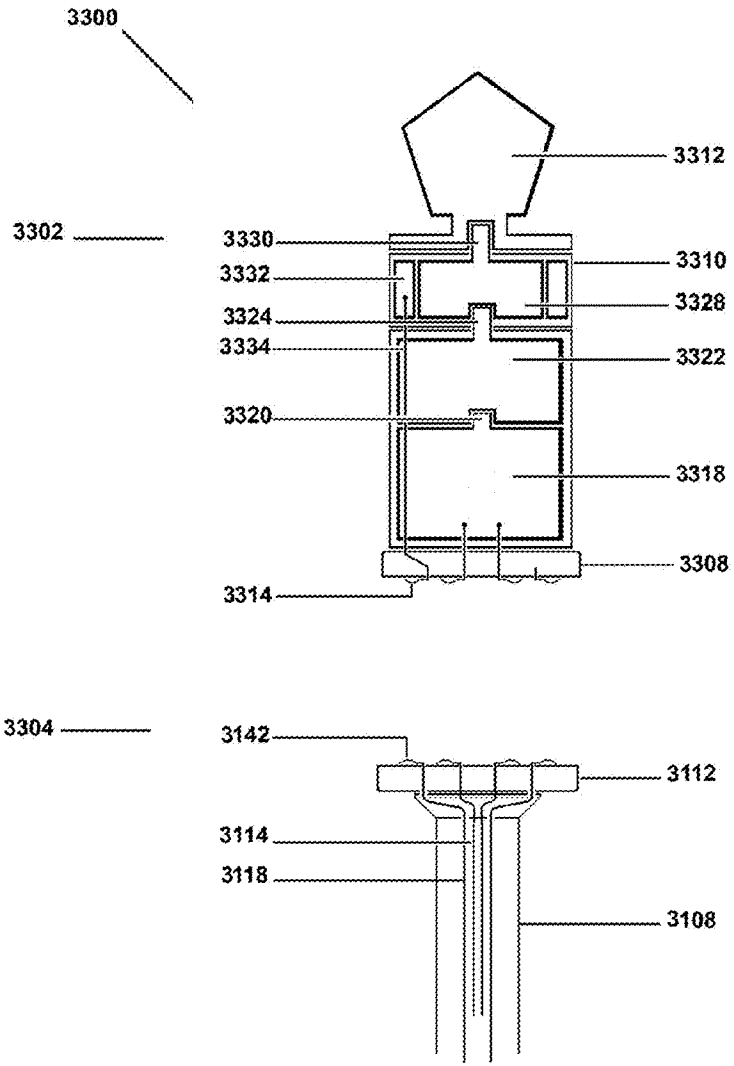
FIG. 33 depicts the internal components of a power head and tool attachment.

Referring now to FIG. 33, the power tool system 3300 may be a tool system comprising a base module 3304 of handle or control module, pole and power head facilitating the attachment of a wide range of tool attachments 3302. Because the power tool system may require the user to deploy the tool at a considerable height the overall weight of the extended tool and power head may be critical to ease of use. Thus, optimizing the distribution of heavy components such as motors, gearsets and other metal mechanisms may be important.

The base component may comprise a pole 3108 and a detachable power head 3110 which may comprise a connection plate 3112 that facilitates the attachment of a wide range of tools 3302. In this embodiment, the power head 3110 may be configured to provide electrical power and signals to the tool attachment. The power head 3110 may be attached to the pole 3108 which conveys electrical power from an energy storage facility, such as a battery compartment, in the handle or control module via conductors 3114, 3118 that are routed inside or outside the pole. These electrical conductors may be controlled by switches in the handle or control module and may carry either power 3114 to the motor(s) that may be of relatively high voltage and current, or electrical signals 3118 that may provide informational content to electronics mechanisms that control the tool attachments. The electrical signals may be passed to multiple contacts 3142 on the mating connection plate 3112 that may engage corresponding mating contacts 3314 on the connection plate 3308 of the tool attachment 3302.

The tool attachment 3302 may comprise three parts: the connection plate 3308, the tool body 3310 and the end effecter 3312 that accomplishes the work. The tool connection plate 3308 may engage mating features of the power head connection plate 3112 to provide positive mechanical and electrical locking of the opposing features. Because each tool may have unique requirements for torque and speed, it may be efficient to place the motor 3318 and all of the speed/torque gearing 3322 resident within the tool body 3310 itself and relieve the power head of the weight of gearing that may not be required by a light duty tool. The motor 3318 may transfer power to the gearbox via a coupling 3320 and the gearbox output shaft 3324 may pass the conditioned power to the tool mechanism 3328. These gears may be a planetary cluster, a worm and worm gear, bevel gears, internal gears, spur gears, right angle gears, and the like. Each tool attachment 3302 may have unique requirements for mechanical and electrical inputs to function appropriately and within the tool there may be required additional mechanical gearing and mechanisms to actuate the end effecter 3312 according to its functional requirement. There may also be a mechanical mechanism 3328 connected to the output 3324 of the gearbox that may provide the appropriate motion to the end effecter such as a crankshaft and connecting rod, a bell crank to provide reciprocating motion, a geneva wheel to provide intermittent motion or any other mechanical modifier of the rotational motion that suits the requirement and may be transmitted 3330 to the end effecter.

The tool attachment may also require motions, sensing or other outputs that may be better provided by electronic components 3332 rather than mechanical components. Such electronic components may be interactively connected to the power head via internal wiring 3334 and may include solenoids or servo motors to effect on/off functions, limit switches to stop and start aspects of the mechanical system within the tool, sensors of many types for controlling the end effecter or responding to the environment, lasers and photo/optics of all kinds such as vision systems, and the like.

Figure 34:
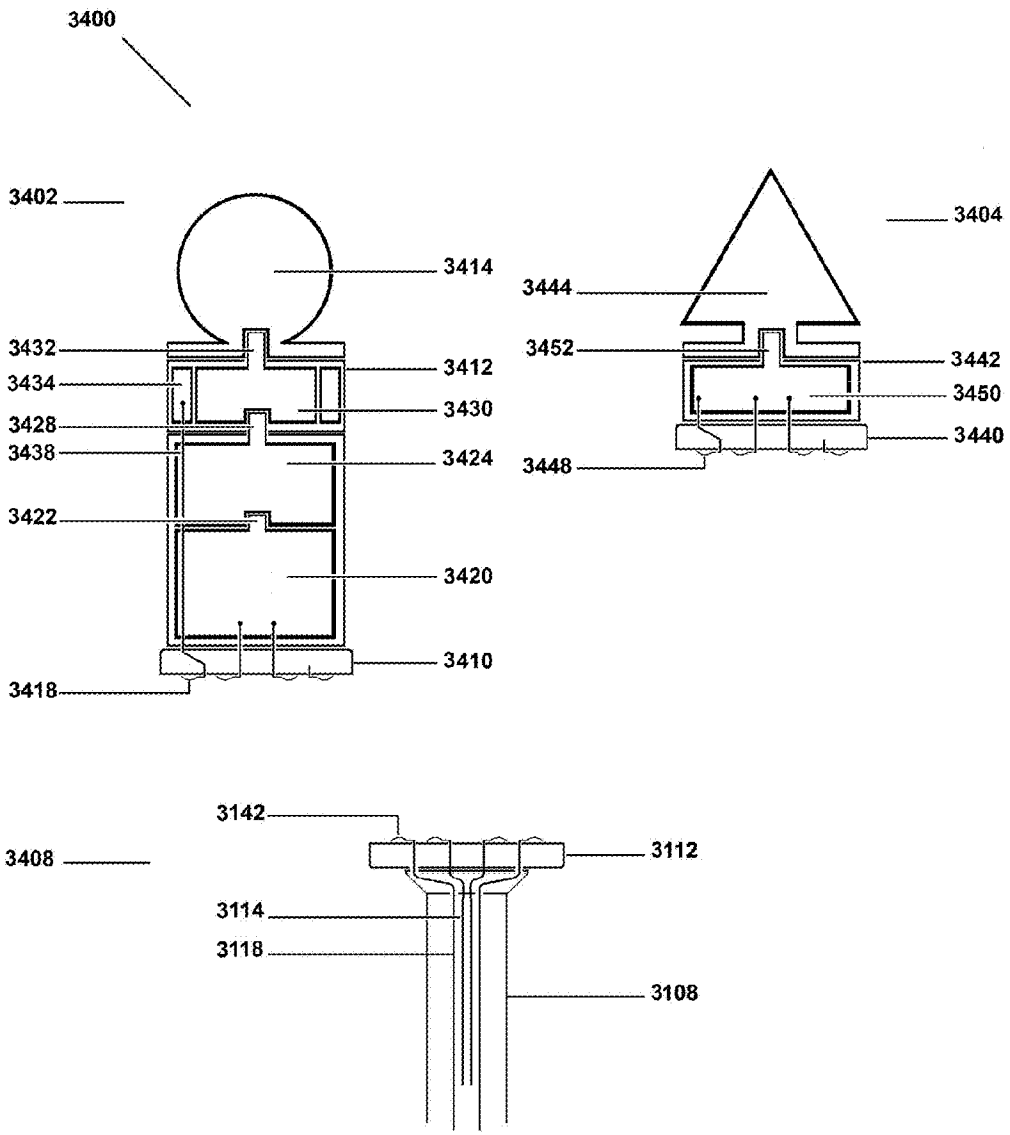
FIG. 34 depicts the internal components of a power head and tool attachment.

Referring to FIG. 34, a power tool system 3400 may be a tool system comprising a base module 3408 of handle or control module, pole and power head facilitating the attachment of a wide range of tool attachments 3402, 3404. Because the power tool system may require the user to deploy the tool at a considerable height the overall weight of the extended tool and power head may be critical to ease of use. Thus, optimizing the distribution of heavy components such as motors, gearsets and other metal mechanisms may be important.

The power base component may be comprised of the pole 3108 and the detachable power head 3110 which may have a connection plate 3112 that facilitates the attachment of a wide range of tools 3302. In this embodiment, the power head 3110 may be configured to provide electrical power and signals to the tool attachment. The power head 3110 may be attached to the pole 3108 which conveys electrical power from an energy storage facility, such as a battery compartment, in the handle or control module via conductors 3114, 3118 that are routed inside or outside the pole. These electrical conductors may be controlled by switches in the handle or control module and may carry either power 3114 to the motor(s) that may be of relatively high voltage and current, or electrical signals 3118 that may provide informational content to electronics mechanisms that control the tool attachments. The electrical signals may be passed to multiple contacts 3142 on the mating connection plate 3112 that engage corresponding mating contacts 3314 on the connection plate 3308 of the tool attachment 3302.

A wide range of tool attachments may be available for the power tool system. Some tools may be relatively complex in function 3402 and other tools may be simple 3404. Both complex and simple tool attachments may comprise at least three parts: the connection plate (3410 and 3440), the tool body (3412 and 3442) and the end effecter (3414 and 3444) that accomplishes the work. The tool connection plate (3410 and 3440) may engage mating features of the power head connection plate 3112 to provide positive mechanical and electrical locking of the opposing features. Because each tool 3402, 3404 may have unique requirements for the electromechanical mechanism, it may be efficient to place that mechanism resident within the tool body (3412 and 3442) itself and relieve the power head of the weight of gearing that may not be required by a light duty tool (3404).

In the embodiment of a more complex tool 3402, the motor 3420 may transfer power to the gearbox via a coupling 3422 and the gearbox output shaft 3428 may pass the conditioned power to the tool mechanism 3328. These gears may be a planetary cluster, a worm and worm gear, bevel gears, internal gears, spur gears, right angle gears or others. Each tool attachment may have a unique requirement for mechanical and electrical inputs to function appropriately and within the tool there may be required additional mechanical gearing and mechanisms to actuate the end effecter 3414 according to its functional requirement. There may also be a mechanical mechanism 3430 connected to the output 3428 of the gearbox that may provide the appropriate motion to the end effecter such as a crankshaft and connecting rod or a bell crank to provide reciprocating motion, a geneva wheel to provide intermittent motion or any other mechanical modifier of the rotational motion that suits the requirement and is transmitted 3432 to the end effecter.

The tool attachment may also require motions, sensing or other outputs that may be better provided by electronic components 3434 rather than mechanical components. Such electronic components may be interactively connected to the power head via internal wiring 3438 and include solenoids or servo motors to effect on/off functions, limit switches to stop and start aspects of the mechanical system within the tool, sensors of many types for controlling the end effecter or responding to the environment, lasers and photo/optics of all kinds such as vision systems, and the like.

The weight and cost savings for the base system of the power tool that may be obtained by placing all of the power and drivetrain in the tool attachment can be appreciated when a simple tool 3404 is analyzed. A tool such as the aerosol spraying attachment for the power tool system enables the remote activation of an aerosol spray can, such as insecticide, paint, lubricant, and the like, but requires only a solenoid and simple linkage for activation. The elecromechanical element 3450 may be simply connected 3452 to the end effecter and requires no other elements for a fully functional device.

Figure 35:
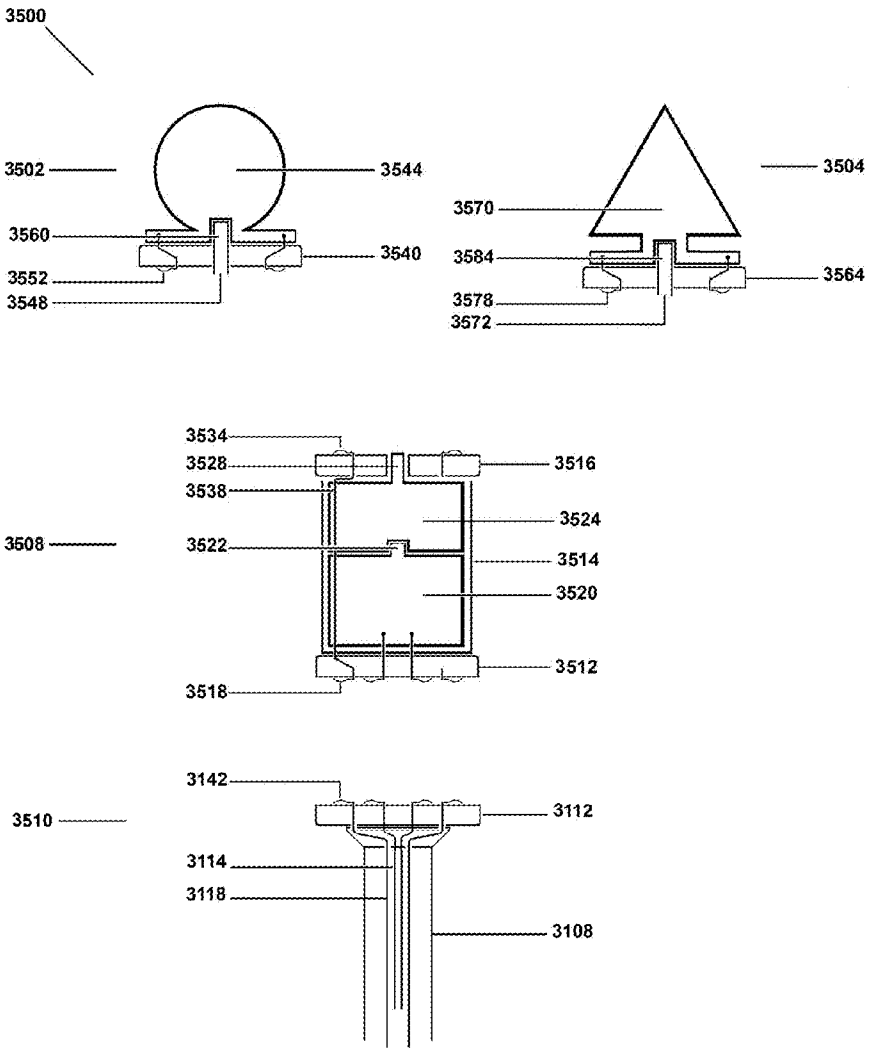
FIG. 35 depicts the internal components of a power head and tool attachment.

Referring now to FIG. 35, the power tool system 3500 may be a tool system comprising a base module 3510 of handle or control module, pole and power head and a wide range of tool attachments 3502, 3504. Because the power tool system may require the user to deploy the tool at a considerable height the overall weight of the extended tool and power head may be critical to ease of use. Thus, optimizing the distribution of heavy components such as motors, gearsets and other metal mechanisms may be important. In many instances there are a range of tools that have similar power requirements, such as a tree saw, hedge trimmer and sickle bar trimmer, may all require reciprocating motion and similar rpm and torque inputs and an efficient approach may be to create a platform of product around a platform power module 3508 so that several attachments can operate off a standard gearmotor/mechanism.

The base component may comprise a pole 3108 and the detachable power head 3110 which may have a connection plate 3112 that permits the attachment of the platform power module 3508. In this embodiment, the power head 3110 may be configured to provide electrical power and signals to the platform power module 3508 attachment. The power head 3110 may be attached to the pole 3108 which conveys electrical power from the energy storage facility, such as a battery compartment, in the handle via conductors 3114, 3118 that are routed inside the pole. These electrical conductors may be controlled by switches in the handle and can carry either power 3114 to the motor(s) that is of relatively high voltage and current, or electrical signals 3118 that provide informational content to electronics mechanisms that control the tool attachments. The electrical signals may be passed to multiple contacts 3142 on the mating connection plate 3112 that may engage corresponding mating contacts 3518 on the connection plate 3512 of the platform power module 3508.

Each platform power module 3508 may support a range of similar tool attachments. The adaptive nature of the platform power module 3508 may allow a family of tool attachments to be very simple. In the platform power module 3508, the motor 3520 may transfer power to the gearbox via a coupling 3522 and the gearbox output shaft 3528 may pass the conditioned power to the platform power module 3508 mechanism drive 3524. The gearbox may be a planetary cluster, a worm and worm gear, bevel gears, internal gears, spur gears, right angle gears or others. Each tool family may have unique requirements for mechanical and electrical inputs to function appropriately and within the tool there may be required additional mechanical gearing and mechanisms to actuate the end effecter 3544, 3570 according to its functional requirement. The platform power module 3508 may have a mechanical mechanism 3524 connected to the output 3522 of the gearbox that may provide the appropriate motion to the end effecter such as a crankshaft and connecting rod or a bell crank to provide reciprocating motion, a geneva wheel to provide intermittent motion or any other mechanical modifier of the rotational motion that suits the requirement and is transmitted 3528 to the connection plate 3516 that will adapt the tool. The tool attachments may also require motions, sensing or other outputs that may better be provided by electronic components rather than mechanical components. Such electronic components may be interactively connected to the platform power module 3508 via internal wiring 3538 that pass the power and signals to contacts 3534 on the connection plate 3516.

The range of simple tool attachments for a platform family may comprise three parts: the connection plate (3540 and 3564), the tool body (3542 and 3568) and the end effecter (3544 and 3570) that accomplishes the work. The tool connection plate (3540 and 3564) may engage mating features of the platform power module 3508 connection plate 3516 to provide positive mechanical and electrical locking of the opposing features. The electrical functional elements may include solenoids or servo motors to effect on/off functions, limit switches to stop and start aspects of the mechanical system within the tool, sensors of many types for controlling the end effecter or responding to the environment, lasers and photo/optics of all kinds such as vision systems, and the like.

The weight and cost savings for the base system of the power tool and for the range of family tool modules that can be obtained by placing all of the power and drivetrain in the platform power module can be appreciated when the family platform toolset is analyzed. The range of tools that may adapt to the similar outputs of the platform power module require minimal differentiation in the mechanical linkages. The end effecter 3544, 3570 may be connected via the pass-through connection 3560, 3584 of the connector plate 3540, 3564 interface and the connections of the connecter plate for mechanical power 3548, 3572 and electric signal 3552, 3578 may be completed requiring no other elements for a fully functional device.

Figure 8:
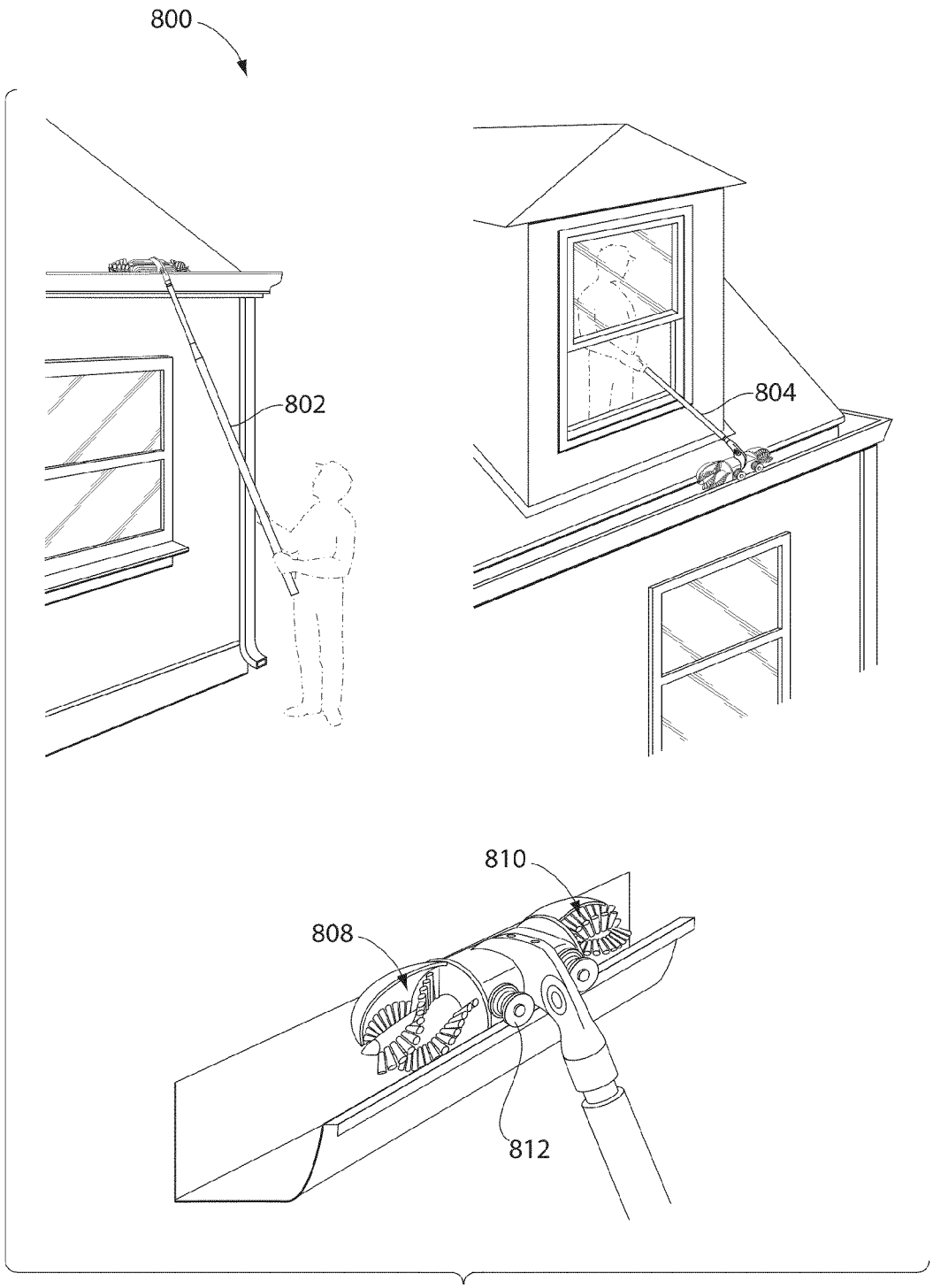
FIG. 8 depicts a gutter cleaning system in operation.

Referring to FIG. 8, an embodiment of a gutter cleaning system 802 is shown in use. The system 802 may comprise a guide pole 804, impellers 808, impeller chutes 810, and support/guide wheels 812. The system 802 may be configured to allow a user to deploy the system 802 into a gutter with the use of the guide pole 804. In some embodiments, the guide pole 804 may be a telescoping pole. In some embodiments, the user may lift the gutter-cleaning system to the gutter from below, place it in the gutter, and initiate operation of the gutter-cleaning system either before or after placing the system within the gutter. The user may move the gutter-cleaning system along the gutter floor, optionally with the aid of a support guide/wheel. In other embodiments, a user may lower a gutter-cleaning system into a gutter from above, such as from a window. The impellers 808 may dislodge and evict gutter debris from the gutter. The impeller chutes 810 may direct the high velocity gutter debris over the outer edge of the gutter. The support/guide wheels 812 may use the gutter edge to ease movement of the system through the gutter trough.

Figure 9:
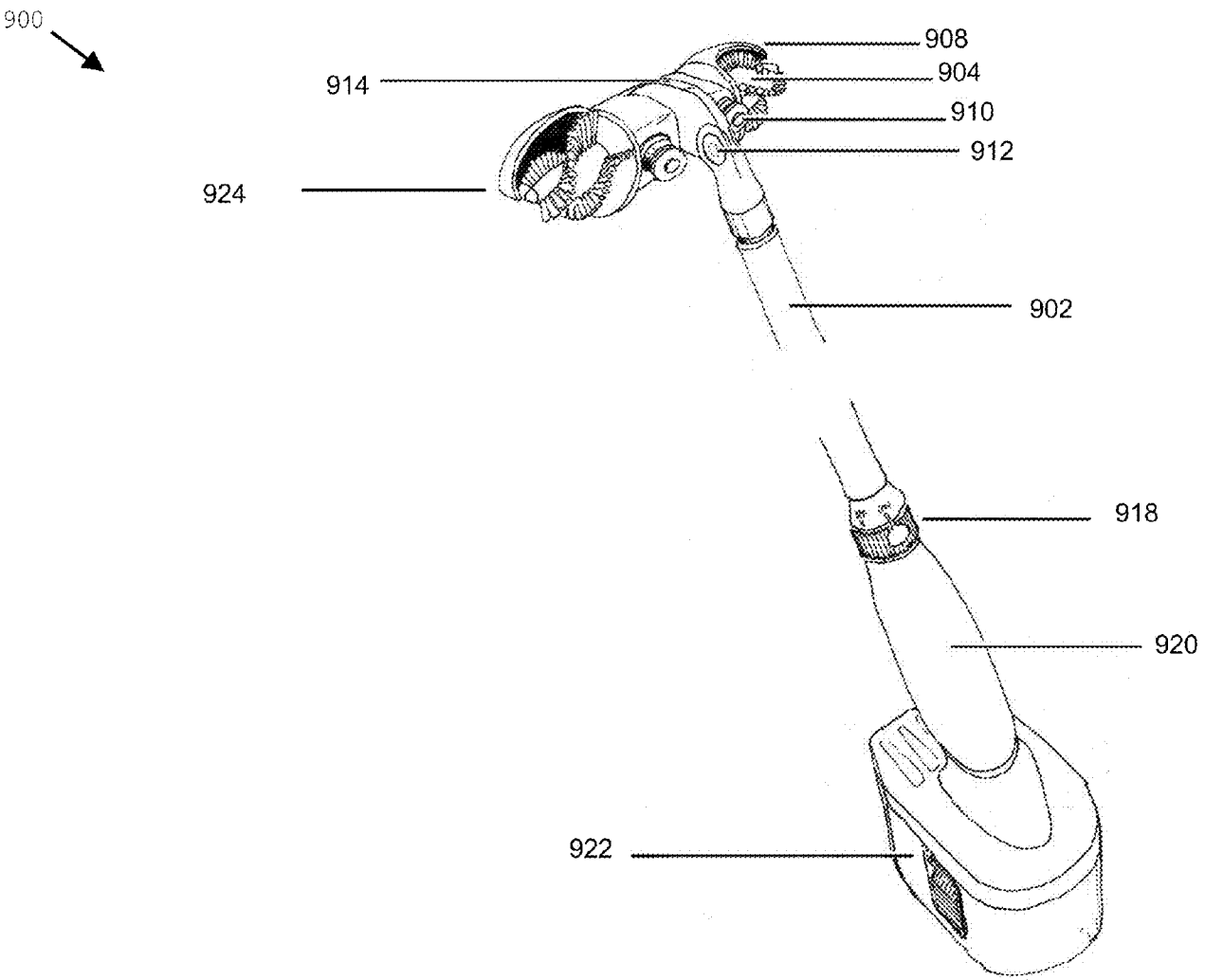
FIG. 9 depicts a gutter cleaning system.

Referring to FIG. 9, an embodiment of a gutter cleaning system 900 is depicted. The gutter cleaning system 900 may comprise a power base 902, impellers 904 on both ends of the gutter-cleaning device 924, a chute housing 908 for each impeller 904, support/guide wheels 910, fasteners 914, a locking pivot 912, a handle control 918, a grip area 920, a rechargeable battery 922, and the like. The system may be configured to allow a user to deploy the system into a gutter with the use of the power base 902. In some embodiments, the power base 902 may comprise a telescoping pole.

Figure 10:
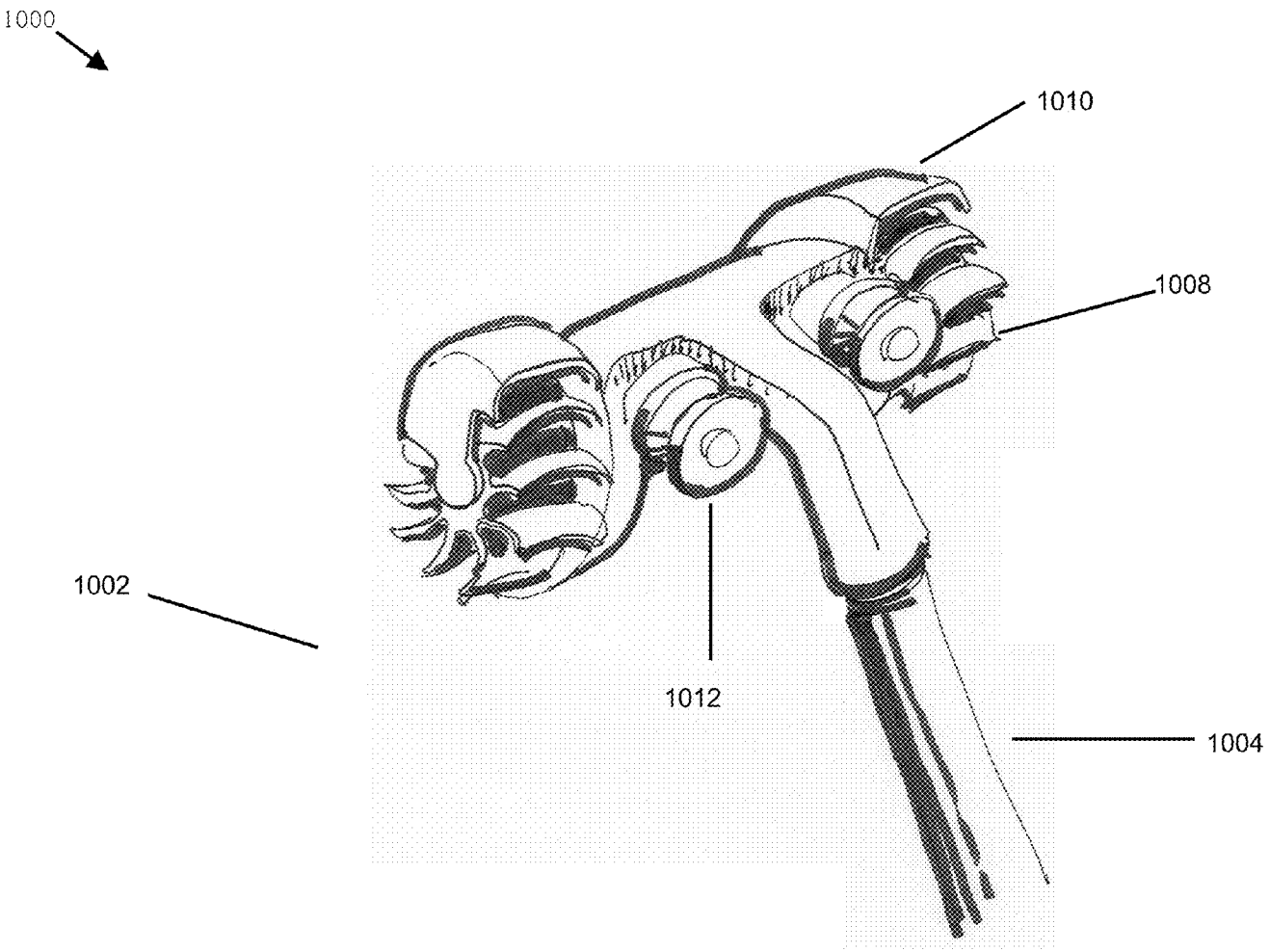
FIG. 10 depicts a gutter cleaning system.

Referring to FIG. 10, an embodiment of a gutter cleaning system 1002 is shown. The system 1002 may comprise a guide pole 1004, impellers 1008, impeller chutes 1010, and support/guide wheels 1012. The system 1002 may be configured to allow a user to deploy the system 1002 into a gutter with the use of the guide pole 1004. In some embodiments, the guide pole 1004 may be a telescoping pole. The impellers 1008 dislodge and evict gutter debris from the gutter. The impeller chutes 1010 direct the high velocity gutter debris over the outer edge of the gutter. The support/guide wheels 1012 use the gutter edge to ease movement of the system through the gutter trough.

Figures 11, 11A, 11B:
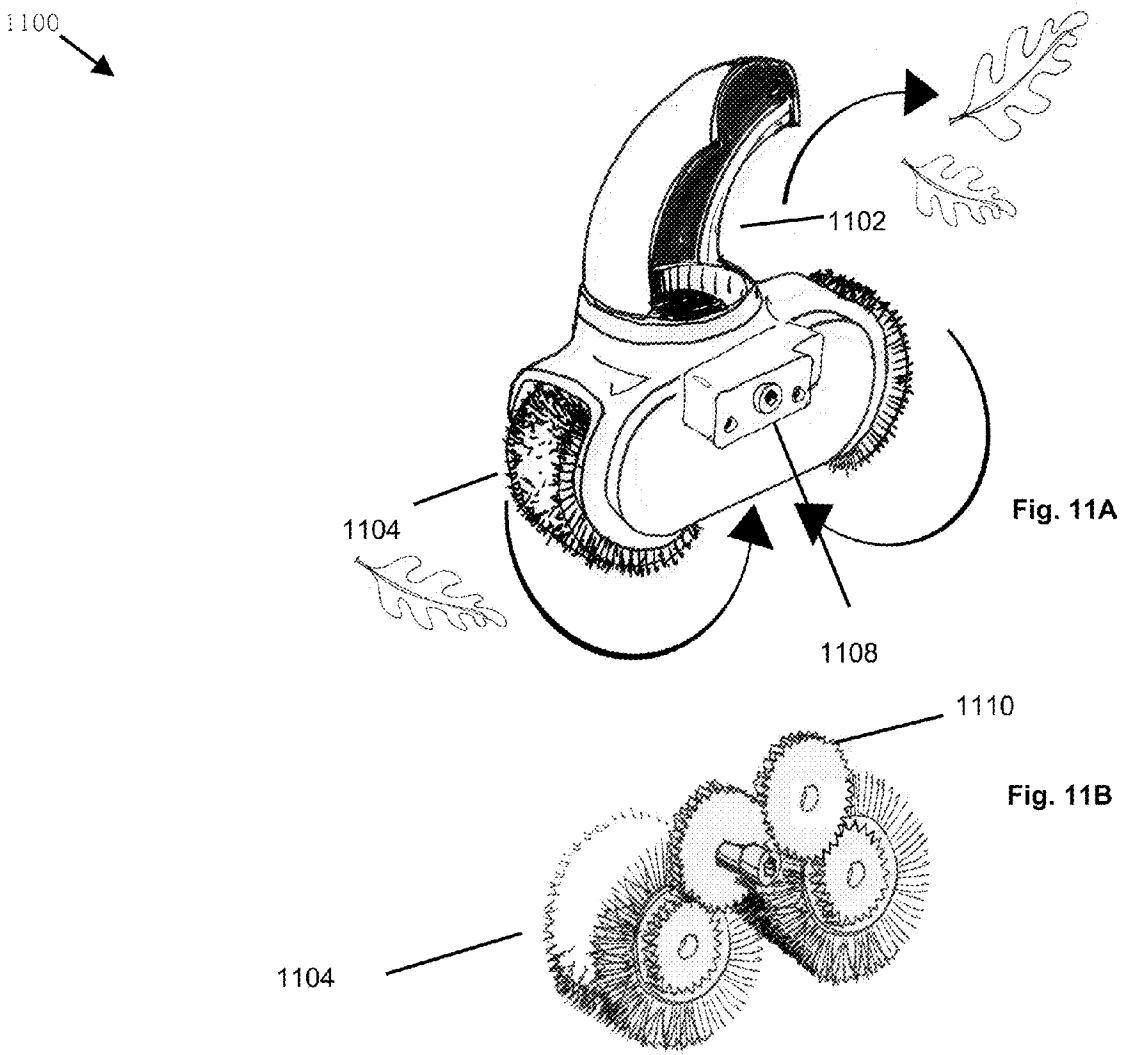
FIG. 11 depicts a counter-rotating brush gutter cleaner

Referring to FIG. 11A, a counter-rotating brush gutter cleaner 1100 may capture gutter debris in the counter-rotating brushes 1104 and move the captured debris against the surface of the gutter into the cleaner 1100. Eventually, the debris may break free of the cleaner 1100 and get discharged from the chute 1102 disposed between the brushes 1104 at high enough velocity so it clears the outside wall of the gutter and falls to the ground or is otherwise ejected, captured, and the like. The cleaner 1100 may attach to a power base 160 at an attachment point 1108.

Referring to FIG. 11B, a cutaway view of the gear mechanism for the counter-rotating brushes 1104 is shown. A single gear 1110 or multiple gears 1110 may engage a gear 1110 disposed on a counter-rotating brush 1104 and cause the brush 1104 to rotate about a central axis. The primary gear driving the assembly may be driven by a power take-off coupling of a power base. In an alternative embodiment, the brushes 1104 may be directly rotated along a driven axle. The counter-rotating brushes 1104 may be flexible full-width paddles, full circumference flexible bristle cylindrical brushes, spiral flexible bristle brushes, spiral flexible straight or hooked-end wire brushes, flexible alternating brush paddles, flexible bucket paddles, alternating blade flexible paddles, and the like.

Figure 12:
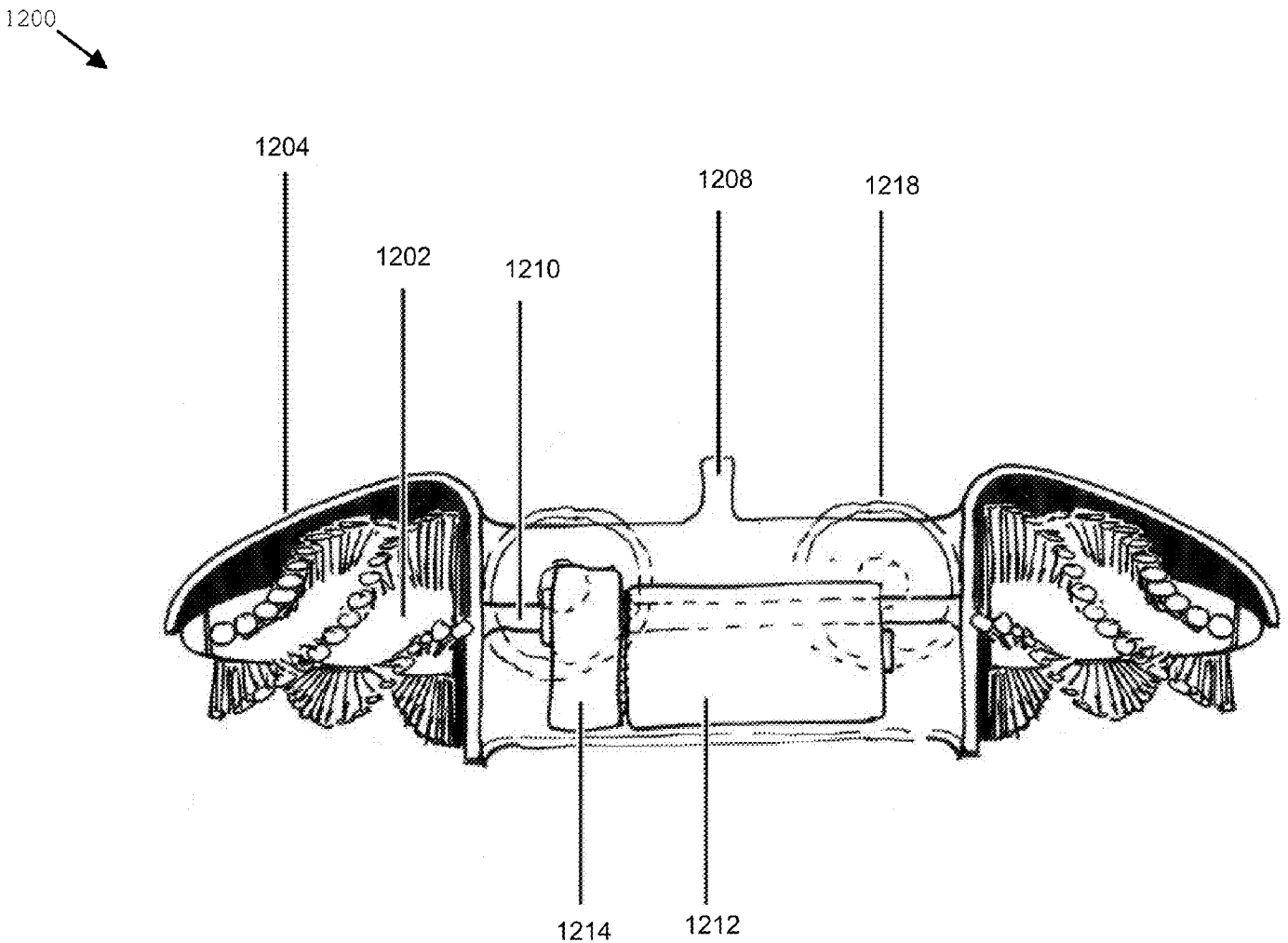
FIG. 12 depicts a gutter-cleaning device.

Referring to FIG. 12, the gutter-cleaning device 1200 may comprise an impeller 1202 on both ends of the device, a chute 1204 housing for each impeller, a top fastener 1208, an impeller drive shaft 1210, an impeller drive motor 1212, an impeller drive transmission 1214, support/guide wheels 1218, and the like. The impeller 1202 may be mounted to the impeller drive shaft 1210. The impeller drive shaft 1210 may be coupled to the impeller transmission 1214 and configured to extend out each end of the impeller transmission 1214 to connect to each impeller 1202 at each end of the gutter-cleaning device 1200. The impeller drive motor 1212 may be mechanically coupled to the impeller transmission 1214 such that the rotational output of the impeller drive motor 1212 is a rotational input to the impeller transmission 1214. In some embodiments of the gutter-cleaning device 1200, the device may comprise an impeller drive motor 1212 for each impeller 1202. In some embodiments, the impeller drive motor 1212 may be mounted within each impeller 1202. The combination of the impeller drive motor 1212 and impeller drive transmission 1214 may be configured and disposed to drive the impeller 1202 with the required rotational speed and torque. In some embodiments, the impeller drive motor 1212 may comprise a gasoline- or biofuel-powered internal combustion engine, a solar-powered engine, an electric motor, and the like. In embodiments, the gutter cleaning device 1200 may further comprise an energy storage facility disposed within the housing. In this embodiment, the gutter-cleaning device 1200 may not need power supplied to it exogenously. In embodiments, the gutter-cleaning device 1200 may not comprise an energy storage facility or other means to obtain power and must therefore be powered exogenously. In this embodiment, the gutter-cleaning device 1200 may be connected to a power base, as described herein, to obtain power. The energy storage facility may be housed within the power base or placement facility and electrically connected to the impeller drive motor 1212.

Figure 13:
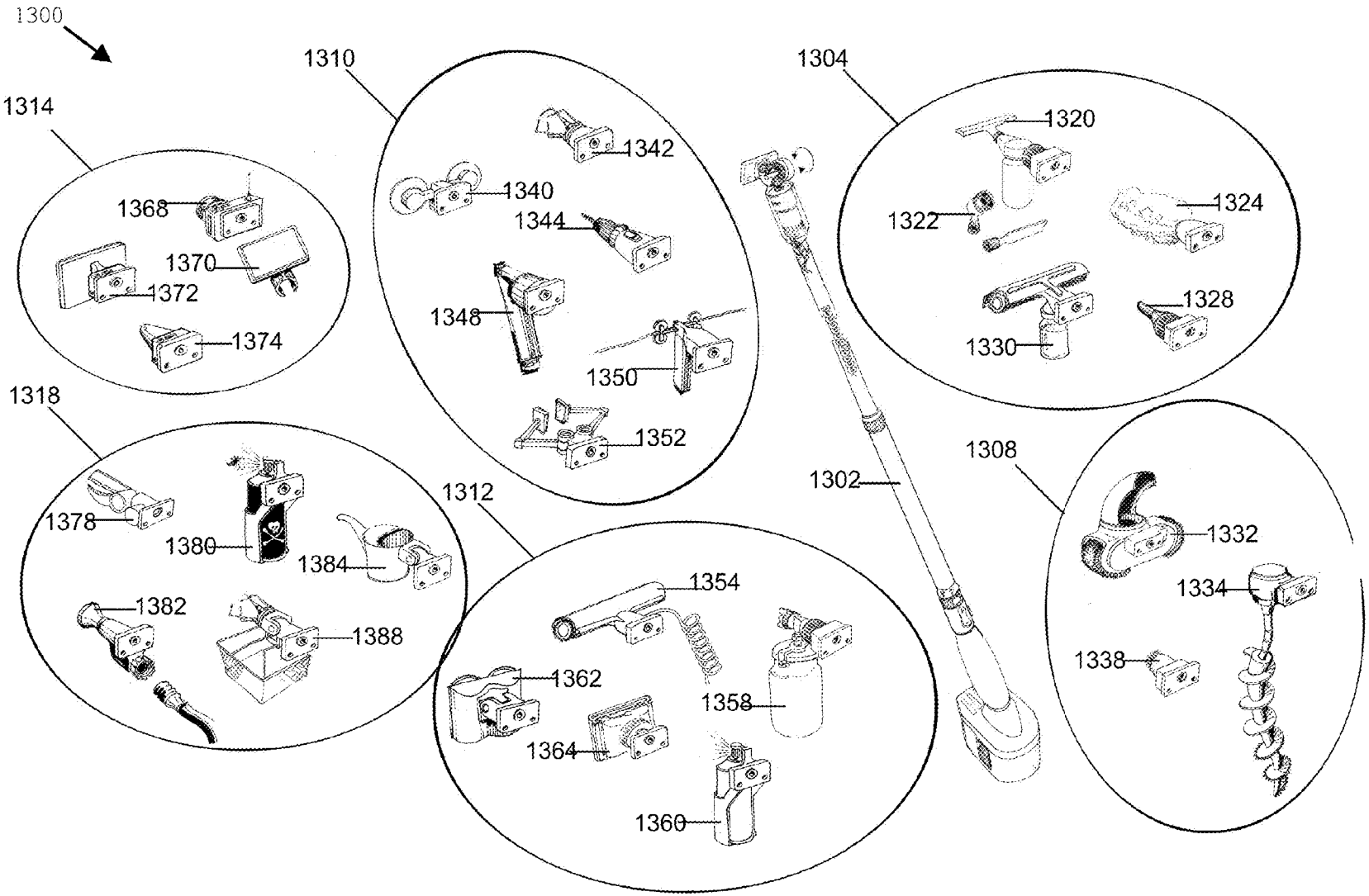
FIG. 13 depicts various families of functional modules.

Referring to FIG. 13, a multi-functional power tool system may comprise a power base 1302 with a head configured to attach interchangeable functional modules. In an embodiment, a single power base 1302 may be able to connect with a variety of different functional modules to provide power and/or control to the attached modules. For example, a user may have a need to perform various outdoor cleaning tasks, such as gutter cleaning and power window washing. The user may mount a gutter-cleaning device with counter-rotating brushes to a power base, lift the device into place in the gutter, and then guide the device along the gutter floor, optionally with the aid of a support guide/wheel, to remove debris in the gutter. Then, the user may dismount the gutter-cleaning device and attach the power window washing module to the power base. The power base may facilitate many such combinations of accomplishments with various functional modules. The multi-functional power tool system may require less storage, such as at an end-use location, a retail location, a warehouse, a distributor, and the like, for the single power base and multiple attachments than for dedicated equipment corresponding to each of the attachments. Manufacturing and distribution may be simplified since the power base may be an invariable, standard component of the system utilized with many different functional modules. The multi-functional power tool system may support future expansion by simply obtaining a functional module that is compatible with the power base. The multi-functional power tool system may be easy to repair and maintain since a single energy storage facility needs to be re-energized, a single component may comprise the majority of the powertrain, the functional modules may be easy to repair since they may lack a majority of the powertrain, and the like.

In an embodiment, the functional modules may attach to the power base 1302 at a mounting plate. The functional modules may be cleaning modules 1304, gutter cleaning modules 1308, holding and fastening modules 1310, finishing and painting modules 1312, inspection modules 1314, landscape/garden modules 1318, and the like. In an embodiment, the functional module may comprise some or all of the necessary elements to receive power from the power base 1302, optionally through a power head, and use it to drive operation of the module. In an embodiment, the functional module may comprise some or all of the necessary elements to receive control signals from the power base 1302 and to act on the received signals. In any event, any of the functional elements of the functional module may be disposed within the functional module or the power base 1302. The power base 1302 may comprise any elements necessary to provide power, control, motive force, and the like to a functional module.

In an embodiment, cleaning modules 1304 may be used with the power base 1302 to provide a cleaning power tool system. The cleaning modules 1304 may be a microvacuum module 1320, various vacuum heads 1322, such as a brush, a crevice nozzle, and the like, a rotating feather duster 1324, a turbine dusting blower 1328, a power window cleaner with fluid dispensing head powered roller with squeegee 1330, a sweeper, a scrub brush, a liquid pump, a degreaser pump, a shoe shiner, and the like. The functions and settings for each functional module may be modified by a user's manual adjustment, a control facility 168, and the like. For example, the rate of the liquid pump, the force of the dusting blower, the speed of the scrub brush, and the like may all be adjusted.

Figure 51:
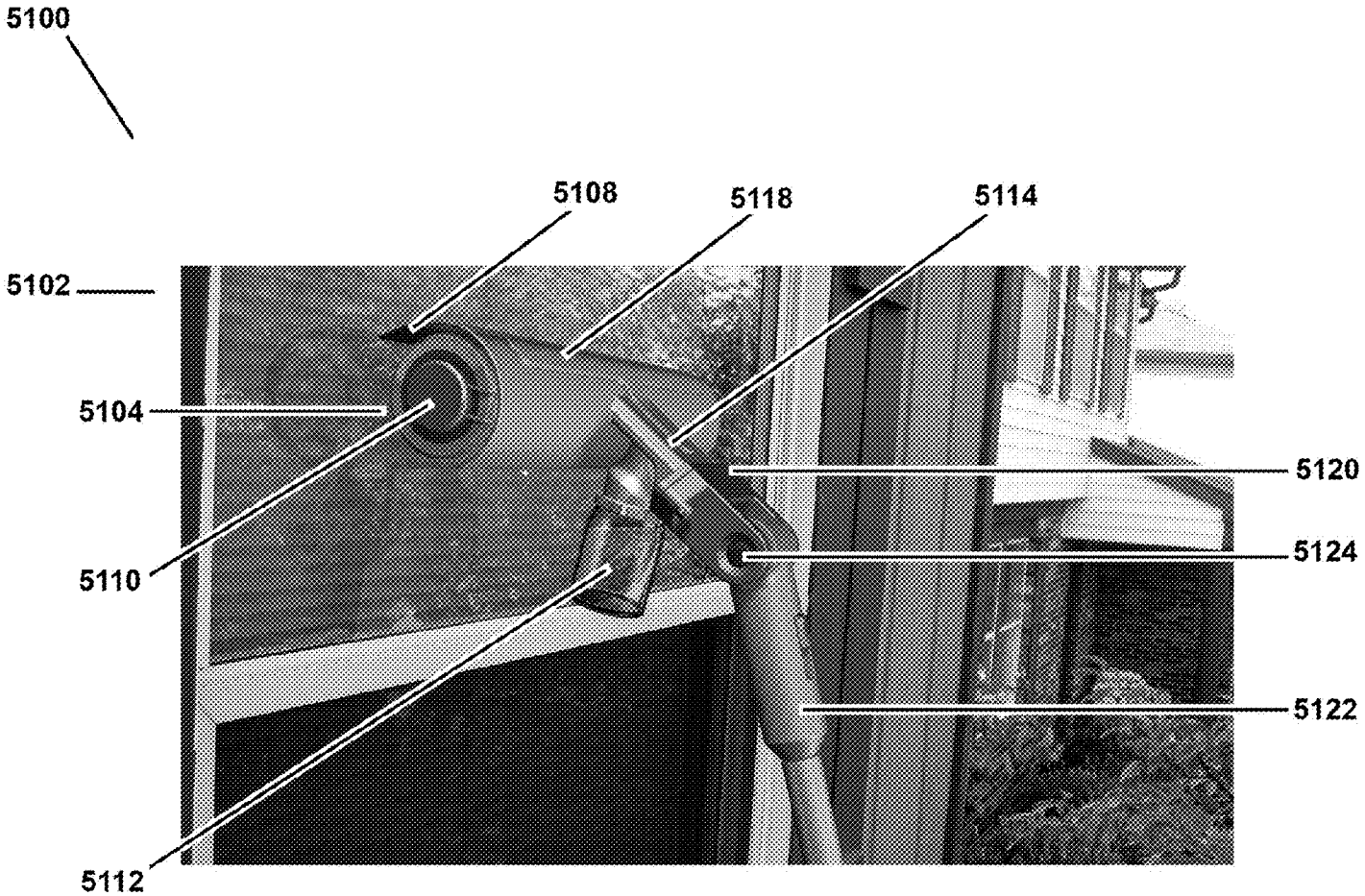
FIG. 51 depicts a window washing tool.

Referring now to FIG. 51, the window washing tool attachment 5100 to the power tool system may provide the user the ability to wash windows on upper stories or in high interior spaces which may be advantageous as it will keep the user from a dangerous position on the top of a ladder. The window washing attachment 5102 may provide a complete system for cleaning glass and may comprise three basic elements: a rotating scrubbing brush 5104, a washing fluid dispensing system 5112 and a squeegee 5108. The window washing tool attachment may attach to the power head 5122 of the power tool system. The power head may have a rotating joint 5124 that allows the user to adjust the angle of the window washing tool to the window plane. The window washing tool attachment may attach to the power head 5122 of the power tool system by a connection plate 5120 that may provide registration features to align mechanical components and resist torque couples and provides slip-free engagement of the power output shaft to the input shaft of the window washing tool assembly. The rotational power provided by the power head may be transferred via a gear train in the body 5114 of the tool to turn the cylindrical scrubbing brush 5104 with the geartrain connecting to the horizontal rotational axis 5110 of the brush. Washing fluid 5112 may be dispensed onto the window via distribution tubes and spray heads 5118 by an electrical pump internal to the body of the tool 5114 that may be triggered by electrical connection, transferred through the connection plate when the user switches power to the pump from a control in the handle of the power tool system. After scrubbing the window, the user may squeegee the glass clean with the built-in squeegee 5108 that may be activated to the forefront use condition by an electrical input from the handle.

Figure 52:
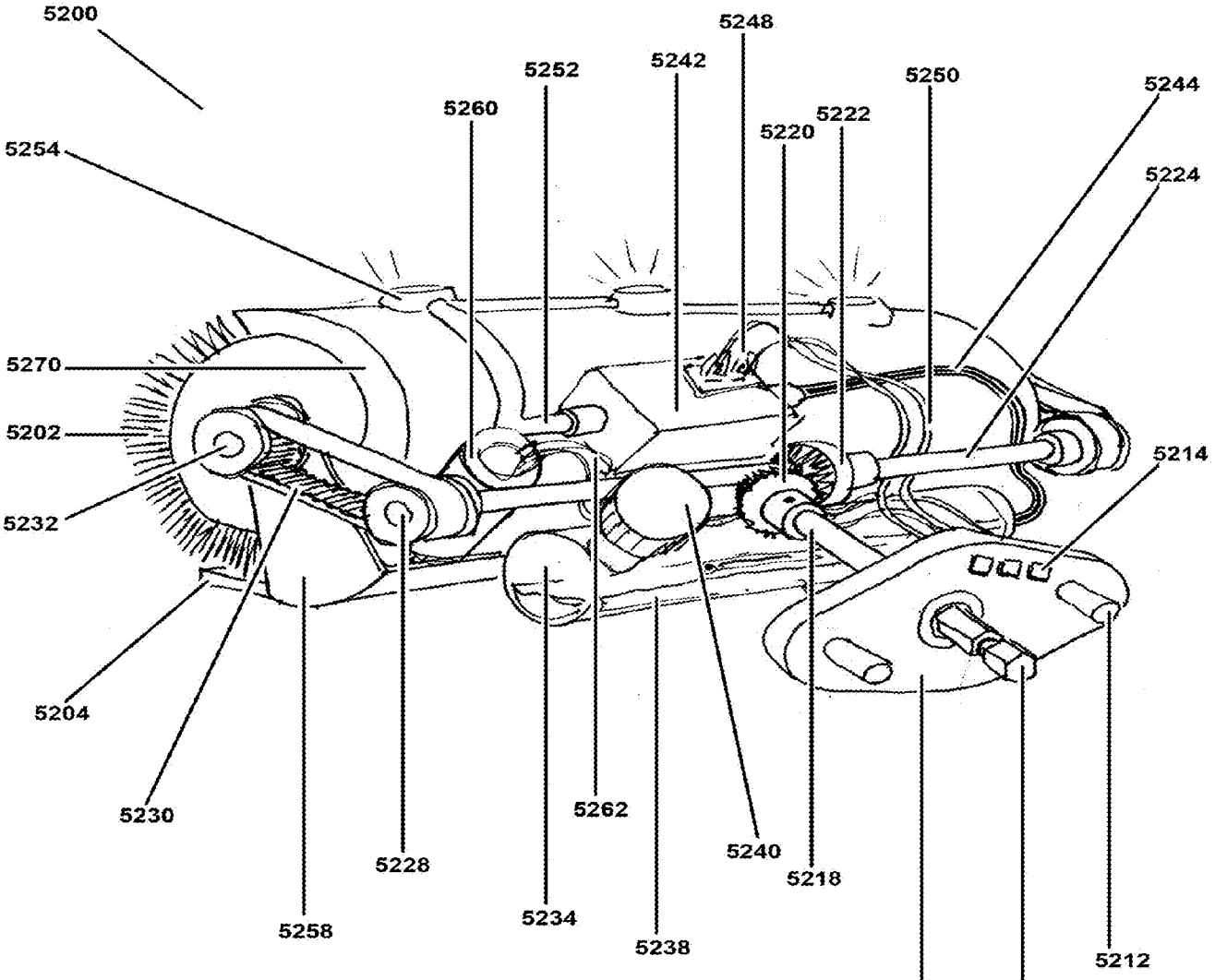
FIG. 52 depicts a component view of a window washing tool attachment.

Referring to FIG. 52, the window washing tool attachment 5200 to the power tool system may provide the user the ability to wash windows on upper stories or in high interior spaces which may be advantageous as it will keep the user from a dangerous position on the top of a ladder. The window washing attachment may provide a complete system for cleaning glass and may comprise three basic elements: the rotating scrubbing brush 5202, the washing fluid dispensing system 5234 and the squeegee 5204. The window washing tool attachment may attach to the power head of the power tool system by a connection plate 5208 that provides registration features 5212 to align mechanical components and resist torque couples and provides slip-free engagement of the power output shaft to the input shaft 5210 of the window washing tool assembly. Electrical contacts 5214 may transfer electrical current switched by the user from the handle controls to energize electromechancial components in the window washing tool. The rotational power provided by the power head may be transferred via the input shaft 5218 to a right angle input bevel gear 5220 that meshes with an identical output bevel gear 5222 at right angles to the input gear that drives a horizontal transfer shaft 5224. Either of the bevel gears may be of a different pitch diameter to provide a gear reduction or increase as required by the output rotational speed desired for the cylindrical scrubbing brush. One or both ends of the transfer shaft 5224 may have timing gears 5228 affixed that transfer the power to another timing gear 5232 affixed to the end of the cylindrical scrubbing brush 5202 central shaft. This connection may also be achieved by other gearing alternatives such as two ninety degree bevel gear connections or a flexible shaft drive. Cleaning fluid 5238 may be supplied to the window surface via a fluid reservoir 5234 and pump 5242 system. A fluid reservoir 5234 which contains a usable volume of cleaning fluid 5238 and may be refillable by a fluid channel with a fluid-proof cap 5240 may be dispensed by an electrical pump 5242 to the window surface. The electrical pump may run and pump fluid onto the window surface when the user triggers a switch on the power tool system handle and electricity is conducted through the conductor contacts 5213 of the window cleaning tool attachment via electrical wires 5250 to the electrical connections 5248 to the pump 5242. The pump may pull washing fluid 5238 from the reservoir 5234 via a conveyance tube 5244 and pressurizes the fluid as it pumps it into the distribution tube 5252 by which it is conveyed to the spray nozzles 5254 wherein it is deposited as a fine mist onto the window pane. Alternatively, the fluid may be dispensed onto the brush 5202 itself wherein it is used to scrub dirt from the window pane. After scrubbing the window, the user squeegees the glass clean with the built-in squeegee 5204 that may be mounted on an armature 5258 with a pivot on or near the rotational axis of the cylindrical brush 5202 activated to the forefront use condition by the activation of an electrical solenoid 5260, servo or other electromechanical device that may provide translation of and appropriate force and direction so that the squeegee blade 5204 moves forward to a foremost contact point that permits the movement of the window washing assembly to squeegee the fluid and dirt from the window surface. The solenoid or other device may be activated when the user triggers a switch on the power tool system handle and electricity is conducted through the conductor contacts 5213 of the window cleaning tool attachment via electrical wires 5262 to the electrical connections to the solenoid 5260 or other electromechanical device and the squeegee armature moves forward so that the squeegee may be in the usable position.

In an embodiment, gutter cleaning modules 1308 may be used with the power base 1302 to provide a gutter cleaning power tool system. The gutter cleaning modules 1308 may be a gutter-cleaning device with impellers, as previously described herein, a counter-rotating brush gutter cleaner 1332, a downspout cleaning brush 1334, a vibratory (ultrasonic, mechanical, etc.) micro-needle for ice removal 1338, any of the gutter-cleaning devices in FIGS. 9-12, and the like. The functions and settings for each functional module may be modified by a user's manual adjustment, a control facility 168, and the like. For example, the speed of the impellers, the intensity of the ultrasonic wave, and the like may all be adjusted.

In an embodiment, holding and fastening modules 1310 may be used with the power base 1302 to provide a holding and fastening power tool system. The holding and fastening modules 1310 may be a dual suction cup flat panel gripper with remote actuate and release 1340, such as for a glass, a picture, and the like, light bulb changer with rotary head 1342, drill/driver, optionally with remote interchangeable bits 1344, power nailer/stapler 1348, wire/cord stapler 1350, two-arm gripper 1352, and the like. The functions and settings for each functional module may be modified by a user setting, a control facility 168, and the like. For example, the power nailer may be adjusted for various size nails, the power stapler may be adjusted for various size staples, the cord stapler may be adjusted for various diameters of cords, and the like.

The holding and fastening modules 1310 may include a keyless chuck coupled to the power head 404.

Applications of the holding and fastening modules 1310 include, without limitation, providing a cordless drill with an extended reach. The chuck may accept drills, shanks, and the like.

The chuck may be fitted with an inspection video camera providing a user with a close-up view of a drilling site. The inspection video camera may be described in detail hereinafter with reference to FIGS. 23 and 24, and elsewhere.

Applications of the holding and fastening modules 1310 includes, without limitation, setting threaded fasteners. Without limitation, square drive fasteners and other self-capturing fasteners may be utilized in such applications.

Figure 25B:
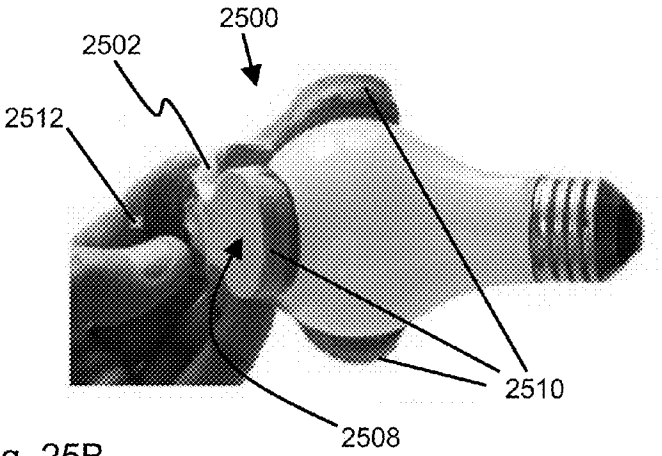
FIG. 25B depicts a side perspective view of a light bulb changing tool.
Figure 25A:
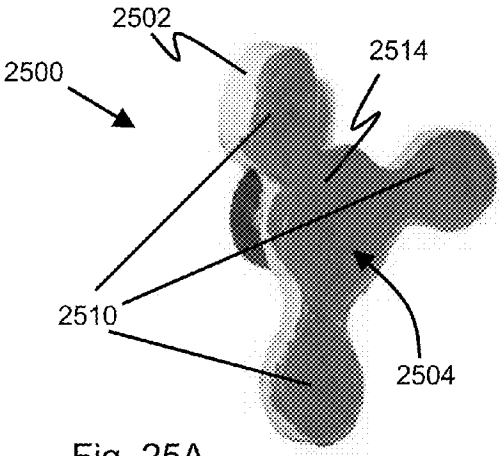
FIG. 25A depicts a front perspective view of a light bulb changing tool.
Figure 25C:
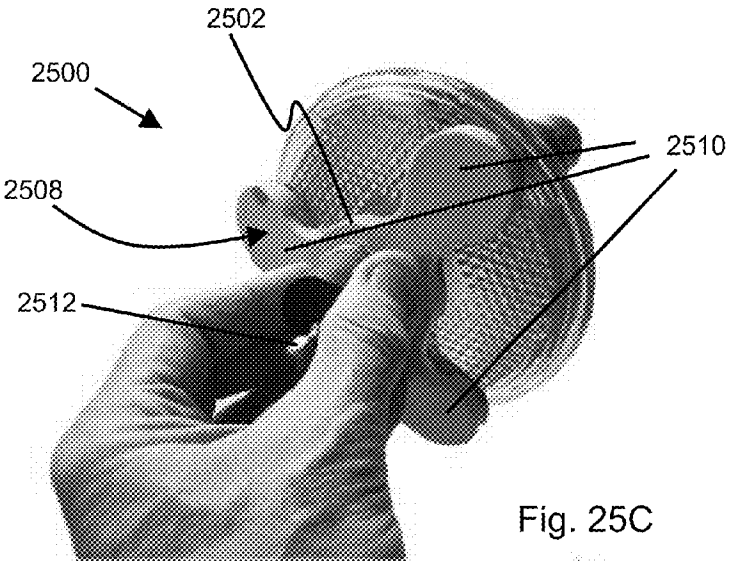
FIG. 25C depicts a back perspective view of a light bulb changing tool.

The light bulb changer with rotary head 1342 may include a light bulb changing tool that is described in greater detail herein with references to FIGS. 25A, 25B, and 25C and elsewhere.

In an embodiment, finishing and painting modules 1312 may be used with the power base 1302 to provide a finishing and painting power tool system. The finishing and painting modules 1312 may be a powered paint roller with remote paint supply 1354, paint sprayer, optionally with paint cup 1358, paint can sprayer 1360, two-drum wall sander 1362, orbital ¼ sheet sander 1364, floor sander, and the like. The functions and settings for each functional module may be modified by a user setting, a control facility 168, and the like. For example, the orbital sheet sander may be adjusted to accept any grit of sandpaper, the paint sprayer may be adjusted for different formulations of paint, and the like.

Figure 41:
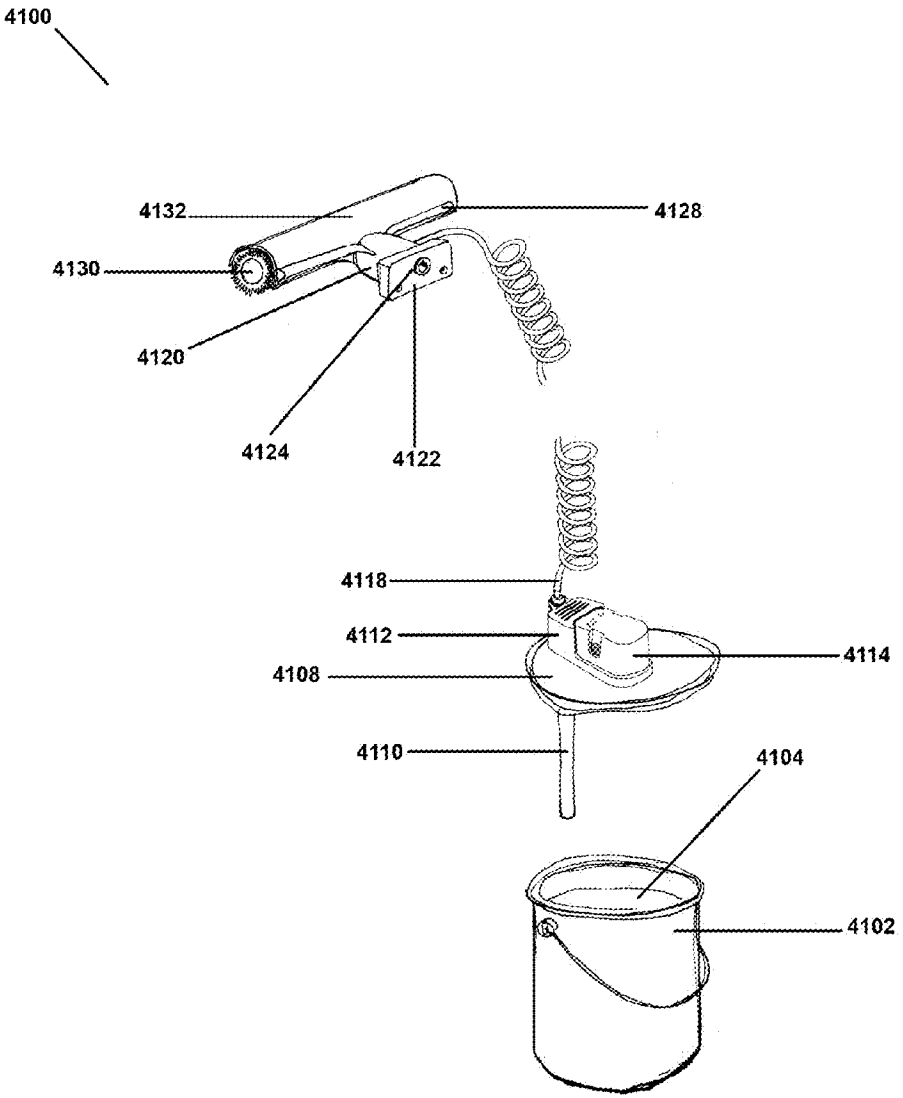
FIG. 41 depicts a paint roller tool attachment.

Referring now to FIG. 41, the Painting Roller tool attachment 4100 to the power tool system may provide the user the ability to apply paint with a standard roller at a height, such as up to twenty feet, which may be advantageous as it will keep someone from a dangerous position on the top of a ladder. The Painting Roller attachment may provide a complete system for applying paint from a paint can and may comprise three basic modules: the pump assembly 4108, hose 4118 and painting roller head 4132 that attaches to the power head of the power tool system. The Painting Roller tool may utilize a pump assembly 4108 that engages the lid attachment recess of a paint can 4102. The pump assembly 4108 utilizes a siphon tube 4110 that extends below the lid attachment to take paint 4104 from the lowest point of the paint can so it will work until the paint is exhausted. The pump 4112 itself may be electric or operate from a battery or rechargeable battery 4114, or any power means. The pump 4112 may utilize the battery of many standard rechargeable tools. The pump 4112 is self-priming and will push the paint up the paint delivery tube 4118 that coils on or beside the pole system of the power tool system. The Painting Roller tool attachment may connect to the power head of the power tool system by a connection plate 4122 that registers and couples the power output shaft of the power head to the input drive shaft 4124 of the Painting Roller tool attachment. The body 4120 of the Painting Roller tool attachment may have a connection for the paint delivery tube 4118 and a distribution manifold 4128 that distributes paint evenly along the length of the roller 4130. The removable roller 4130 may have a paint spray shield 4132 that protects the user and environment from splatter as the paint 4104 is applied.

Figure 42:
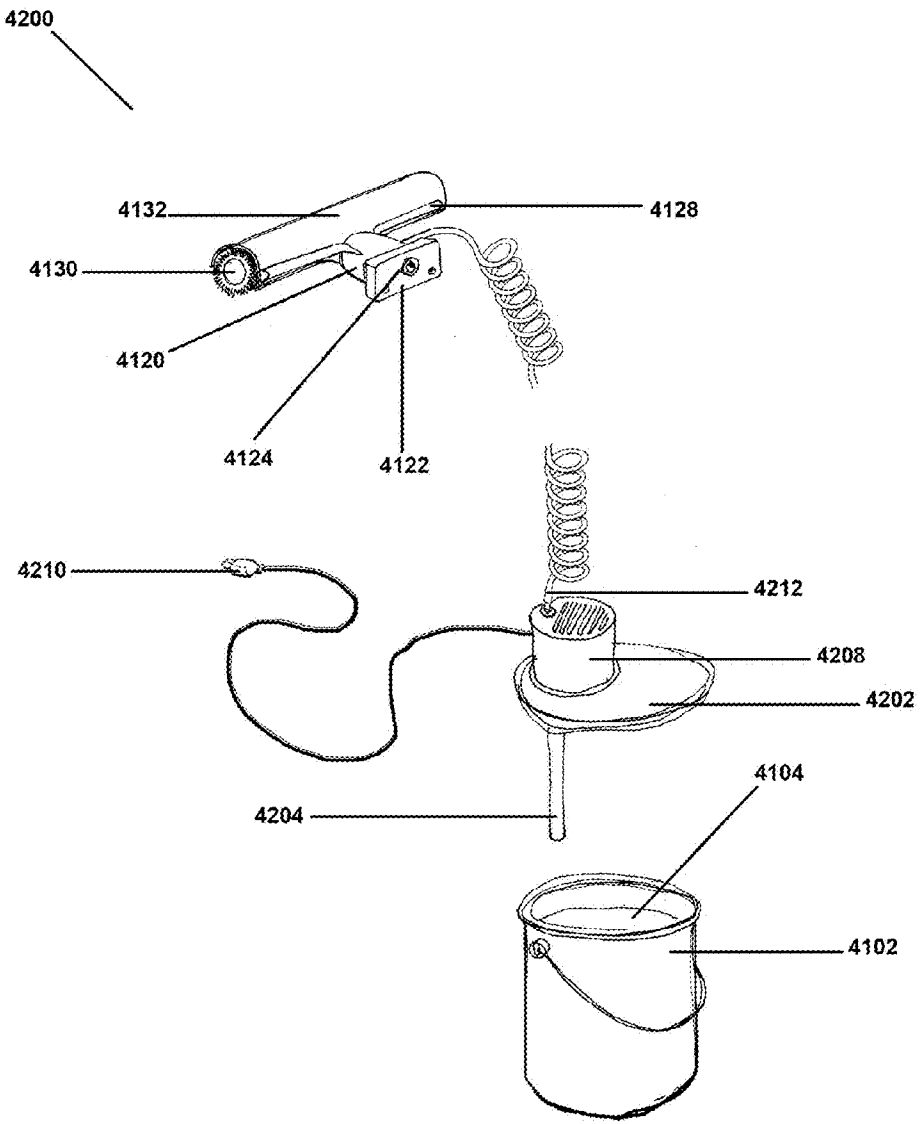
FIG. 42 depicts the components of a paint roller tool attachment.

Referring now to FIG. 42, the Painting Roller tool utilizes a pump assembly 4202 that engages precisely into the lid attachment recess of a standard paint can 4102. The pump assembly 4202 may utilize a siphon tube 4204 that extends below the lid attachment to take paint 4104 from the lowest point of the paint can so it will work until the paint is exhausted. The pump 4208 itself may be electric and operate from standard 110 VAC line current with a standard plug and electric cable. The pump 4208 may be self-priming and will push the paint up the paint delivery tube 4212 that coils on or beside the pole system of the power tool system. The Painting Roller tool attachment may connect to the power head of the power tool system by a connection plate 4122 that registers and couples the power output shaft of the power head to the input drive shaft 4124 of the Painting Roller tool attachment. The body 4120 of the Painting Roller tool attachment may have a connection for the paint delivery tube 4212 and a distribution manifold 4128 that distributes paint evenly along the length of the roller 4130. The removable roller 4130 may have a paint spray shield 4132 that protects the user and environment from splatter as the paint 4104 is applied.

Figure 43:
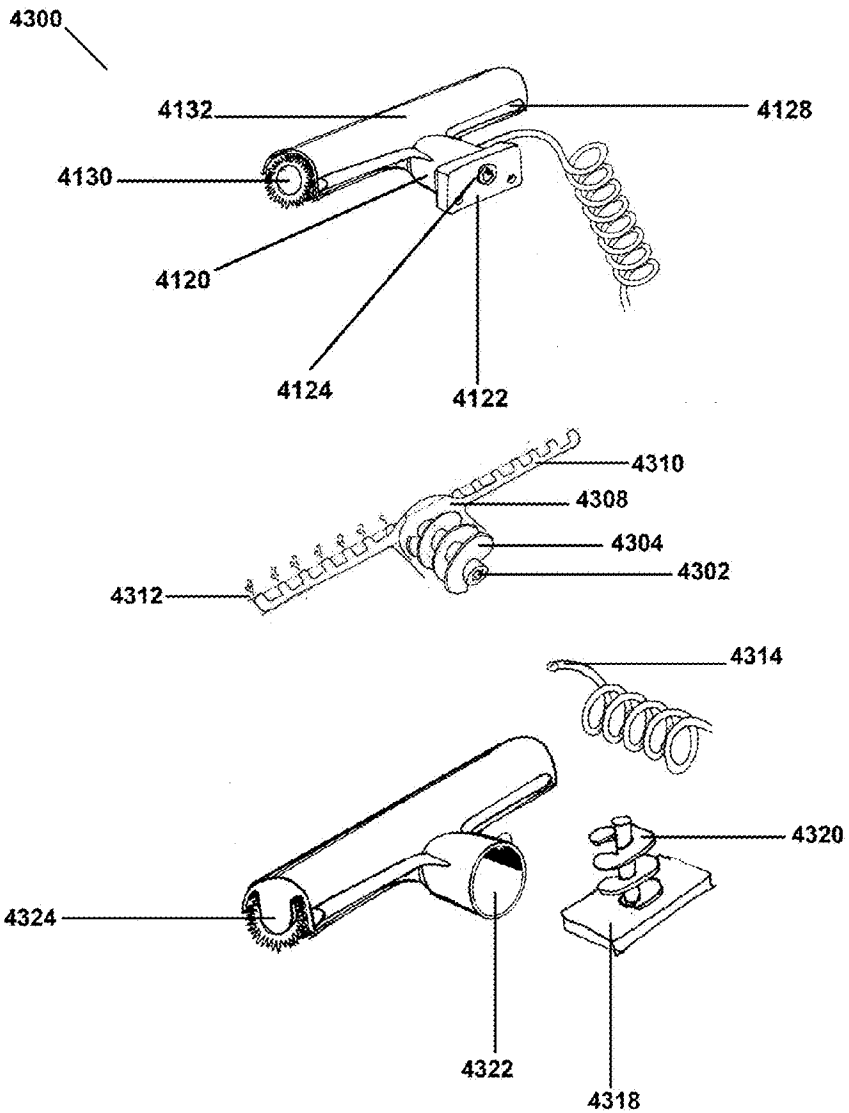
FIG. 43 depicts the components of a paint roller tool attachment.

Referring now to FIG. 43, the Painting Roller tool attachment 4300 to the power tool system may provide the user the ability to apply paint with a standard roller at a height, such as up to twenty feet, which may be advantageous as it will keep someone from the dangerous position on the top of a ladder. The Painting Roller tool attachment connects to the power head of the power tool system by a connection plate 4122 that registers and couples the power output shaft of the power head to the input drive shaft 4124 of the Painting Roller tool attachment. The body 4120 of the Painting Roller tool attachment has a connection for the paint delivery tube and a distribution manifold 4128 that distributes paint evenly along the length of the roller 4130. The removable roller 4130 may have a paint spray shield 4132 that protects the user and environment from splatter as the paint is applied. Internally to the body of the Painting Roller tool attachment there may be a power coupling 4302 that engages the power output shaft of the power head. This shaft is coupled to a pressure pump 4304 that increases the pressure of the paint within the manifold supply housing 4308 and ensures that the pressure in the paint distribution manifold 4310 is sufficient to evenly distribute the paint 4312 along the length of the removable paint roller. When the painting task is complete, the Painting Roller tool attachment may disassemble for easy cleaning. The paint delivery hose 4314 may be removable for flushing and the connection plate 4318 with the pump assembly 4320 may disengage from the body permitting easy cleaning and access to the manifold supply housing 4322 which may be flushed. The paint roller 4324 may be removable for cleaning or single-use disposal.

In an embodiment, inspection modules 1314 may be used with the power base 1302 to provide an inspection power tool system. The inspection modules 1314 may be a digital wireless video/still camera with remote viewing screen 1368, remote viewing screen 1370, infrared thermal imager 1372, moisture detector 1374, mold detector, radon detector, and the like. The functions and settings for each functional module may be modified by a user setting, a control facility 168, and the like. For example, the camera may be adjusted for any kind of lighting, the mold detector may be adjusted to any sensitivity range, and the like.

In an embodiment, landscape/garden modules 1318 may be used with the power base 1302 to provide a landscape/garden power tool system. The landscape/garden modules 1318 may be a pruning shear 1378, aerosol spray can actuator 1380, remote actuated hose nozzle 1382, remote actuated watering can 1384, fruit picker 1388, a weed whacker, an edger, a broadcast spreader, a leaf blower, a snow remover, a mulcher, a composter, a trimmer, an aerator, a reel mower, a reciprocating scythe, a rake, a rotary blade mower, and the like. The functions and settings for each functional module may be modified by a user setting, a control facility 168, and the like. For example, the fruit picker may be adjusted to pick any kind of fruit, the hose nozzle may be adjusted for any pattern of spray, the rotary blade mower may be adjusted to any cutting height, the broadcast spreader may be adjusted to any rate of feed, and the like.

The aerosol spray can actuator 1380 may operate to discharge an aerosol spray can. The aerosol spray can actuator 1380 may be adapted to receive input power in the form of an the input torque from a power head and to convert the input power into a pressure that is applied to the pressure valve of the aerosol spray can. Generally, the aerosol spray can actuator 1380 may be adapted to receive any and all input power, such as and without limitation electrical power, and to convert the input power into pressure that is applied to the pressure valve of the aerosol spray can. Embodiments of the aerosol spray can actuator 1380 may include an adjustable friction clutch for converting the input torque into pressure, a solenoid for converting electrical input power into pressure, or any and all other devices for converting the input power into the pressure. In any case, the pressure may actuate the pressure valve of the aerosol spray can, causing the aerosol spray can to discharge. It will be understood that various embodiments of the aerosol spray can actuator 1380 are possible.

Figure 36:
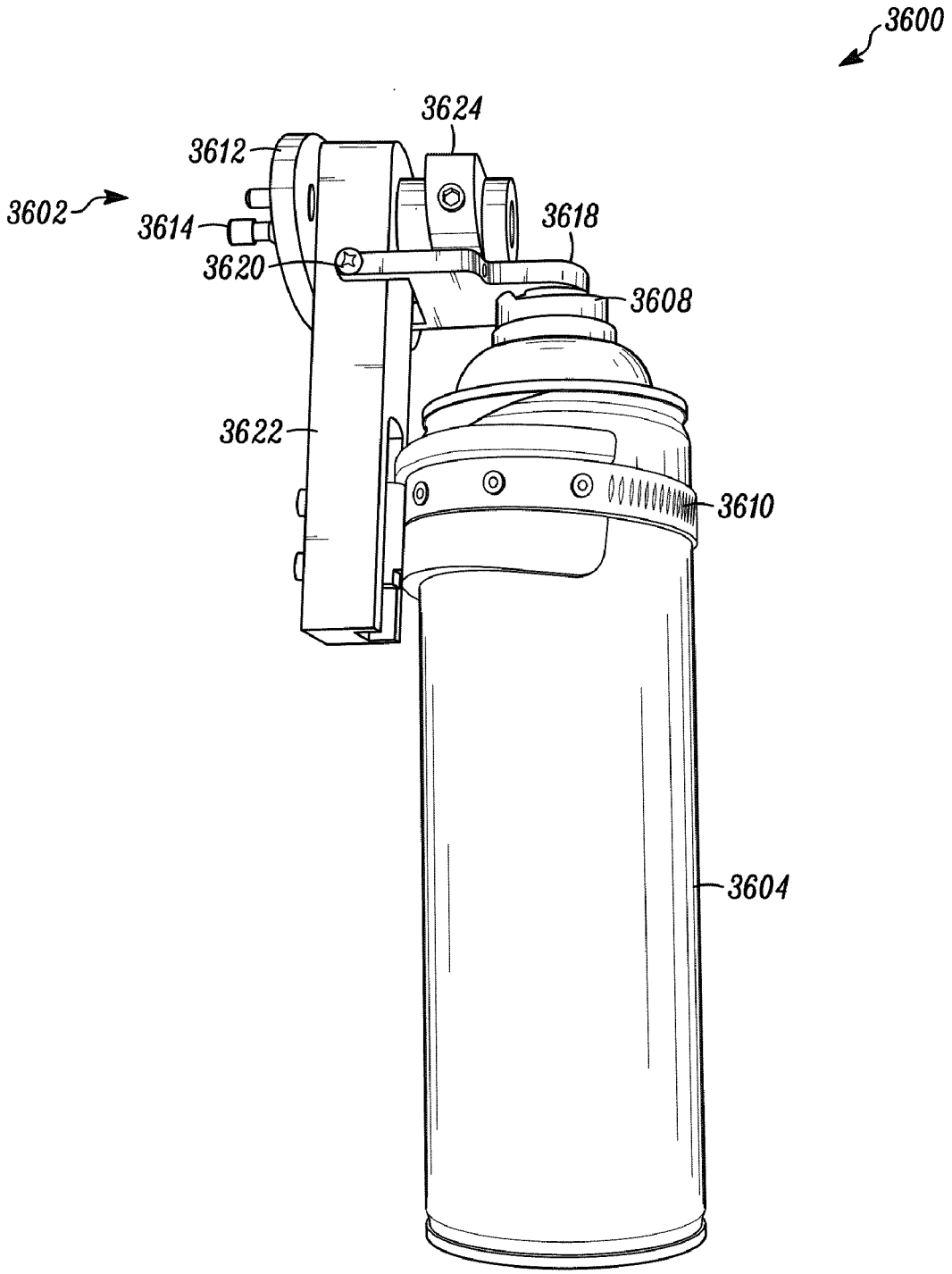
FIG. 36 depicts a spray can actuating functional module.

Referring now to FIG. 36, the Aerosol Spray tool attachment 3600 to the power tool system provides the user the ability to activate spray cans at a distance, such as up to twenty feet, which may be advantageous, such as if one is trying to spray insecticide on a wasp nest and is not forced to do it in close proximity on the top of a ladder. The tool may also be useful for spraying paint cans, lubricants, insecticides, herbicides, and many other products packaged in aerosol containers where proximity may be hazardous or noxious. The power stick Aerosol Spray attachment may be a compact product 3602 that attaches to an aerosol can 3604 and facilitates remote actuation of the spray nozzle 3608. The Aerosol Spray attachment connects the aerosol can by means of a band clamp 3610 or any other clamping method that will firmly grip the diameter of the can such as a C-clamp, clamshell clamp, closed ring, sticky foam or viscoelastic polymer band, magnetic band, or the like, holding the aerosol can firmly to the body 3622 of the device. The Aerosol Spray tool attachment may connect to the power head of the power stick by a connection plate 3612 that registers and couples the power output shaft of the power head to the input drive shaft 3614 of the Aerosol Spray tool attachment. Activation of the aerosol can spray nozzle may be accomplished by depressing the nozzle plate 3618 against the aerosol can nozzle 3608 as it hinges from a connection point 3620 on the body 3622 of the device. The activation force may be provided by several methods including a friction cam 3624 that is activated by the rotational force applied by the input drive shaft 3614, driving the nozzle plate downward when torque is applied by activation of the power head motor by the user and depressing the aerosol nozzle thus dispensing the spray can contents.

Figure 37:
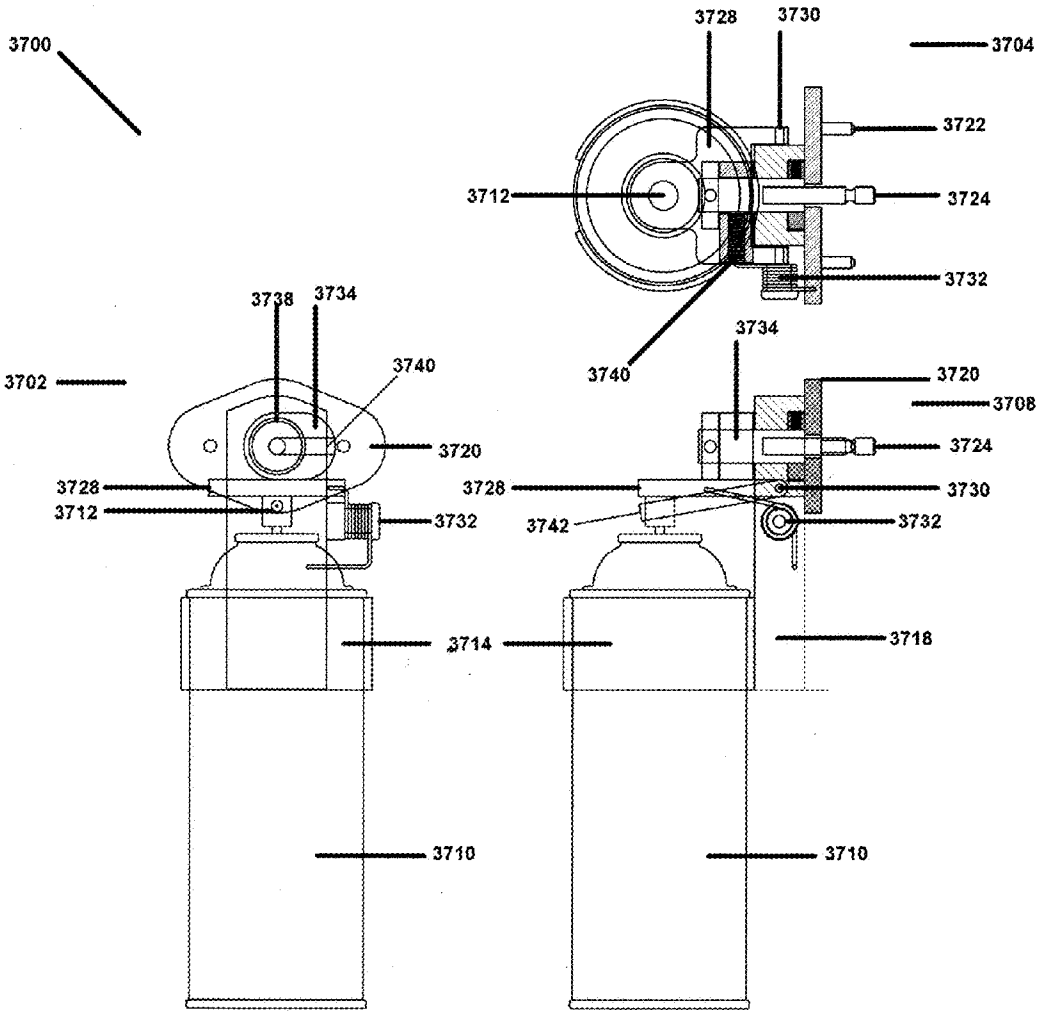
FIG. 37 depicts a front, side, and top view of the components of a spray can actuating functional module.

Referring now to FIG. 37, the power stick Aerosol Spray attachment is a compact product 3700 that is shown in this engineering diagram in three views, the front view 3702, the side view 3708 and the top view 3704. The Aerosol Spray tool attachment attaches to an aerosol can 3710 and facilitates remote actuation of the spray nozzle 3712. The Aerosol Spray attachment connects the aerosol can by means of a band clamp 3714 or any other clamping method that will firmly grip the diameter of the can such as a C-clamp, clamshell clamp, closed ring, sticky foam or viscoelastic polymer band, magnetic band, or many others, holding the aerosol can firmly to the body 3718 of the device. The Aerosol Spray tool attachment connects to the power head of the power stick by a connection plate 3720 that registers and couples the power output shaft of the power head to the input drive shaft 3724 of the Aerosol Spray tool attachment. Activation of the aerosol can spray nozzle 3712 is accomplished by depressing the nozzle plate 3728 against the aerosol can nozzle 3712 as it hinges from a connection point 3730 on the body 3718 of the device. The nozzle plate is held in the open position by a spring, illustrated here as a torsion spring 3732 but which can be of any sort including mechanical, pneumatic, hydraulic, magnetic or other. The activation force can be provided by many mechanical, chemical and electrical methods including a friction cam 3734 that is activated by the rotational force applied by the input drive shaft 3724. The friction cam 3734 may be adjusted to provide enough torque to drive the cam downward onto the nozzle plate 3728, that force being enough to depress the aerosol can spray nozzle but when that nozzle reaches the stop point, the input shaft will rotate freely inside the cam with the limiting torque being adjustable by a friction collar 3738 and a friction collar adjusting screw 3740 so that the correct balance is obtained. The nozzle plate 3728 is driven downward 3742 by the torque of the friction cam 3734 generated by the power head motor when the user switches power to the power head and depresses the aerosol nozzle 3712 thus dispensing the medium.

Figure 38:
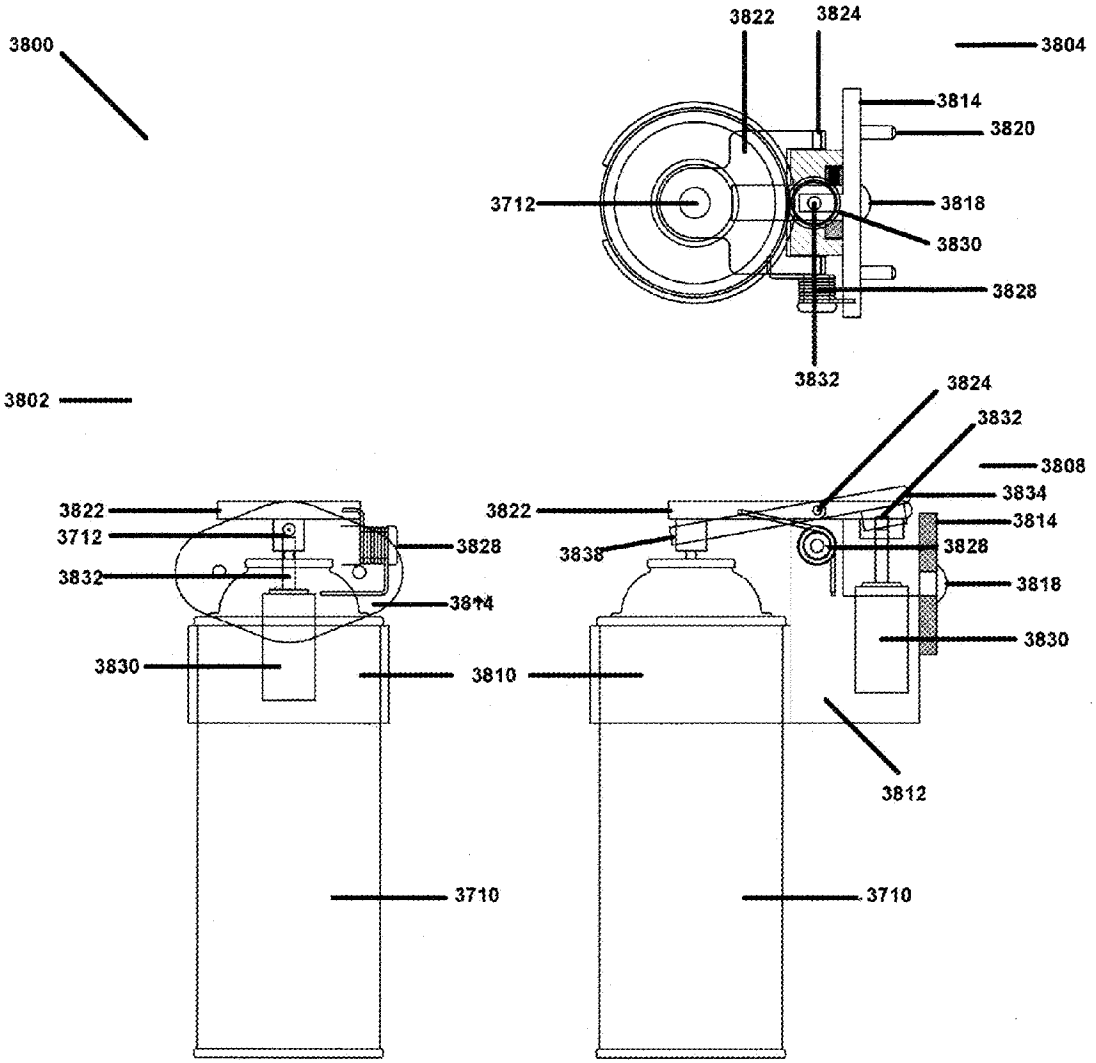
FIG. 38 depicts the components of a spray can actuating functional module.

Referring now to FIG. 38, the power stick Aerosol Spray attachment is a compact product 3800 that is shown in this engineering diagram in three views, the front view 3802, the side view 3808 and the top view 3804. The Aerosol Spray tool attachment attaches to an aerosol can 3710 and facilitates remote actuation of the spray nozzle 3712. The Aerosol Spray attachment connects the aerosol can by means of a band clamp 3810 or any other clamping method that will firmly grip the diameter of the can such as a C-clamp, clamshell clamp, closed ring, sticky foam or viscoelastic polymer band, magnetic band, or many others, holding the aerosol can firmly to the body 3812 of the device. The Aerosol Spray tool attachment connects to the power head of the power stick by a connection plate 3814 that registers and couples the electrical contact of the power head to the electrical contact 3818 of the Aerosol Spray tool attachment. Activation of the aerosol can spray nozzle 3712 is accomplished by depressing the nozzle plate 3822 against the aerosol can nozzle 3712 as it hinges from a connection point 3824 on the body 3812 of the device. The nozzle plate may be held in the open position by a spring, illustrated here as a torsion spring 3828 but which can be of any sort including mechanical, pneumatic, hydraulic, magnetic or other. The activation force may be provided by many mechanical, chemical and electrical methods including a short-stroke power out solenoid 3830 that is activated by electrical current applied by the power system of the power stick and conducted through the electrical contact 3818 to the solenoid 3830. The stroke of the solenoid rod 3832 on the back beam 3834 of the nozzle plate may be enough to drive the front beam 3838 of the nozzle plate 3822 downward onto the aerosol can spray nozzle 3712, that force being enough to depress the aerosol can spray nozzle but when that nozzle reaches the stop point, the stroke of the solenoid is at its end and residual energy is not enough to overwhelm the mechanical system. The nozzle plate 3822 is driven downward 3838 when the solenoid is energized by the electrical current flowing through the power head when the user switches the power ON and the aerosol nozzle 3712 thus dispenses the spray can contents.

Figure 14:
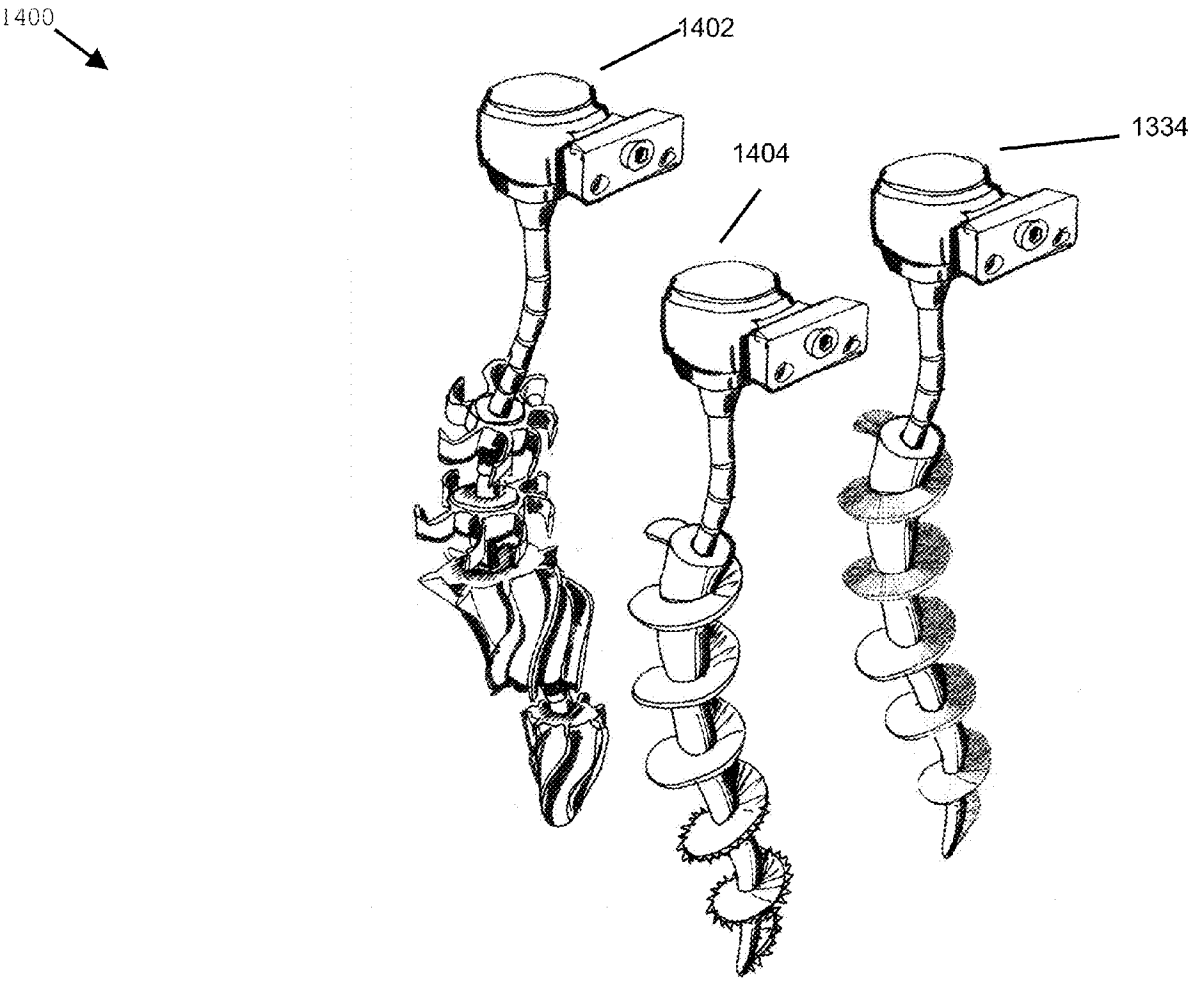
FIG. 14 depicts downspout cleaning tools.
Figure 15:
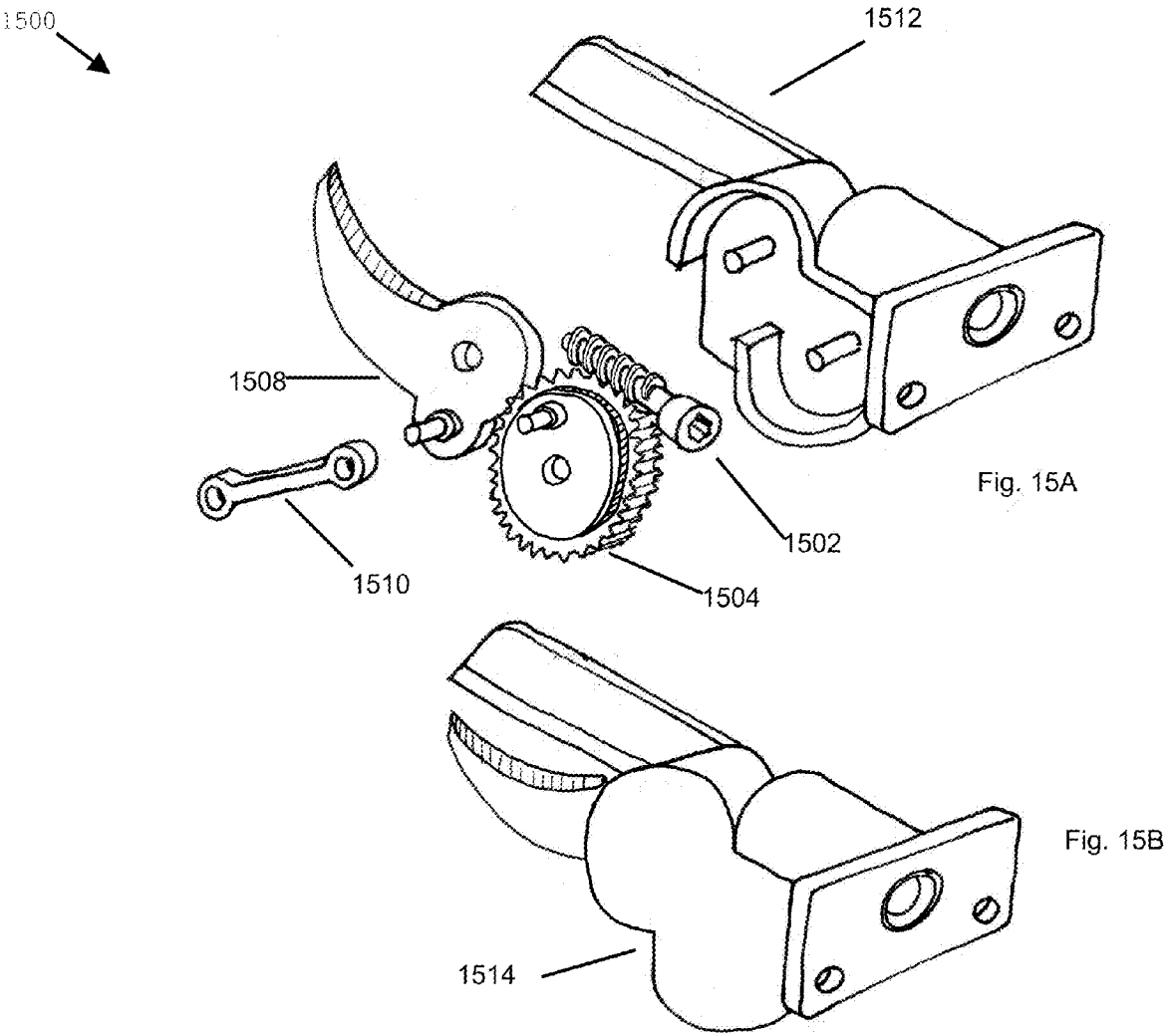
FIG. 15A depicts an exploded view of a pruning shear.
FIG. 15B depicts a perspective view of a pruning shear.

A user may deploy the multi-functional power tool system by mounting a device/functional module at a head of a power base. The power base may comprise a telescoping pole, a static pole, a control module, a handle, and the like. In embodiments, in order to operate the functional module at or near a desired location, a user may lift the functional module at an end of the power base to a desired location and initiate control of the module either before or after placing the module near the desired location. For example, referring to FIG. 14, downspout cleaning tools 1400 may be used with the power base 1302 to clear a downspout. In an embodiment, the downspout cleaning tool 1400 may be an auger brush 1334. The auger brush 1334 may be placed in a downspout and actuated to rotate and clean the downspout with the action of the rotating bristles. In an embodiment, the downspout cleaning tool 1400 may be an auger tool with impellers 1402. The impellers may be disposed along the auger for facilitating removal of debris from a gutter downspout. In an embodiment, the downspout cleaning tool 1400 may be an auger tool with teeth 1404 for chopping material in a downspout, such as large debris or ice. In any case, an auger element of the downspout cleaning tools 1400 may include a gear transfer coupling that provides gravity plumb orientation for the auger element. The gravity plumb orientation may enable the auger element to find its way into an opening of a downspout. In another example, referring to FIGS. 15A & 15B, a pruning shear 1378 may be used with a power base 1302 to prune foliage. In an embodiment, the drive from the power base may engage a worm screw 1502 to drive a worm gear 1504. The worm gear 1504 may connect to the pivoting pruning blade 1508 via a connecting rod 1510 to create a reciprocating motion of the pruning blade 1508 against the fixed blade 1512 and shear items disposed between the pruning blade 1508 and the fixed blade 1512. In embodiments, there may be a friction clutch 1514 between the worm gear 1504 and the plate to which the connecting rod 1510 attaches so that if an attempt is made to cut an oversized object, such as an oversized branch, the friction disc would spin so as to not burn out the motor or overload the geartrain.

Figure 16A:
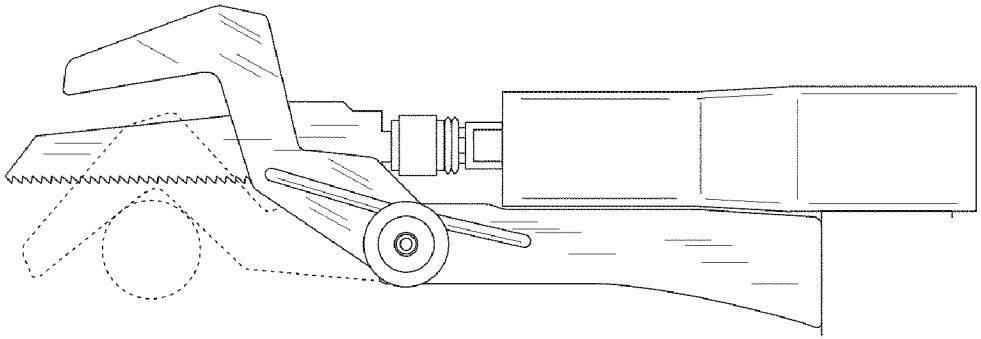
FIGS. 16A and B depict a reciprocating tree saw attachment.
Figure 16B:
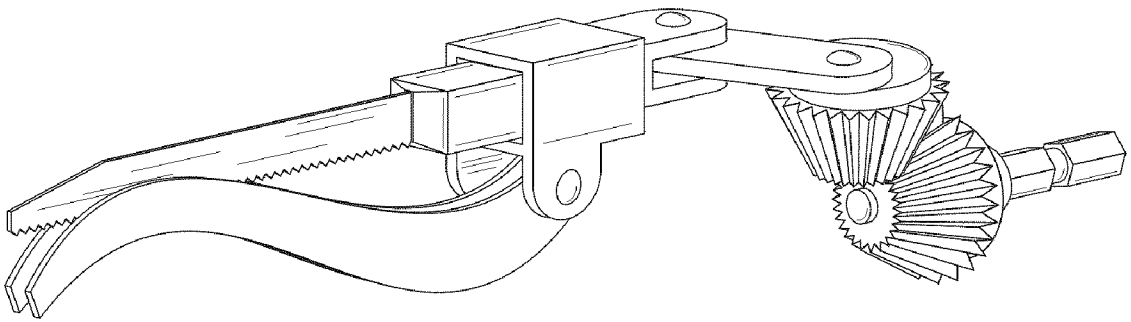
Figure 17:
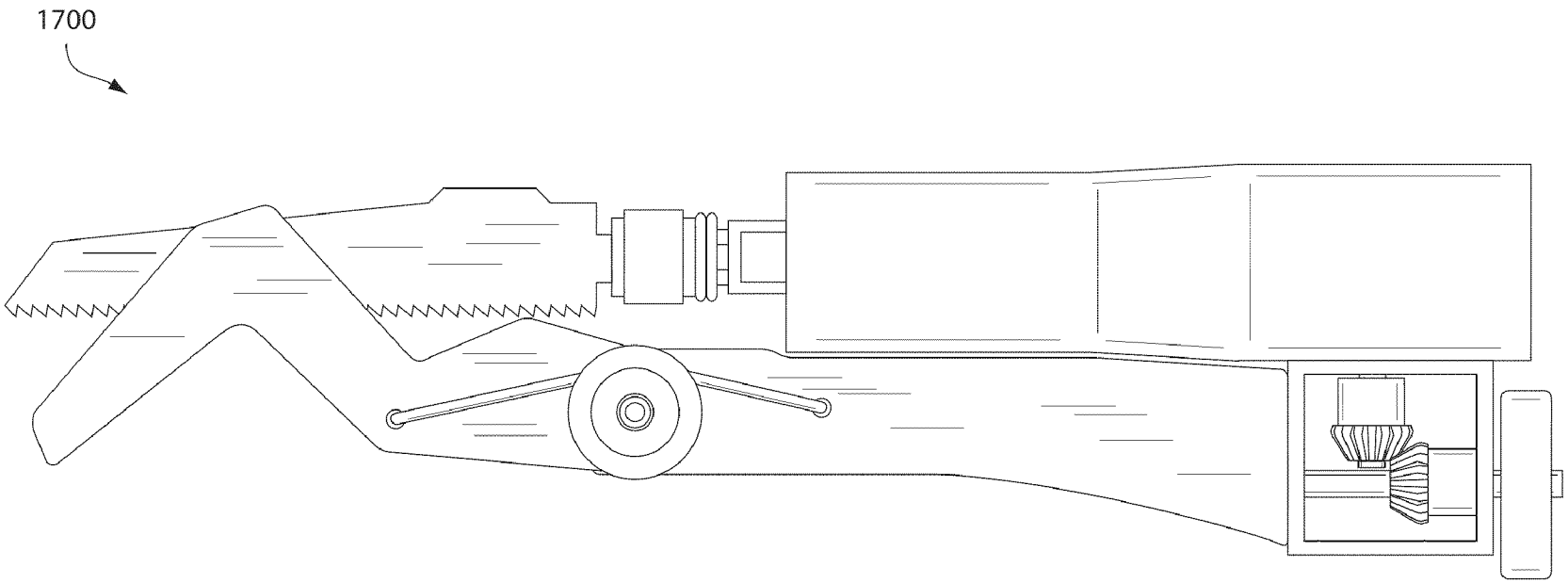
FIG. 17 depicts a reciprocating tree saw attachment with the grip guard closed.
Figure 18:
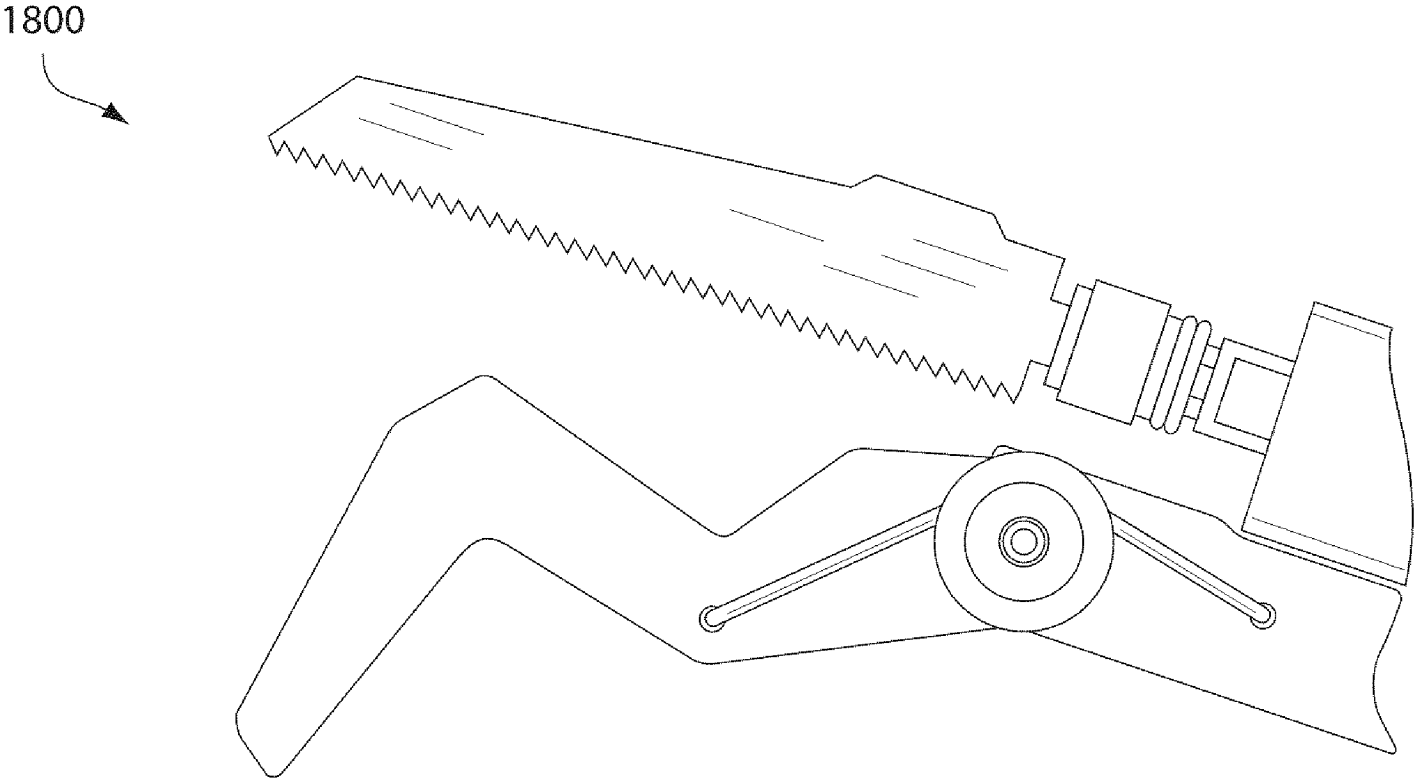
FIG. 18 depicts a reciprocating tree saw attachment with the grip guard closed.

Referring to FIGS. 16A and B through 18, embodiments of a reciprocating tree saw attachment for use with the power base are depicted with a gripping guard. The gripping guard may be spring loaded. The reciprocating tree saw may use a right angle drive and a reciprocating engine comprising a crankshaft and connecting rod driving a piston back and forth to provide reciprocating action to an attached blade. The blade may be attached with a quick release. In an alternative embodiment, the reciprocating saw may comprise a flywheel and pin with a cross slot in the piston to create the reciprocating motion in less space than with the connecting rod. The reciprocating saw may comprise a blade guard that may help position the saw when it is mounted to the power base. Referring to FIGS. 17 and 18, the spring loaded guard may clamp onto the branch and then the saw motion may be activated. In an alternative embodiment, referring to FIGS. 16A and B, the reciprocating saw may be spring loaded downward to provide a locating grip over the top of the branch and the user may work against the spring to saw through the branch.

Figure 44:
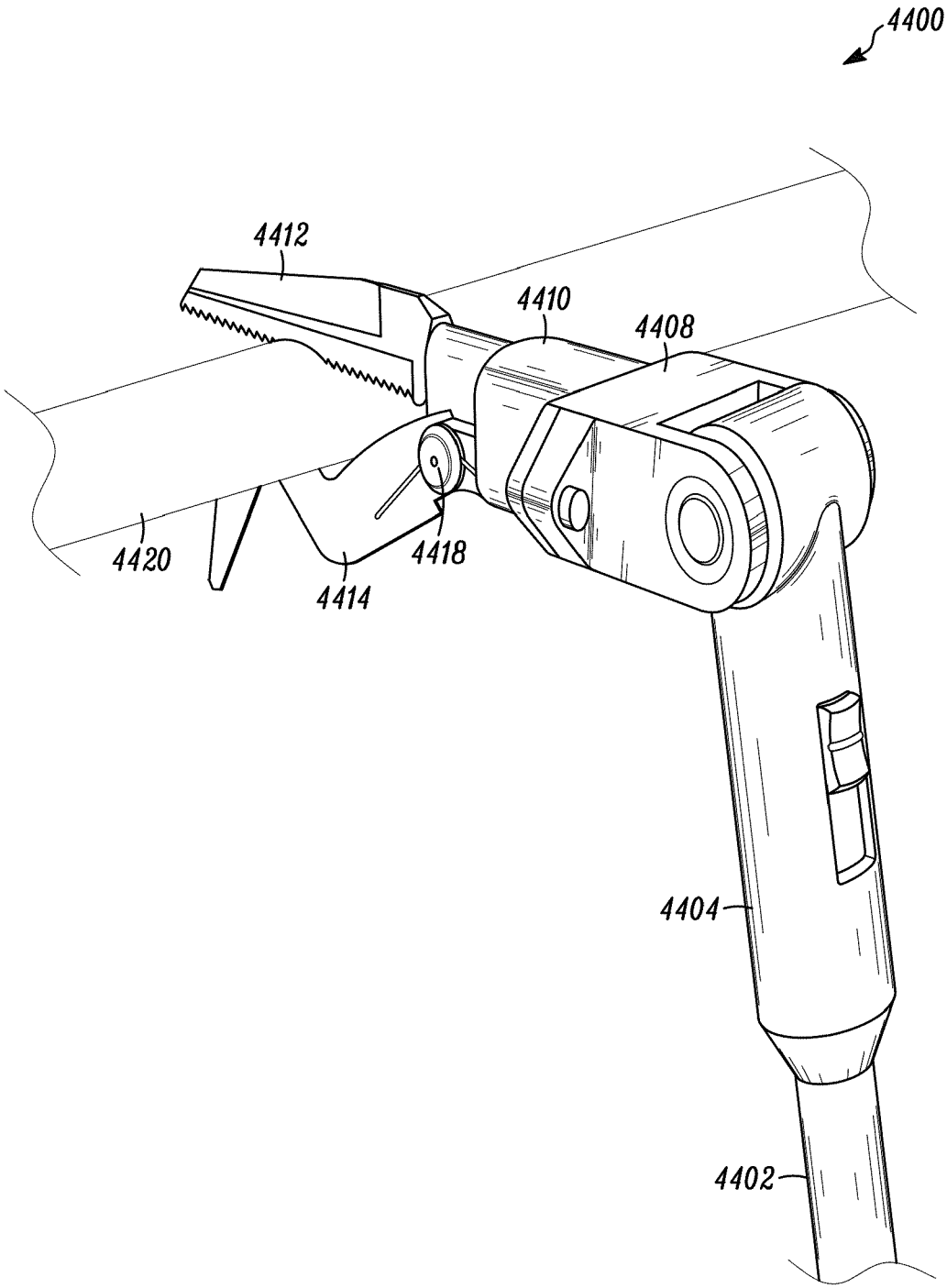
FIG. 44 depicts a tree saw tool in action.

Referring now to FIG. 44, the tree saw tool attachment 4400 to the power tool system may provide the user the ability to cut tree limbs at a distance, such as up to twenty feet, which may be advantageous as it may permit a wide range of pruning activities without the hazard of climbing a ladder to perform the cutting task. The power tool system tree saw tool attachment connects to the power head 4404 of the power tool system 4402 by a connection plate 4408 that registers and couples the power output shaft of the power head to the input drive shaft of the tree saw tool attachment. The body 4410 of the tree saw tool attachment may comprise a mechanism that converts the rotational input from the power head and converts it to reciprocating motion that drives the saw blade 4412. The saw blade 4412 may be protected by a hinged and spring-loaded 4418 blade guard 4414 that opens when forced against the tree branch 4420 and holds the blade in alignment as the cutting takes place, and may also relieve the weight of the power tool system on the user's arms during the duration of the cut.

Figure 45:
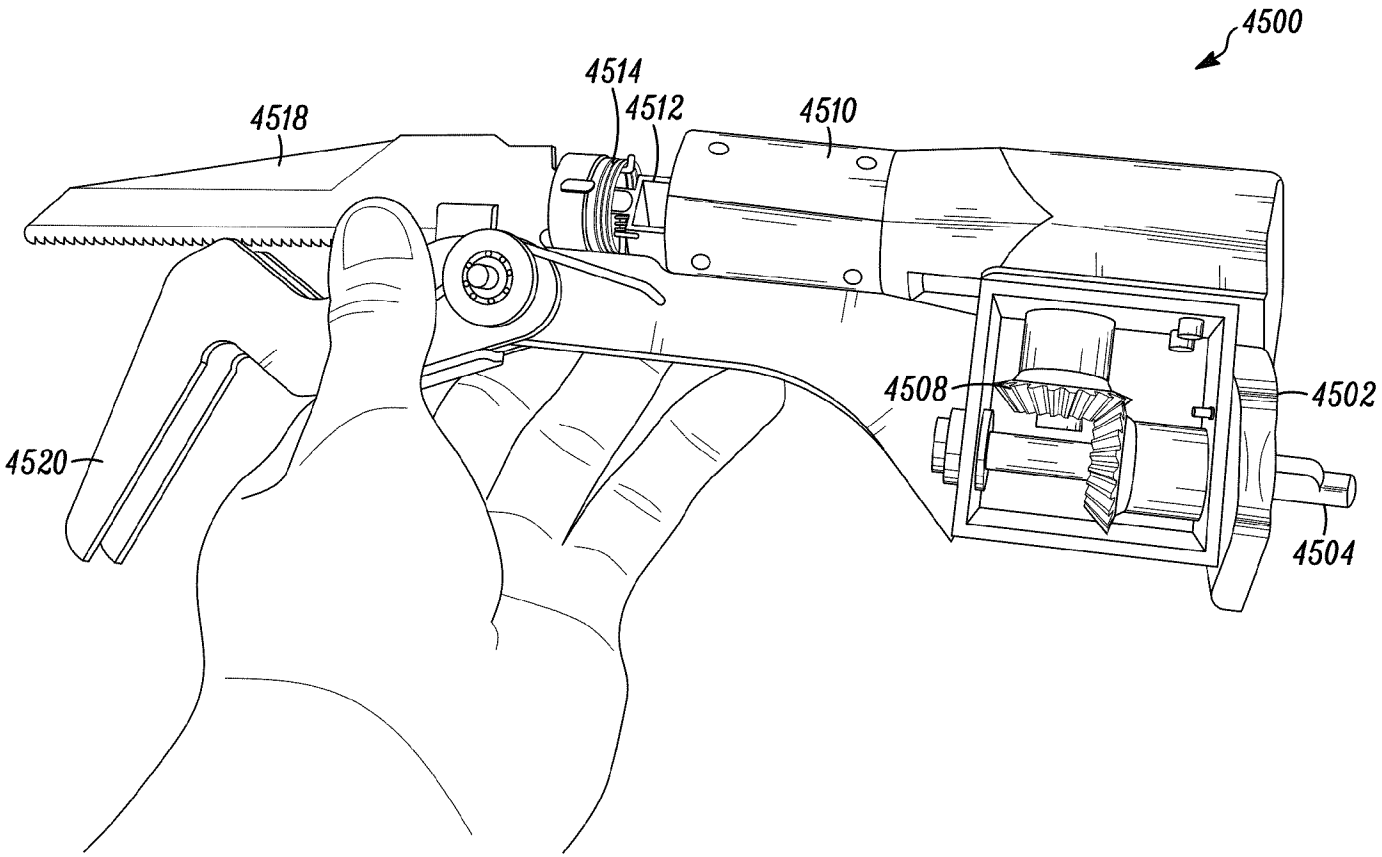
FIG. 45 depicts a side view of a tree saw tool

Referring now to FIG. 45, the tree saw tool attachment 4500 to the power tool system may provide the user the ability to cut tree limbs at a distance of up to twenty feet using the extensible pole system. The power tool system tree saw tool attachment connects to the power head of the power tool system by a connection plate 4502 that registers and couples the power output shaft of the power head to the input drive shaft 4504 of the tree saw tool attachment. The body 4510 of the tree saw tool attachment comprises a right angle drive gearbox 4508 and a mechanism that converts the rotational input from the power head and converts it to reciprocating motion that drives the releasable chuck 4514 that holds the saw blade 4518. The saw blade 4518 may be protected by a hinged and spring-loaded blade guard 4520 that opens when forced against the tree branch and holds the blade in alignment as the cutting takes place, and may also relieve the weight of the power tool system on the users arms during the duration of the cut.

Figure 46:
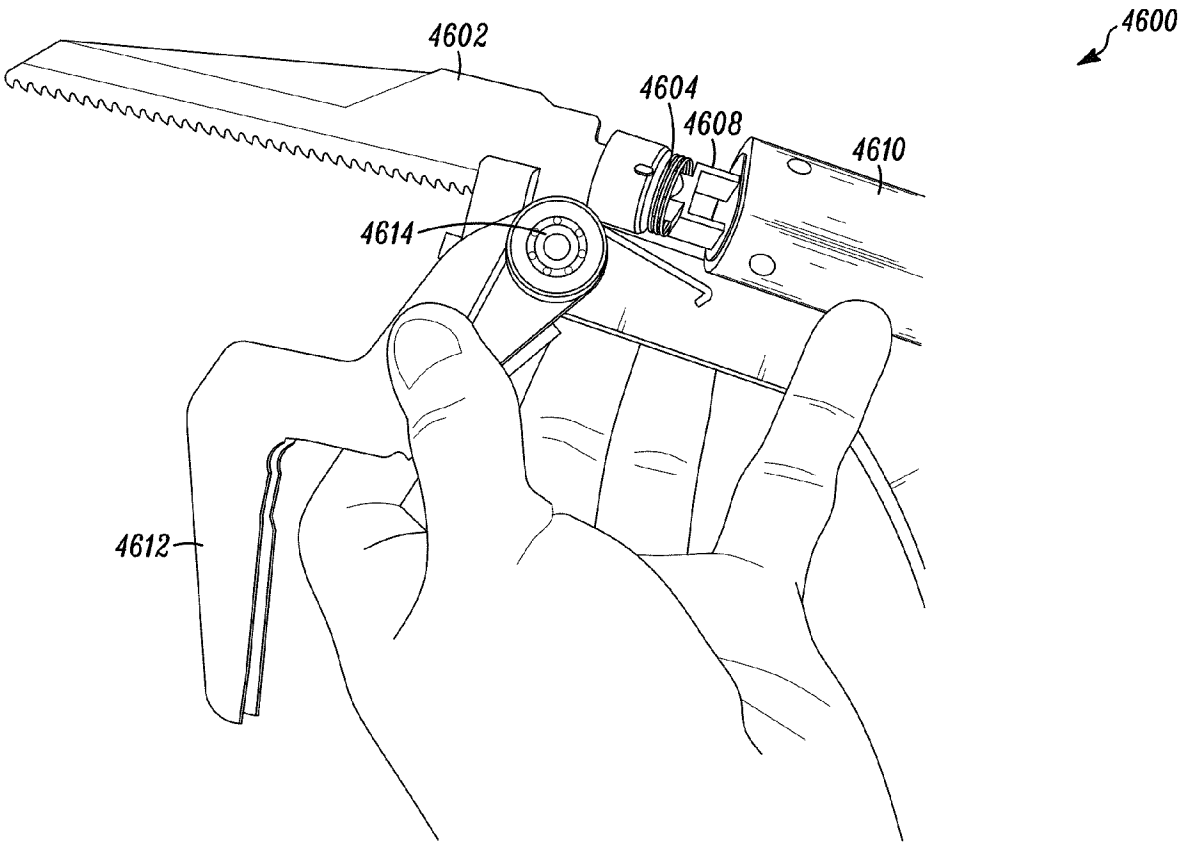
FIG. 46 depicts a side view of a tree saw tool

Referring now to FIG. 46, the tree saw tool attachment 4600 to the power tool system may provide the user the ability to cut tree limbs at a distance, such as up to twenty feet, using the extensible pole system. The body 4610 of the tree saw tool attachment contains a mechanism that converts the rotational input from the power head to reciprocating motion that drives a piston arm 4608 and at the end there is a releasable chuck 4604 that holds the saw blade 4602. The saw blade 4602 may be protected by a hinged and spring-loaded blade guard 4612 that opens when forced against the tree branch and holds the blade in alignment as the cutting takes place, and may also relieve the weight of the power tool system on the user's arms during the duration of the cut.

Figure 47:
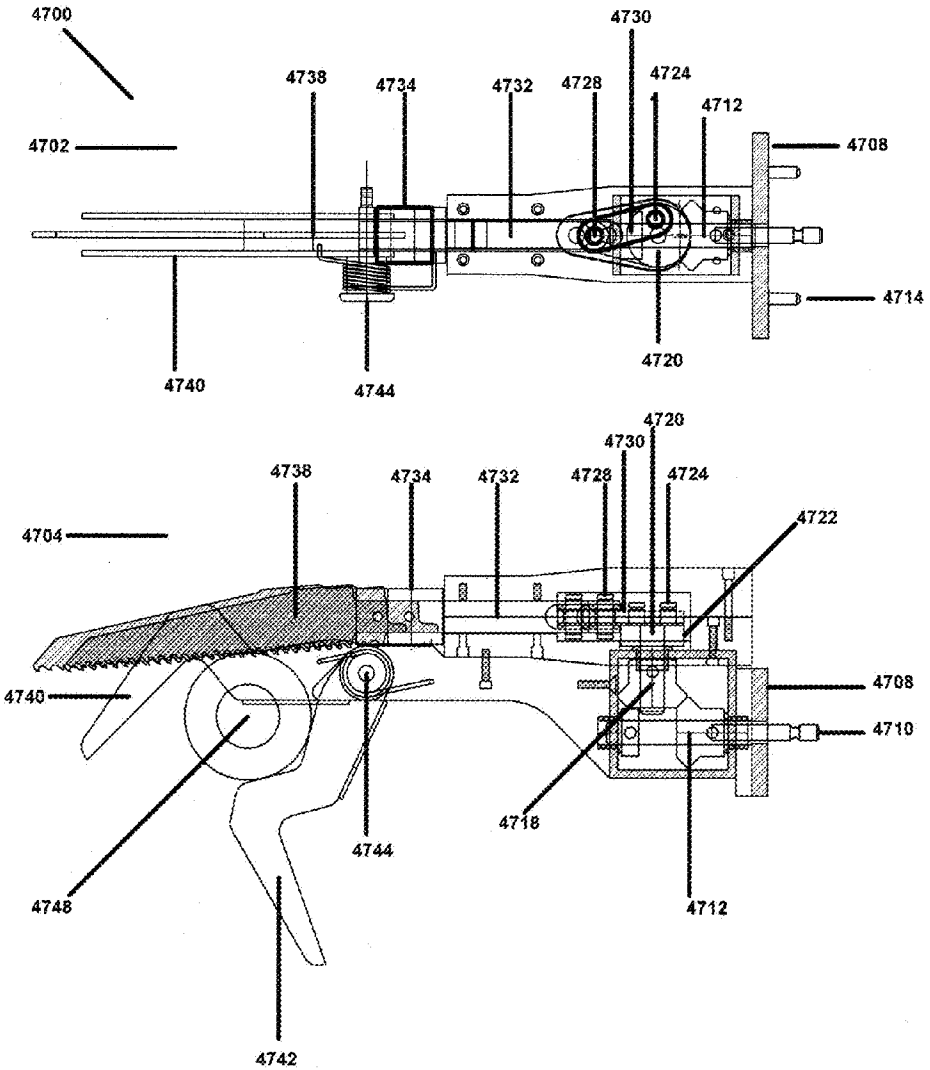
FIG. 47 depicts a top view and side view of the components of a tree saw attachment.

Referring to FIG. 47, the tree saw tool attachment 4700 to the power tool system may provide the user the ability to cut tree limbs at a distance, such as up to twenty feet, using the extensible pole system. The power tool system tree saw tool attachment may be a compact product 4700 that is shown in this engineering diagram in two views, the top view 4702 and the side view 4704. The power tool system tree saw tool attachment may connect to the power head of the power tool system by a connection plate 4708 that is registered 4714 to resolve the torque load and couples the power output shaft of the power head to the input drive shaft 4710 of the tree saw tool attachment. The input shaft may be connected to a right angle bevel gear 4712 that drives a similar mating bevel gear 4718 at ninety degrees on a vertical output shaft 4720. Affixed to the top of the output shaft may be a flywheel 4722 that has a crankpin attached at the outer perimeter 4724. There may be a connecting rod 4730 that pivots upon the crankpin that in turn is connected by another pivot connection to the end of the piston shaft 4732. As the flywheel 4722 rotates the connecting rod's 4730 pivot-attached end at the crankpin 4724 describes a circle, the diameter of which is the stroke of the piston rod 4732 pivot-attached at the other end. For every rotation of the flywheel, the piston rod 4732 may make one forward and one backward stroke. At the far end of the piston is a chuck 4734 that captures the end of the saw blade 4738. On either side of the saw blade may be a blade guard element 4740 both of which are combined together on a hinge pin to create a rigid element and that may be spring-loaded upward to the closed position to protect against impingement on the blade. In the closed position the front of the blade guard may have a mouth-like opening 4740 that when pushed against a cylindrical object 4748 such as a tree branch will force open the blade guard 4742 admitting the branch 4748 and capturing it between the guard and the saw blade thus ensuring a consistent cutting motion and contact between blade and tree.

Figure 48:
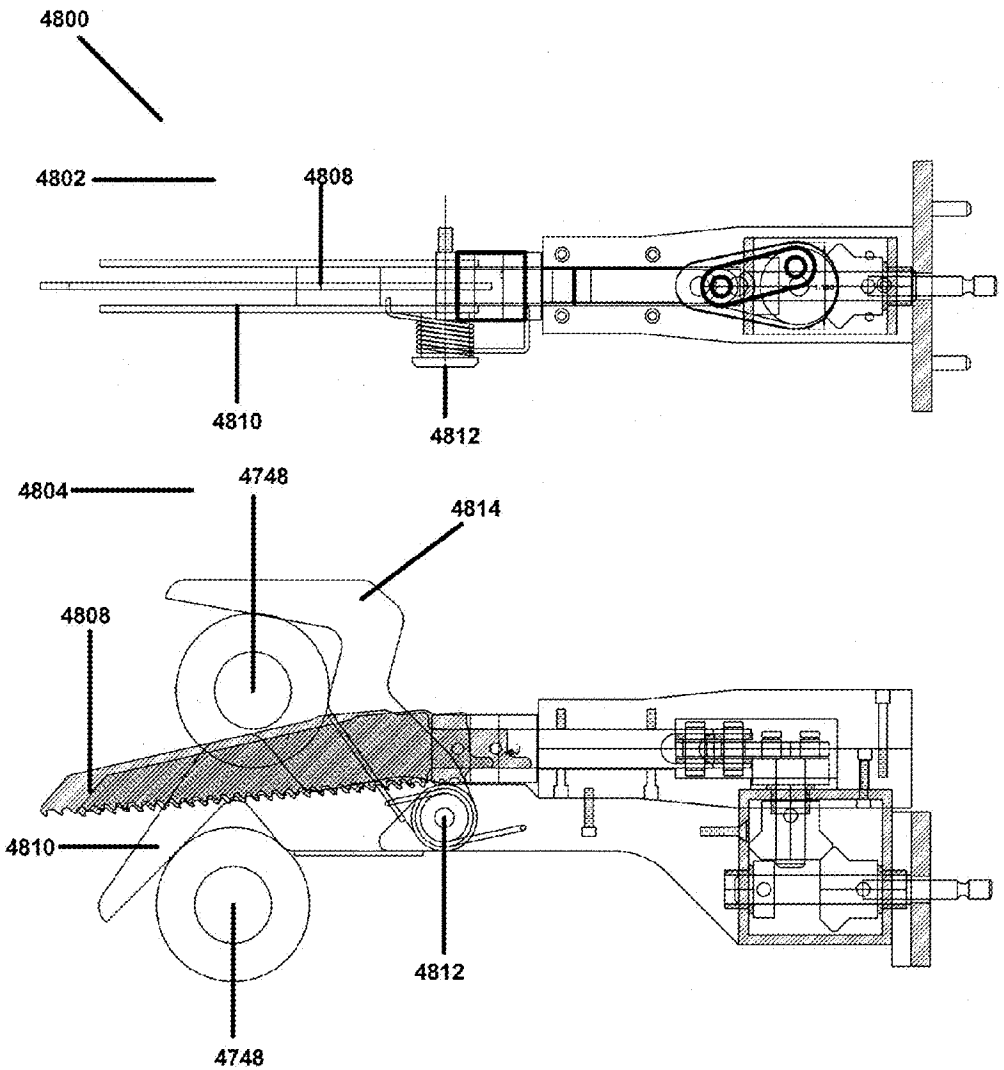
FIG. 48 depicts a top view and side view of the components of a tree saw attachment.

Referring now to FIG. 48, the tree saw tool attachment 4800 to the power tool system may provide the user the ability to cut tree limbs at a great distance using the extensible pole system. The power tool system tree saw tool attachment is shown in this engineering diagram in two views, the top view 4802 and the side view 4804. The saw blade 4808 may be driven by the reciprocating piston mechanism of the device. On either side of the saw blade may be a blade guard 4810 both of which are combined together on a hinge pin to create a rigid element and that may be spring-loaded 4812 downward to the closed position to protect against impingement on the blade. In the closed position the blade guard 4810 may form a hook that can be hooked over the tree branch 4748 thus supporting the weight of the power tool system head assembly at the end of the pole. As cutting commences, the weight of the head may follow the cut into the branch 4748 and the spring-loaded blade guard 4814 may move upward out of the way while the cut progresses although still supporting some of the weight of the head. When the cut is complete and the branch 4748 falls away, the blade guard 4810 may snap back into place to protect the saw blade 4808.

Figure 19B:
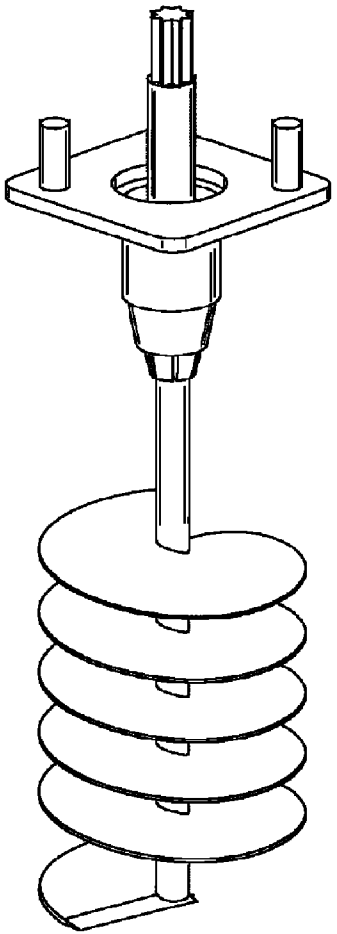
FIGS. 19A and B depict an auger attachment.
Figure 19A:
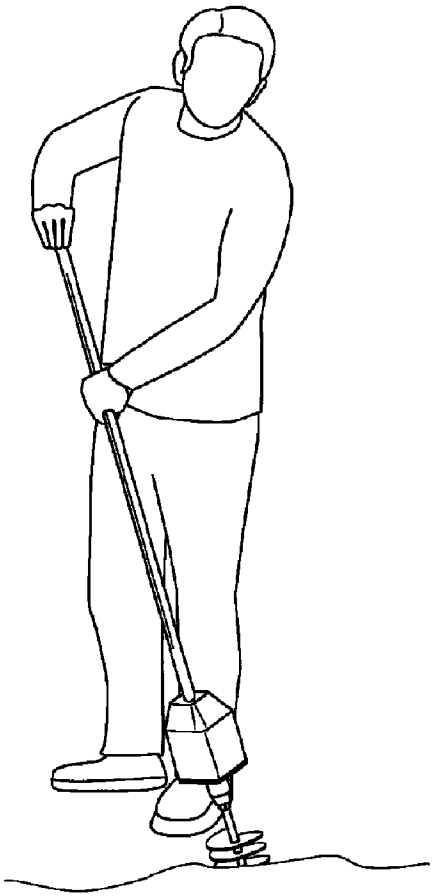

Referring to FIGS. 19A and B, an auger attachment for use with the power base is depicted. The auger attachment may be either a stand along auger attachment or an interchangeable auger bit for a drill attachment. The auger attachment may comprise a high torque gear head. The gear head may be geared to a very slow rpm. The auger attachment may be used for making holes in the earth, such as for bulb planting. Using the power base, the user may control the speed of rotation of the auger head.

Figure 20:
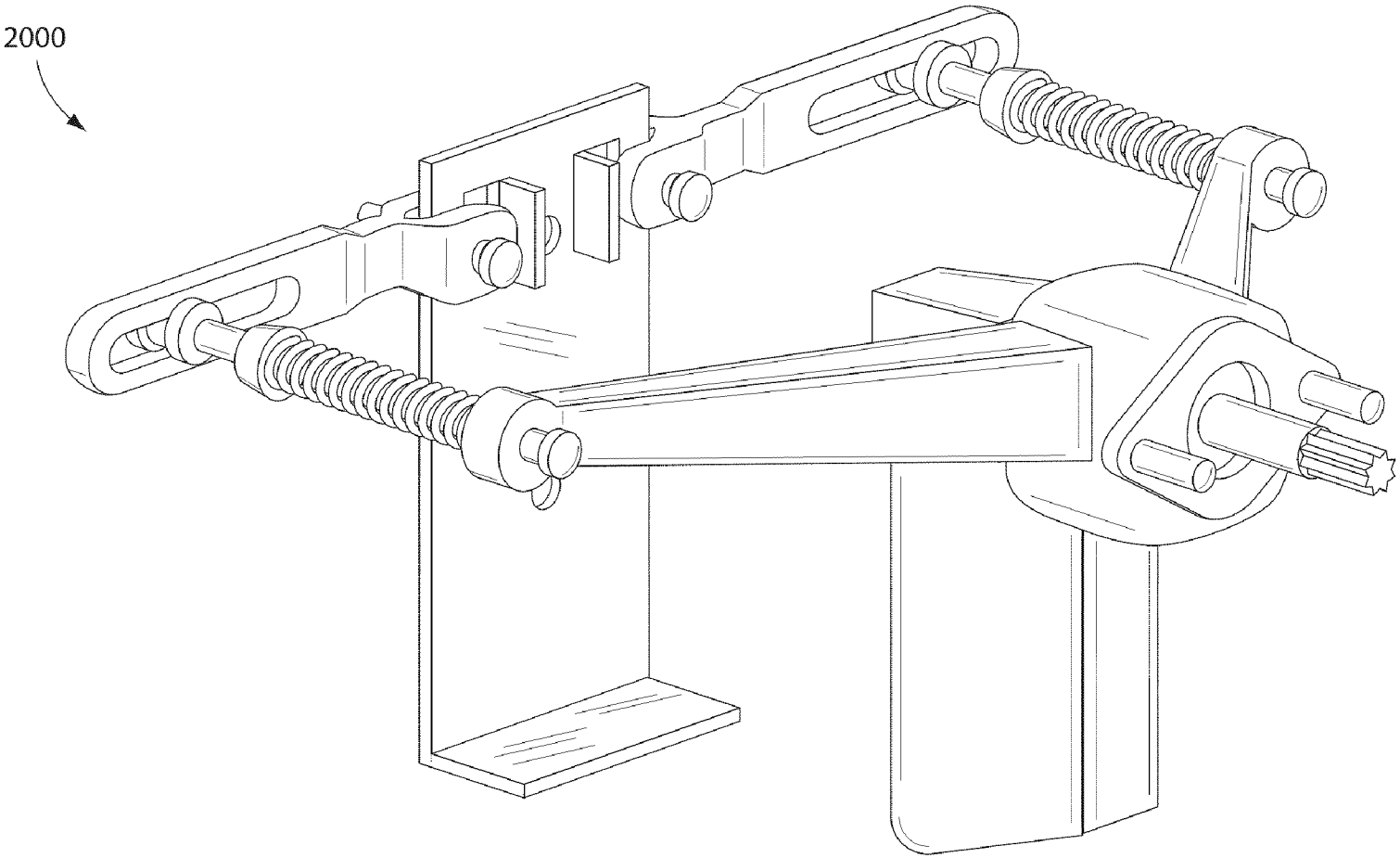
FIG. 20 depicts a clamping nailer/stapler attachment.

Referring to FIG. 20, a clamping nailer/stapler attachment for use with the power base is depicted. The clamping nailer/stapler attachment may utilize a spring loaded clamp system. The spring loaded clamp system may enable positioning of the item to be fastened in front of the nail/staple gate. The fastening engine may be pushed up and fired into a hole of the item. The clamp arms may be adjustable. The springs in the adjustable clamp arms may allow the nail head to move in and away from the work piece. The clamp arms may be attached to a workpiece or mounting plate of some sort.

Figure 21:
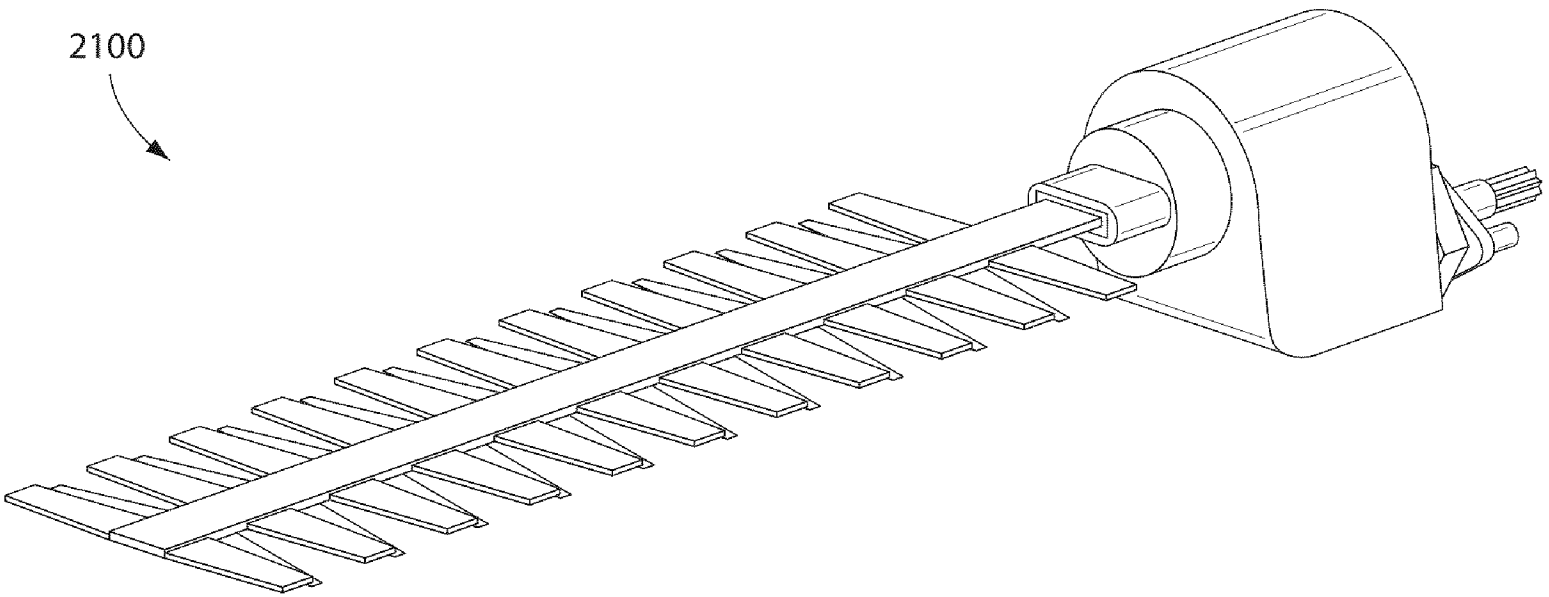
FIG. 21 depicts a sickle bar hedge trimmer attachment.

Referring to FIG. 21, a sickle bar hedge trimmer attachment for use with the power base is depicted. The hedge trimmer attachment uses a similar reciprocating engine to that of the tree saw attachment but it drives a sickle bar trimmer at the end of the power base or an extension pole for trimming high hedges or deep into the hedge that may normally be very hard to reach. In embodiments of the hedge trimmer attachment, the hedge trimmer may comprise a reciprocating gearbox, a speed reduction gearbox, a right angle drive, a reciprocating engine, and the like.

Figure 39:
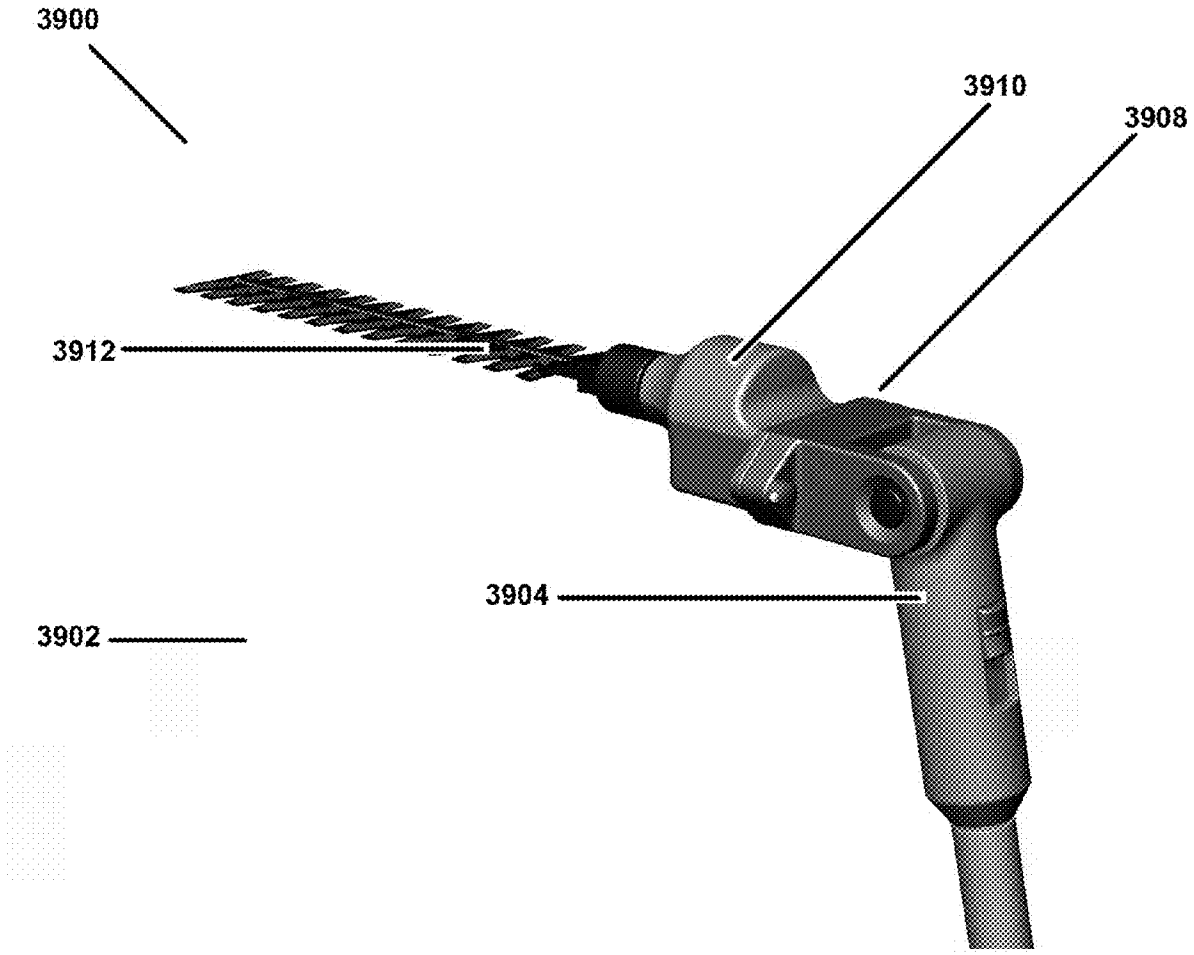
FIG. 39 depicts a hedge trimmer attachment.

Referring now to FIG. 39, the Hedge Trimmer tool attachment 3900 to the power stick tool system provides the user the ability to clip the small diameter branches of hedges and other small plants at a distance, such as up to twenty feet from the user, which may be advantageous as it may eliminate the need to use a ladder. The power stick Hedge Trimmer attachment operates to cut branches using a sickle bar knife design 3912, wherein one row of blades passes by another row of blades in close proximity to create a shearing motion between the knife edges. The Hedge Trimmer tool attachment connects to the power head 3904 of the power stick by a connection plate 3908 that registers and couples the power output shaft of the power head to the input drive shaft of the Hedge Trimmer tool attachment. Activation of the switch in the handle of the power stick provides electric current to the gearmotor in the power head 3904 which in turn drives the input shaft of the Hedge Trimmer tool attachment which drives a gearbox 3910 that creates reciprocating motion which activates the sickle bar mechanism 3912 of the Hedge Trimmer tool attachment.

Figure 40:
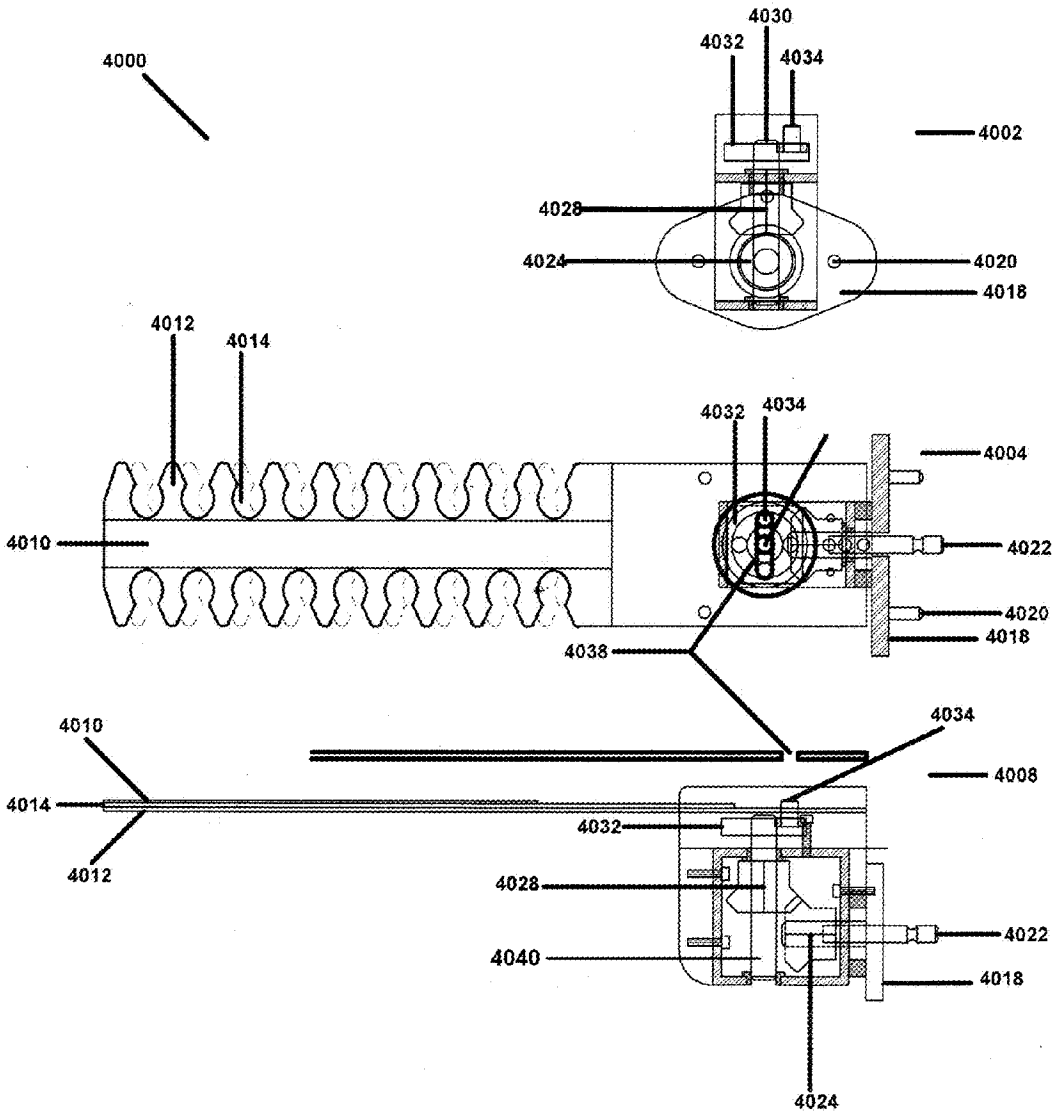
FIG. 40 depicts the components of a hedge trimmer attachment.

Referring now to FIG. 40, the Hedge Trimmer tool attachment 4000 to the power tool system provides the user the ability to clip the small diameter branches of hedges and other small plants at a distance of up to twenty feet from the user which is very advantageous as it eliminates the need to use of a ladder. The power stick Hedge Trimmer tool attachment is a compact product 4000 that is shown in this engineering diagram in three views, the end view 4002, the top view 4004 and the side view 4008. The power stick Hedge Trimmer attachment operates to cut small branches using a sickle bar knife design 4010 utilizing reciprocating motion, wherein one row of movable blades 4014 passes by another row of stationary blades 4012 in close proximity to create a shearing motion between the knife edges. The moving set of blades 4014 may be trapped between the stationary blade 4012 that forms the chassis of the sickle bar and a top frame 4010 that is attached with high precision to the stationary blade to permit the movable blade freedom to move on the longitudinal axis with very high precision. The Hedge Trimmer tool attachment connects to the power head 3904 of the power stick by a connection plate 4018 that registers 4020 and couples the power output shaft of the power head to the input drive shaft 4022 of the Hedge Trimmer tool attachment. Activation of the switch in the handle of the power tool system may provide electric current to the gear motor in the power head 3904 which in turn drives the input shaft 4022 on which is mounted a right angle bevel gear 4024 that engages a similar bevel gear 4028 at ninety degrees orientation so that this power shaft 4040 rotates at identical rpm in a vertical orientation relative to the long axis of the sickle bar cutter. Mounted to the top of this power shaft 4040 in the horizontal plane of the sickle bar cutter may be a flywheel 4032 with an eccentric crank pin 4034 that orbits the vertical axis of the power shaft at the same rpm as the power shaft. This crank pin 4034 may engage in a cross slot 4038 in the movable blade and as it moves in its orbit creates a reciprocating motion of the sickle bar movable blade 4014.

Figure 22B:
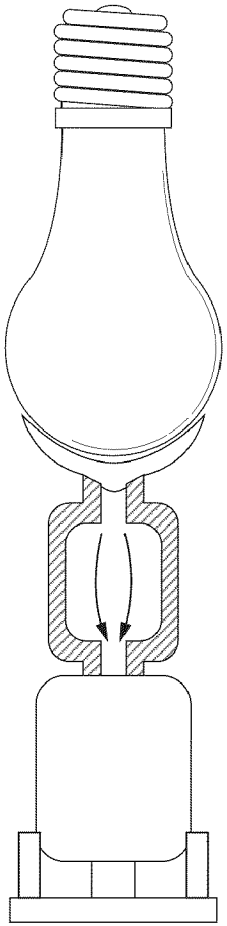
FIGS. 22A and B depict a suction clamp bulb changer attachment.
Figure 22A:
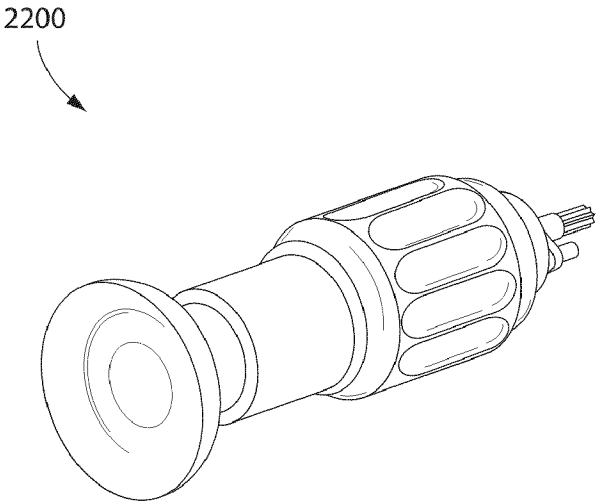

Referring to FIGS. 22A and B, a suction clamp bulb changer attachment is depicted. The suction clamp bulb changer may utilize a turbine or microturbine to create suction and a rotary head to turn bulb in and out. An adjustable friction clutch may inhibit over driving the bulb. Varied stepped or staged size cups may accommodate a range of bulb sizes. The stepped cups may also be useful for positioning other, non-bulb items as well. Using the power base, a user may control the speed of rotation of the bulb changer. The vacuum cup may be associated with a vacuum chamber, which may in turn be associated with a rotary head. The assembly of vacuum cup, vacuum chamber, and rotary head may interface to a vacuum connection associated with the power base or provided from a separate source.

Figure 23:
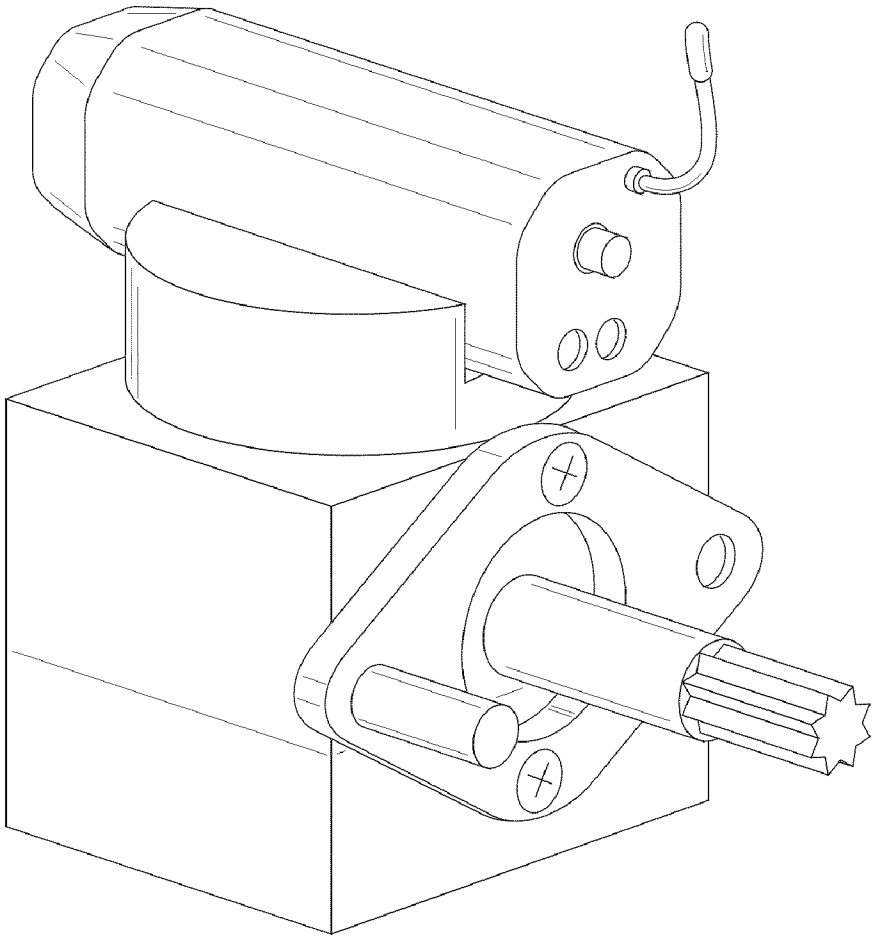
FIG. 23 depicts a rear view of an inspection camera.
Figure 24:
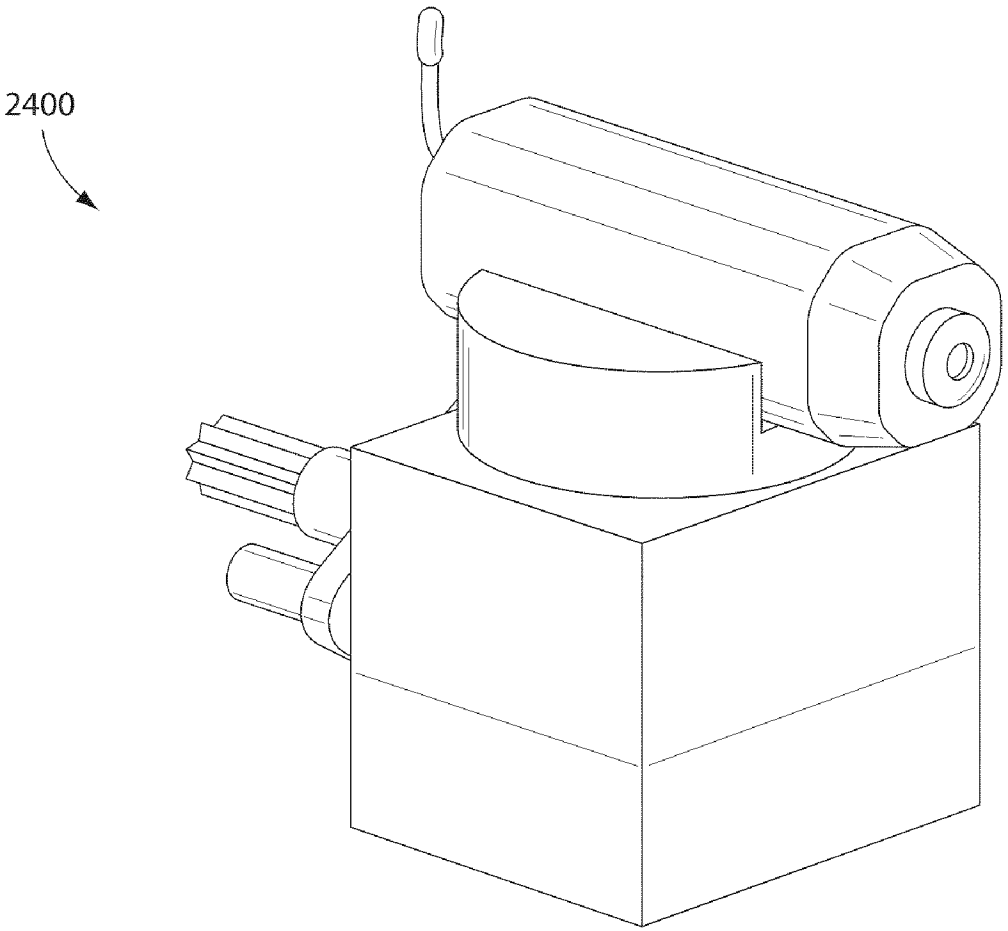
FIG. 24 depicts a front view of an inspection camera.

Referring to FIGS. 23 and 24, back and front views, respectively, of an inspection video camera mounted on a turning turntable are depicted. The inspection video camera may be an inspection module 1314 and, in particular, a digital wireless video/still camera 1368. The turntable may move at a speed set by a user. The turntable may utilize a worm/worm gear combination to permit panning of the camera at the end of the power base. Vertical adjustment may be accomplished at a power head angle adjustment. A wireless link may provide an image at an attachable monitor or at a separate remote viewing monitor. The camera may be a video camera, still camera, infrared camera, night vision camera, digital camera, and the like.

FIG. 25A depicts a front perspective view of a light bulb changing tool 2500. The light bulb changing tool 2500 includes a gripper 2502, a gripping side 2504 of the gripper 2502, fingers 2510 of the gripper 2502, and a polymer 2514 disposed on the gripping side 2504.

The light bulb changing tool 2500 may be a functional module that can grab a variety of light bulbs. Applications of the light bulb changing tool 2500 may include grabbing a light bulb, twisting the light bulb to install and/or remove the light bulb from a socket, and releasing the light bulb. This twisting may result from a torque that is applied to or generated by the light bulb changing tool 2500.

The gripper 2502 may be a device that has two opposed sides, one of which is the gripping side 2504. The gripper 2502 may include the fingers 2510. The gripper 2502 may include the viscoelastic polymer 2514.

The gripping side 2504 may be that side of the gripper 2502 that is used to engage a light bulb or other object. The gripping side 2504 may be substantially coated with the polymer 2514. In the present depiction, for the purpose of illustration and not limitation, the gripping side 2504 is entirely coated with the polymer 2514.

The fingers 2510 may be compliant elements of the gripper 2502. In applications, a user may bend and/or twist the fingers into a desirable position and the fingers may substantially maintain that position until the user later bends and/or twists the fingers again. The desirable position may allow the fingers 2510 to receive the light bulb in a way that generates greater contact between the light bulb and the gripping side 2504 than would be possible if the fingers 2510 were not compliant. It will be understood that various materials and techniques may be employed to provide the fingers 2510. In embodiments, the fingers may be substantially fixed in a position and not compliant, the position corresponding to one or more light bulb sizes.

The polymer 2514 may be a material that is sticky. Additionally, the polymer 2514 may be non-oily. The polymer 2514 may be a viscoelastic polymer. The polymer 2514 may be a low viscosity viscoelastic polymer. The polymer 2514 may adhere to a variety of objects, such as and without limitation the light bulb. After the polymer 2514 adheres to an object, a slight tug may pull the object free from the polymer 2514. In applications, a user may place a light bulb into contact with the polymer 2514. Then, the user may use the light bulb changing tool 2500 to insert the light bulb into a socket and twist the light bulb into place. With the light bulb now secured in the socket, the user may slight tug the light bulb changing tool 2500 away from the light bulb, causing the polymer 2514 to release the light bulb. It will be understood that the polymer 2514 enables various applications. Furthermore, it will be understood that various materials may be employed as the polymer 2514.

FIG. 25B depicts a side perspective view of the light bulb changing tool 2500. The light bulb changing tool 2500 may include an attaching side 2508 of the gripper 2502, the fingers 2510, and an attachment point 2512 disposed on the attaching side 2508.

The fingers 2510 are shown in a desirable position, which is described hereinabove with reference to FIG. 25A and elsewhere.

The attachment point 2512 may be a facility that is adapted to attach to a gear head. In embodiments, the attachment point 2512 may include at least one of a shank, a threaded connector, a clasp, a magnet, a pin, or the like. The attachment point 2512 may be complementary to or compatible with the connection point 608. For example and without limitation, the attachment point 2512 may include a male component and the connection point 608 may include a matching female component. It will be understood that various embodiments of the attachment point 2512 are possible.

The gear head may be adapted to receive an input torque at a first speed and to rotate the gripper 2502 with an output torque at a second speed. The gear head may be adapted to attach to a motor providing the input torque. The first speed may be greater than the second speed. The gear head may include a torque-limiting clutch that is adapted to limit the output torque more or less to a preset torque. The gear head may, without limitation, include the power takeoff coupling 318 and the gearbox 304. The power takeoff coupling 318 may be the element of the gear head to which the attachment point 2512 attaches. Optionally, the gear head may further include the gear set 308 and pivot 312. It will be understood that various embodiments of the gear head and torque-limiting clutch are possible.

The torque-limiting clutch may be adjustable, allowing the preset torque to be adjusted by a user. In embodiments, the torque-limiting clutch may be an adjustable friction clutch. It will be appreciated that various embodiments of the torque-limiting clutch are possible.

Alternatively, the attachment point 2512 may be a facility that is adapted to attach to the motor or a power head 404 or 600. Here, embodiments of the attachment point 2512 may include the gear head plus at least one of a shank, a threaded connector, a clasp, a magnet, or the like. It will be appreciated that various embodiments of such an attachment point 2512 are possible.

Alternatively, the attachment point 2512 may be a facility that is adapted to attach to a power base. The attachment point 2512 may include an electric motor gear head; a pole having a first end and a second end; and a wire having a first end and a second end.

The electric motor gear head may be a combination of an electric motor and the gear head. It will be understood that the electric motor gear head may be a single, integrated device or may include an individual electric motor that is operatively coupled to an individual gear head. In any case, the electric motor gear head may be adapted to produce a torque that rotates the gripper 2502. It will be appreciated that various embodiments of the electric motor gear head are possible.

The pole may be a segmented pole, a telescoping pole, a segmented and telescoping pole, or the like as described herein and elsewhere. The electric motor gear head may be disposed on the first end of the pole. The second end of the pole may be adapted to attach to a remote power base, such as and without limitation the power base 160, the power base 300, the power base 400, the power base 500, the power base 902, the power base 1302, or the like. It will be understood that various embodiments of the pole are possible.

The first end of the wire may be connected to the electric motor gear head. The second end of the wire may be adapted to connect to an electrical connector of the power base. For example and without limitation, the electrical connector of the power base may include a socket and the second end of the wire may include a plug that fits into the socket. It will be understood that various embodiments of the second end of the wire are possible.

The electrical connector of the power base may be adapted to provide suitable electrical power and, optionally, control signals for driving the electric motor gear head. It will be understood that various embodiments of the electrical connector of the power base are possible.

FIG. 25C depicts a back perspective view of a light bulb changing tool. The light bulb changing tool 2500 may include the gripper 2502, the attaching side 2508, the fingers 2510, and the attachment point 2512.

The fingers 2510 are shown in a desirable position, which is described hereinabove with reference to FIG. 25A and elsewhere. It will be understood that various desirable positions are possible.

Figure 26C:
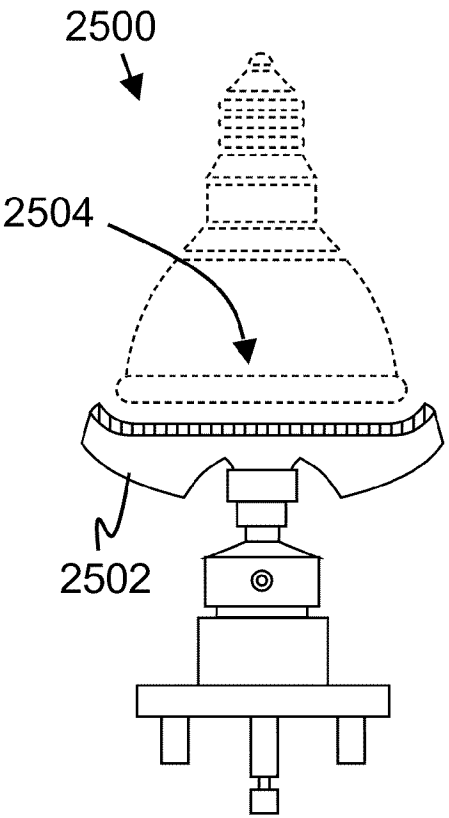
FIG. 26C depicts a cut-away view of a light bulb changing tool.
Figure 26B:
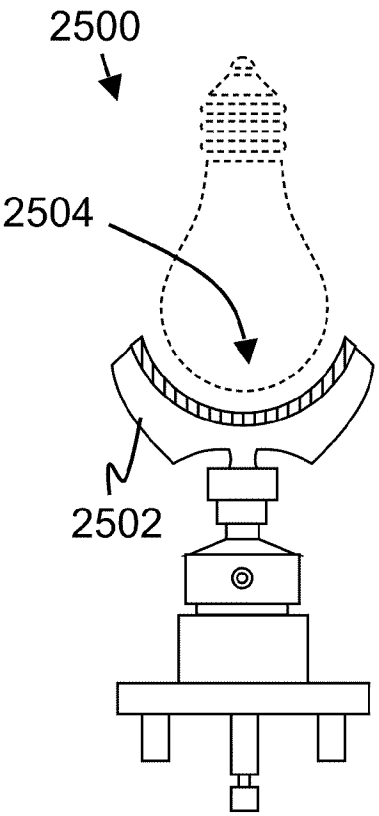
FIG. 26B depicts a cut-away view of a light bulb changing tool.
Figure 26A:
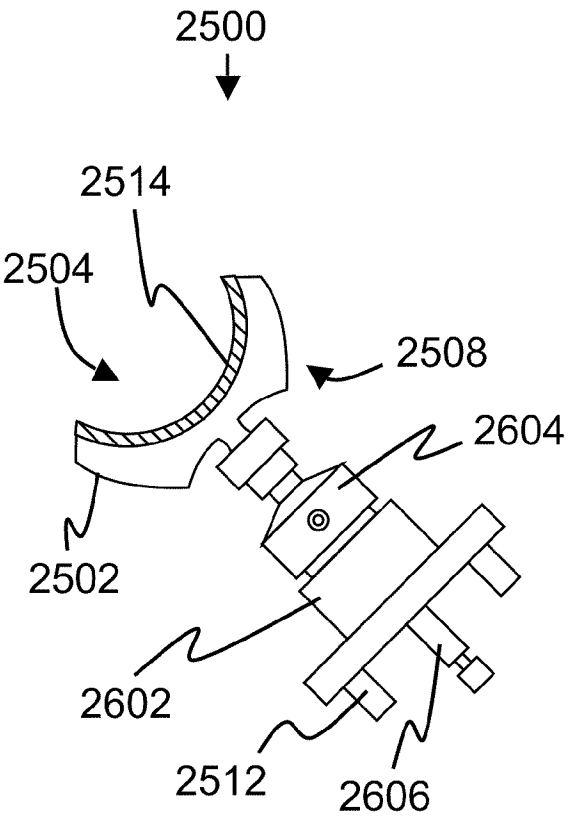
FIG. 26A depicts a cut-away view a light bulb changing tool.

FIG. 26A depicts a cut-away view the light bulb changing tool 2500. The light bulb changing tool 2500 may include the gripper 2502, the gripping side 2504, the attaching side 2508, the attachment point 2512, the polymer 2514, a gear head 2602, a torque-limiting clutch 2604, and a shank 2606.

The cut-away view may depict a sectional view of the gripper 2502, including the gripping side 2504, the attaching side 2508, and the polymer 2514. The cit-away view may depict a side perspective view of the gear head 2602, the torque-limiting clutch 2604, the shank 2606, and other elements.

The gripper 2502 may be a flexible disc or other flexible shape. As depicted, the gripper 2502 may or may not have the fingers 2510.

The gear head 2602 may be described hereinabove with references to FIGS. 25A, 25B, and 25C and elsewhere.

The torque-limiting clutch 2604 may be described hereinabove with references to FIGS. 25A, 25B, and 25C and elsewhere.

The shank 2606, as described hereinabove with references to FIGS. 25A, 25B, and 25C and elsewhere, may be part of the attachment point 2512.

FIG. 26B depicts a cut-away view of a light bulb changing tool. The light bulb changing tool 2500 may include the gripper 2502 and the gripping side 2504.

The cut-away view may depict a sectional view of the gripper 2502, including the gripping side 2504 and associated elements. The cut-away view may depict a side perspective view of other elements.

The gripper 2502 may be in a desirable position vis-à-vis a round light bulb. It will be understood that the desirable position allows greater contact between the gripping side 2504 and the light bulb than may otherwise be possible.

The gripper 2502 may be flexible and may assume the desirable position. The gripper's flexibility may or may not, wholly or partially, be due to one or more compliant elements of the gripper 2502. For example and without limitation, the one or more compliant elements may be the fingers 2510. As depicted, the gripper 2502 may or may not have the fingers 2510.

Alternatively, the gripper 2502 may be more or less permanently fixed in the desirable position.

It will be understood that many embodiments of the gripper 2502 are possible.

FIG. 26C depicts a cut-away view of a light bulb changing tool. The light bulb changing tool 2500 may include the gripper 2502 and the gripping side 2504.

The cut-away view may depict a sectional view of the gripper 2502, including the gripping side 2504 and associated elements. The cut-away view may depict a side perspective view of other elements.

The gripper 2502 may be in a desirable position vis-à-vis a flat-faced light bulb.

Figure 27:
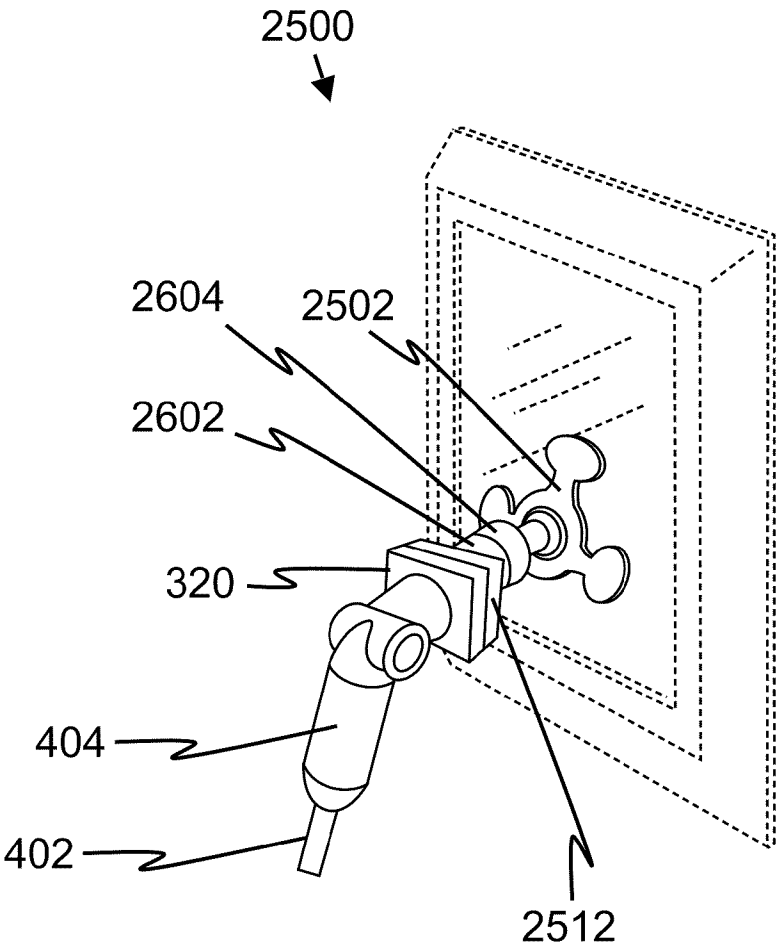
FIG. 27 depicts a perspective view of a light bulb changing tool.

FIG. 27 depicts a perspective view of a light bulb changing tool. The light bulb changing tool 2500 may include the gripper 2502, the attachment point 2512, the gear head 2602, the torque-limiting clutch 2604, the mounting plate 320, the pole 402, and the power head 404.

The gripper 2502 may be in a desirable position vis-à-vis a flat surface. For example and without limitation, the flat surface may be a glass surface mounted in a picture frame.

Here, the light bulb changing tool 2500 may be employed to position a wall-mounted picture in a frame. It will be appreciated that various applications of the light bulb changing tool 2500 are possible. It will be appreciated that such applications may or may not involve a light bulb.

Figure 53:
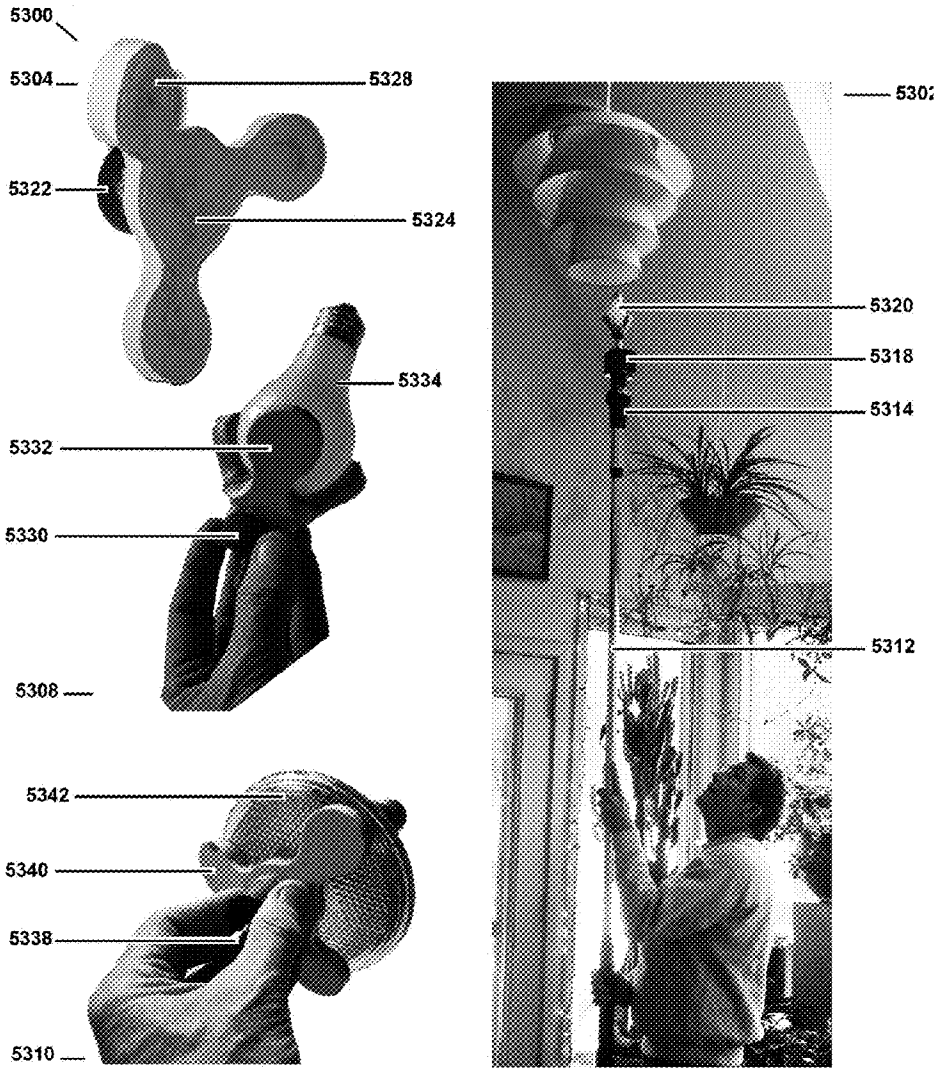
FIG. 53 depicts a light bulb changing tool.

Referring to FIG. 53, the light bulb changing tool attachment 5300 to the power tool system 5302 may provide the user the ability to remove and replace a light bulb 5320 at an extended reach while it minimizes the danger by keeping the user off a ladder. The light bulb changing tool attachment may connect to the power head 5314 of the power tool system 5312 by a connection plate that registers and couples the power output shaft of the power head to the input drive shaft of the light bulb changing tool attachment. The body 5318 of the light bulb changing tool attachment contains a mechanism that creates a very low speed rotation of the bulb in either direction while limiting the torque that can be applied so that the danger of breaking a bulb 5320 from over-tightening is eliminated. The end effecter 5304 which grips the light bulb may be a multi-lobed gripper 5324 that has conformable lobes 5328 to accommodate the range of light bulb shapes. It may attach to the light bulb changing tool attachment with a hub 5322 that incorporates a hex shaft that couples to the hex chuck of the light bulb changing tool attachment. For applications that require replacement of standard globe incandescent light bulbs 5308 the lobes of the gripper 5332 may be conformed to the spherical shape of the lower portion of the light bulb 5334. The hub 5330 of the gripper may attach to the light bulb changing tool attachment with a quick release mechanism. When the application 5310 requires replacement of a flood light type bulb 5342 the lobes of the gripper 5340 may flatten to accept the flattened face of the flood light bulb. The hub of the gripper may have a hex shaft 5338 that may engage the quick release hex chuck of the light bulb changing tool attachment.

Figure 54:
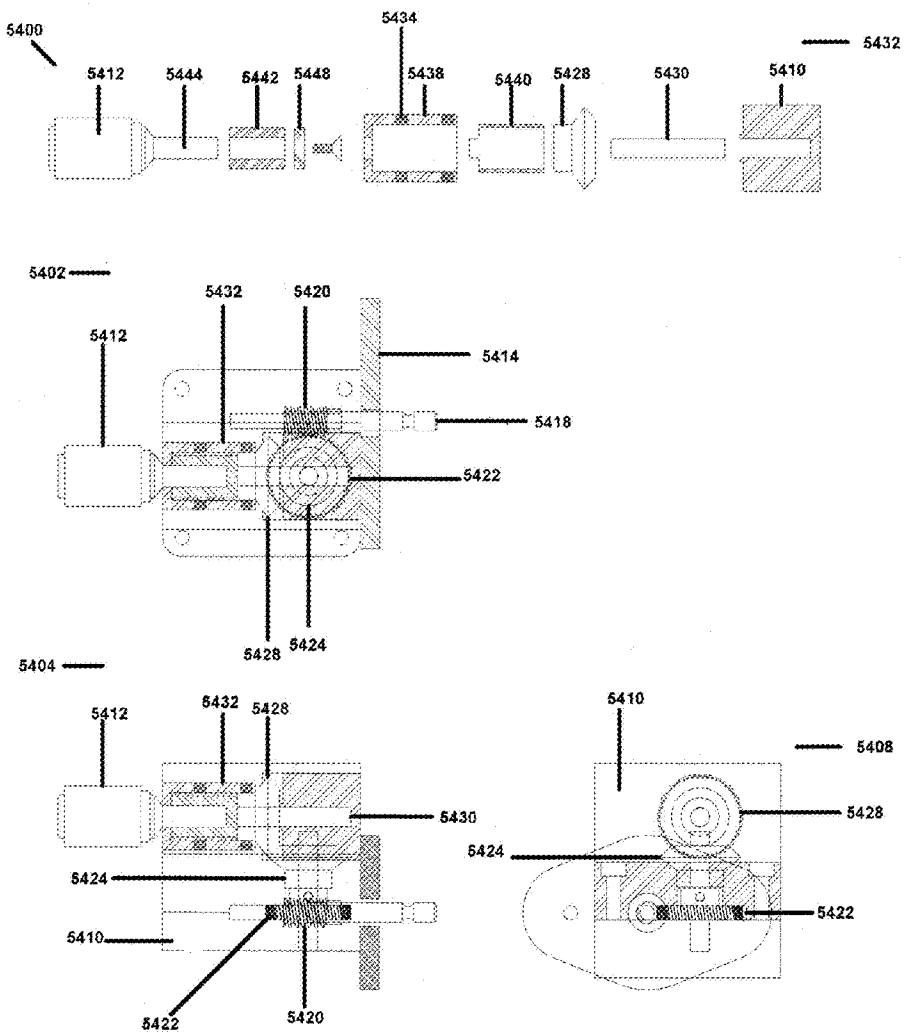
FIG. 54 depicts a top, side, and end view of a light bulb changing tool attachment.

Referring now to FIG. 54, the light bulb changing tool attachment 5400 to the power tool system may provide the user the ability to remove and replace a light bulb at an extended reach while it minimizes the danger by keeping the user off a ladder. The power tool system light bulb changing tool attachment may be a compact product that is shown in this engineering diagram in three views, the top view 5402, the side view 5404 and the end view 5408. There is also an exploded side section view 5432 that shows the elements of the torque limiting clutch. The light bulb changing tool attachment connects to the power head of the power tool system by a connection plate 5414 that registers and couples the power output shaft of the power head to the input drive shaft 5418 of the light bulb changing tool attachment. The body 5410 of the light bulb changing tool attachment comprises a mechanism that creates a very low speed rotation of the bulb in either direction while limiting the torque that can be applied so that the danger of breaking a bulb from over-tightening is eliminated. The end effecter which grips the light bulb may be a multi-lobed gripper that has conformable lobes to accommodate the range of light bulb shapes. It may attach to the light bulb changing tool attachment with a hub that incorporates a hex shaft that couples to the quick-release hex chuck 5412 of the light bulb changing tool attachment that utilizes a ball-detent locking mechanism. The input shaft of the light bulb changing tool may be attached to a worm 5420 that engages a worm gear 5422 on a transverse vertical shaft that rotates at a greatly reduced rpm and in turn is attached to a right angle bevel gear 5424. Mated with this right angle bevel gear 5424 is an identical bevel gear 5428 attached to a shaft at ninety degrees that is the output shaft 5430, driving the torque limiting slip-clutch 5432. The output shaft 5430 connects to the driving bevel gear 5428 and to the slip-clutch cage 5438 as a single rotating unit. Internal to the slip-clutch cage 5438 may be the split friction sleeve 5440 that creates an adjustable friction connection between the slip-clutch cage 5438 and the internal drive sleeve 5442. This adjustable friction may be applied in a number of ways but here is effected by set screws 5434 that apply inward pressure on the split sleeve 5440. The drive sleeve 5442 may be affixed to the output hex shaft 5444 of the quick-release hex chuck 5412 of the light bulb changing tool attachment by a hex bore in the drive sleeve that resolves the torque load transferred to the drive sleeve. The quick-release hex chuck 5412 of the light bulb changing tool attachment may be retained by a retainer washer 5448, keeping the assembly 5432 contained within the body 5410 of the light bulb changing tool attachment.

Figure 28:
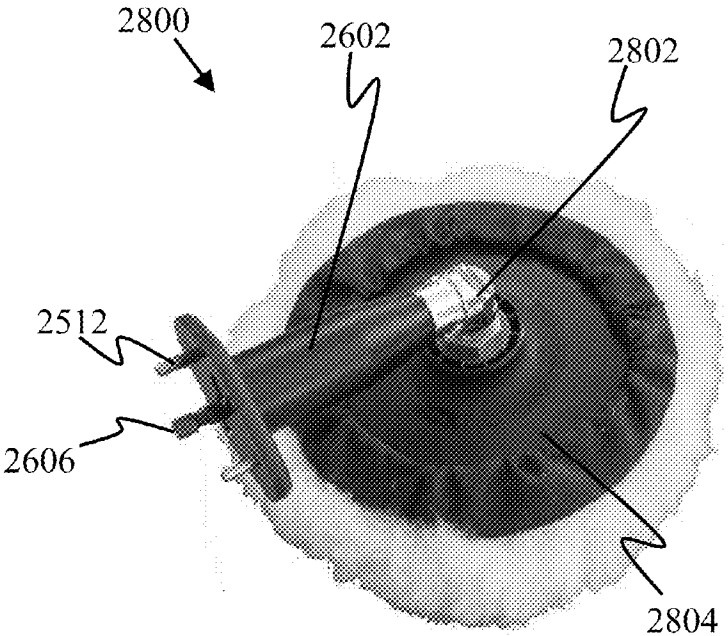
FIG. 28 depicts a perspective view of a vehicle cleaning tool.

FIG. 28 depicts a perspective view of a vehicle cleaning tool. The vehicle cleaning tool 2800 may include the shank 2606, the attachment point 1512, the gear head 2602, an arbor 2802, and a functional module 2804 for cleaning or detailing a vehicle.

The shank 2606 or an analogous element may be coupled to or integral to the gear head 2602. In applications, a motor may rotate the shank 2606 and thusly provide an input rotation to the gear head 2602.

The attachment point 1512 may be coupled to or integral to the gear head 2602. In applications, the attachment point 1512 may be adapted to couple to the connection point 608, which is described hereinabove with reference to FIG. 6 and elsewhere.

The connection point 608 may be a quick-release connection point that is an element of the power head 404. For example and without limitation, the connection point 608 that includes a detent released by a spring latch actuated by a button integral to the power head 404 may be a quick-release connection point. Generally, any and all embodiments of the connection point 608 may be the quick-release connection point. It will be understood that various embodiments of a quick-release connection point as part of a power head are possible.

The gear head 2602 may be operatively coupled to the arbor 2802. The gear head 2602 may rotate the arbor 2802 in response to the input rotation. The gear head 2602 may reduce the input rotation's velocity and then rotate the arbor 2802 at this reduced velocity. The gear head 2602 may include a torque-limiting clutch that is adapted to limit the reduced velocity's torque.

The gear head 2602 may be adapted to couple to a power head having a quick-release connection point. Such an adaptation may include the attachment point 2512, the shank 2606, and the like. For example and without limitation, The torque-limiting clutch may be an adjustable friction clutch. It will be understood that various embodiments of the torque-limiting clutch are possible.

The arbor 2802 may be adapted to connect to a functional module 2804 for cleaning or detailing a vehicle. The arbor 2802 may transfer a rotation from the gear head 2602 to the functional module 2804. The arbor 2802 may have two sides, one of which is oriented toward the gear head 2602 and the other of which is oriented toward the functional module 2804. In embodiments these two sides may be oriented in any and all ways with respect to one another. For the purpose of illustration and not limitation, the present illustration shows the two sides oriented at a right angle with respect to one another.

The functional module 2804 for cleaning or detailing a vehicle may include bristles, cloth, pad material, sponge material, a combination of the foregoing, or the like. The functional module 2804 for cleaning or detailing a vehicle may be designed to clean or detail a vehicle. Rotation of this functional module 2804 by the arbor 2802 may improve or substantially provide a cleaning or detailing action of the functional module 2804. Various embodiments of the functional module 2804 for cleaning or detailing a vehicle are described hereinafter and elsewhere. It will be understood that a variety of functional modules 2804 for cleaning or detailing a vehicle are possible.

Figure 29A:
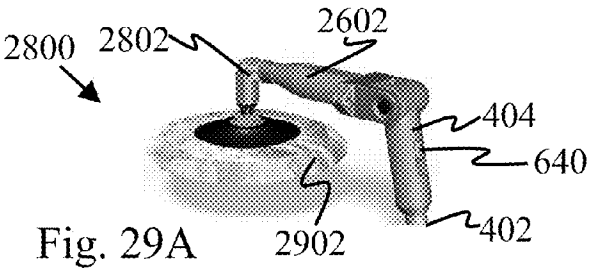
FIG. 29A depicts a perspective view of a vehicle cleaning tool.

FIG. 29A depicts a perspective view of a vehicle cleaning tool. The vehicle cleaning tool 2800 may include the pole 402, the power head 404, the arbor 2802, the gear head 2602, the manual speed change switch 640, and a cloth cleaning disc 2902.

The pole and the power head may be described hereinabove with reference to FIG. 4, to FIG. 6, and elsewhere.

The manual speed change switch 640 may be described hereinabove with reference to FIG. 6 and elsewhere.

The cloth cleaning disk 2902 may be a functional module 2804 for cleaning or detailing a vehicle. The cloth cleaning disk 2902 may include cloth material for cleaning or detailing a vehicle. When rotated by the arbor 2802, the cloth cleaning disc 2902 may provide a cleaning or detailing action for cleaning or detailing a vehicle. It will be understood that various embodiments of the cloth cleaning disk 2902 are possible.

Figure 29B:
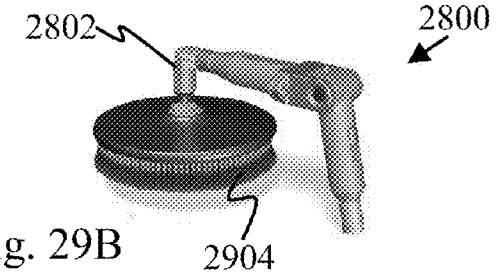
FIG. 29B depicts a perspective view of a vehicle cleaning tool.

FIG. 29B depicts a perspective view of a vehicle cleaning tool. The vehicle cleaning tool 2800 may include the arbor 2802 and a bristle cleaning disk 2904.

The bristle cleaning disk 2904 may be a functional module 2804 for cleaning or detailing a vehicle. The bristle cleaning disk 2904 may include a bristle material for cleaning or detailing a vehicle. When rotated by the arbor 2802, the bristle cleaning disk 2904 may provide a cleaning or detailing action for cleaning or detailing a vehicle. It will be understood that various embodiments of the bristle cleaning disk 2904 are possible.

Figure 29C:
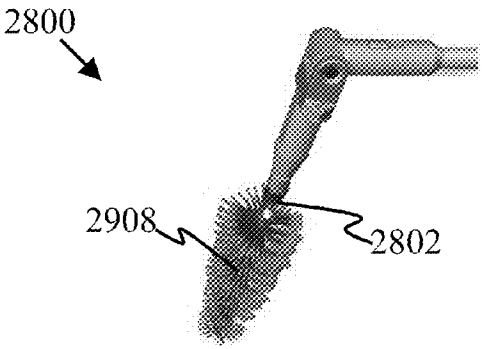
FIG. 29C depicts a perspective view of a vehicle cleaning tool.

FIG. 29C depicts a perspective view of a vehicle cleaning tool. The vehicle cleaning tool 2900 may include the arbor 2802 and a bristle cleaning brush 2908.

For the purpose of illustration and not limitation, the two sides of the arbor 2802 are oriented along a horizontal axis with respect to one another.

The bristle cleaning brush 2908 may be a functional module 2804 for cleaning or detailing a vehicle. The bristle cleaning brush 2908 may include a bristle material arranged in a spiral or other shape for cleaning or detailing a vehicle. When rotated by the arbor 2802, the bristle cleaning brush 2908 may provide a cleaning or detailing action for cleaning or detailing a vehicle. It will be understood that various embodiments of the bristle cleaning brush 2908 are possible.

Figure 30B:
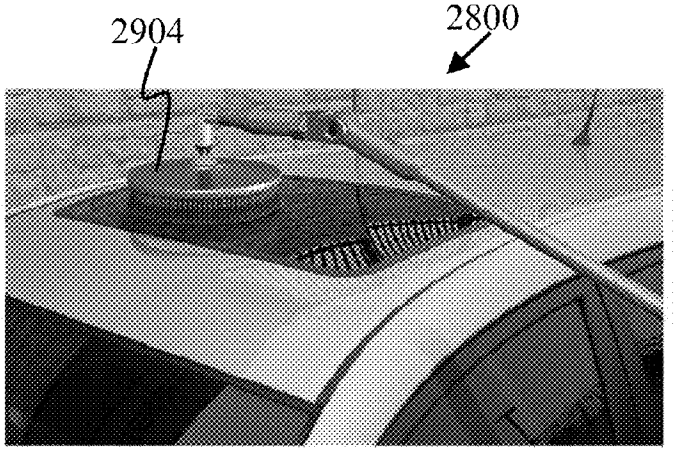
FIG. 30B depicts a perspective view of an application of a vehicle cleaning tool.
Figure 30A:
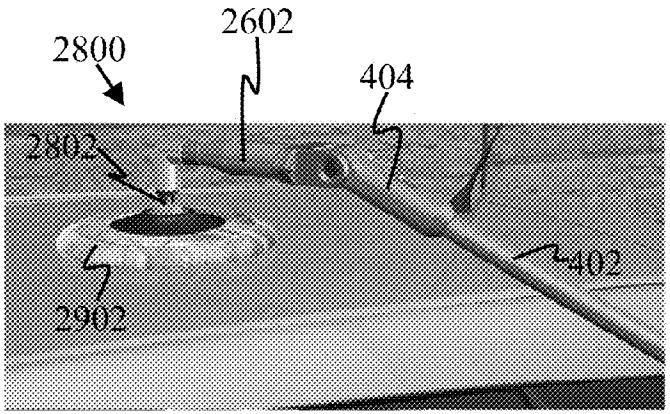
FIG. 30A depicts a perspective view of an application of a vehicle cleaning tool.

FIG. 30A depicts a perspective view of an application of a vehicle cleaning tool. The vehicle cleaning tool 2800 may include the cloth cleaning disk 2902.

FIG. 30B depicts a perspective view of an application of a vehicle cleaning tool. The vehicle cleaning tool 2800 may include the bristle cleaning disk 2904.

Figure 30C:
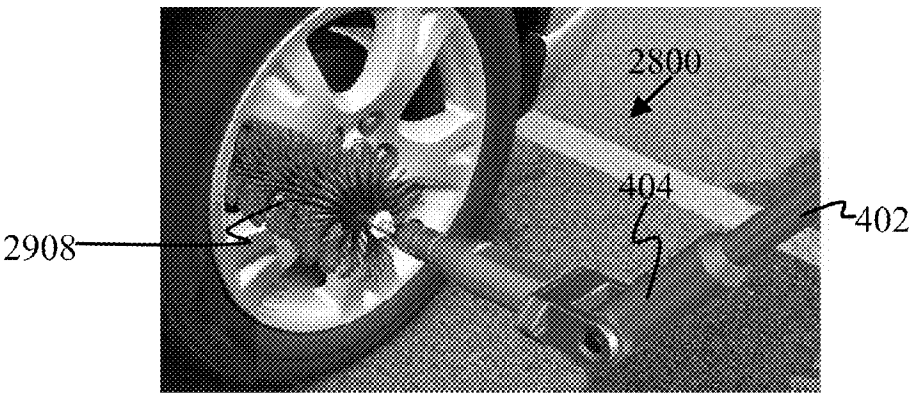
FIG. 30C depicts a perspective view of an application of a vehicle cleaning tool.

FIG. 30C depicts a perspective view of an application of a vehicle cleaning tool. The vehicle cleaning tool 2800 may include the bristle cleaning brush 2908.

It will be understood that many applications of the vehicle cleaning tool 2800 are possible. Such applications may or may not relate to cleaning a vehicle.

Figure 49:
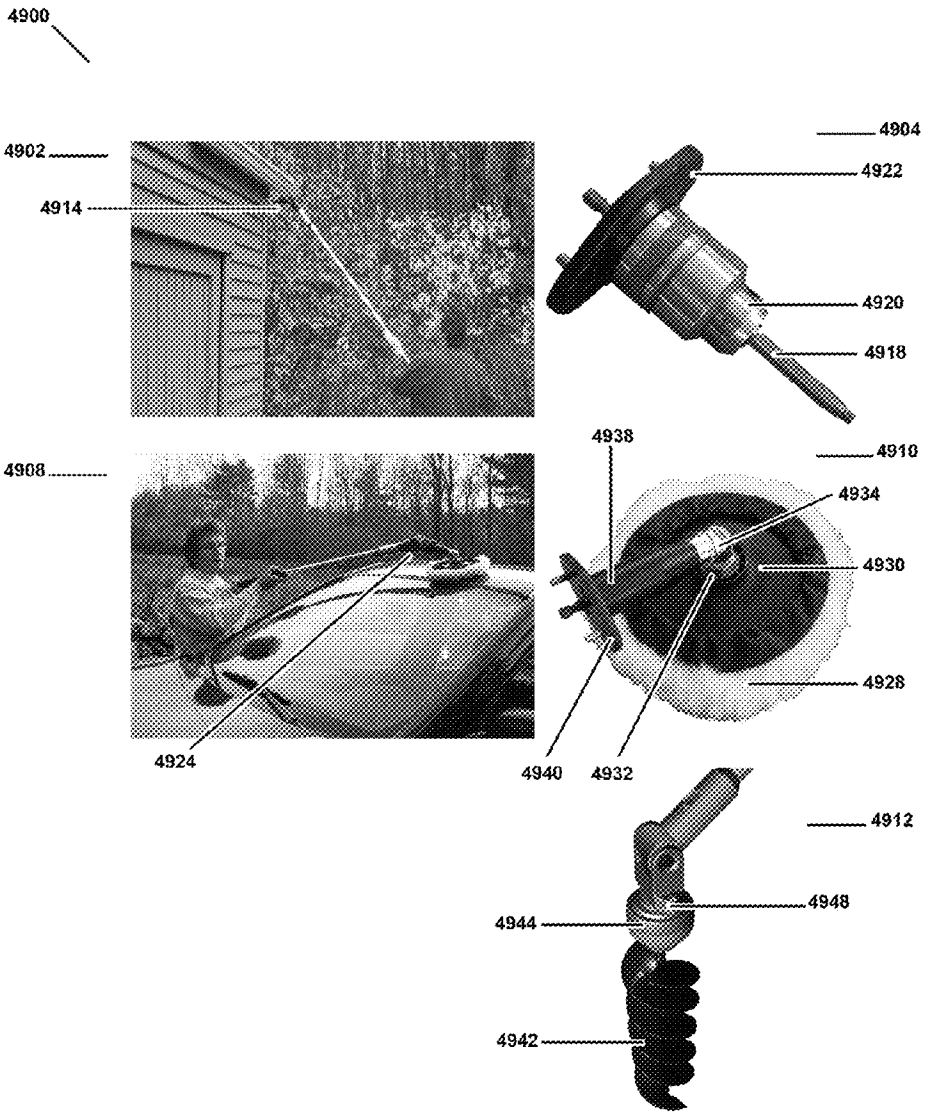
FIG. 49 depicts a range of direct drive tool attachments.

Referring now to FIG. 49, the power tool system may provide the user the ability to use a wide range of tools at a distance thereby providing an ability to do work from a standing position that would otherwise require a ladder. While some of the tool attachments may require additional mechanisms to reformat the drive characteristics and other contributing electromechanical elements to do their job, a number of the tool attachments may utilize the direct rotational drive of the power tool system power head with little or no modification save the addition of an attachment mechanism. These direct drive tool attachments 4900 form a compact family of products that connect to the power head of the power tool system by a range of different tool chucks many of which are familiar in the tool industry. The range of applications for such a tool family include simple drilling and fastening 4902 using ubiquitous tools such as twist drills 4914, spade bits, augers and forstener bits and drivers such as flat-blade, Phillips, square-drive and specialty bits. Other applications include cleaning implements 4908, as for vehicles, wherein a range of end effecters such as rotary circular brushes, rotary buffing and polishing pads, and specialty detailing brushes can make the job much easier on today's larger vehicles 4924. In addition, there are direct drive implements for lawn and garden 4912 care such as earth augers to create holes for bulb planting. All this range of tool types consist of a basic tool that need only be connected to the rotational drive of the power head by a mechanical attachment mechanism. Such attachment mechanisms may include a three-jaw chuck 4920, either with a chuck key or keyless, a detent-action hex chuck 4932 or in some cases a chuck with reduction gearing such as an in-line planetary gearhead 4944 that reduces rpm and increases torque in response to certain tool requirements. For drilling and fastening applications using ubiquitous tools such as twist drills, spade bits, augers and forstener bits and drivers such as flat-blade, Phillips, square-drive 4918 and specialty bits a standard three jaw chuck may permit the highest flexibility to accommodate the wide range of possible tools and fasteners. The three-jaw chuck 4920 may be direct coupled to the power tool system power head by a connection plate 4922 that provides registration features to align mechanical components and resist torque couples and slip free engagement of the power output shaft to the input shaft of the chuck assembly. With many other tools, a hex shaft coupling may be the preferred mechanism to transfer power in a drive train. There are many mechanisms for engaging the hex shaft of a tool shank and these are utilized by the power tool system to engage a wide range of such tools. Often it is advantageous to provide power at ninety degrees on inclination to the work piece 4924 and one of the tool chucks for the power tool system may utilize a ninety degree hex shaft chuck 4934 with a ball detent retention of the hex shaft of the tool within the chuck 4932 itself. There are many means of retaining the hex shaft of the tool including mechanical locks, magnetic latches, external locks, screw threads, and others. The hex shaft chuck assembly is attached to the power tool system power head by a connection plate 4940 that provides registration features to align mechanical components and resist torque couples and slip free engagement of the power output shaft to the input shaft of the chuck assembly. Many special cleaning implements are part of the system, all which may utilize the hex shaft to provide high-torque rotational drive to the various cleaning implements. Some flat rotational brushes, polishing and buffing wheels may use the same circular cleaning disc 4930 with the cleaning/buffing/polishing pads 4928 fastening to that disc. Others may be self-contained dedicated cleaning implements that direct connect to the hex chuck. Some tools may require higher torque and lower speeds although they may still utilize a direct rotational drive from the power head of the power tool system. An in-line planetary or other kind of gearbox 4944 may reduce the rpm and increase the torque in a very compact form factor. The in-line gearbox assembly may be attached to the power tool system power head by a connection plate 4948 that provides registration features to align mechanical components and resist torque couples and slip free engagement of the power output shaft to the input shaft of the chuck assembly. The in-line gearbox 4944 connects with a hex-drive chuck or a three-jaw chuck utilized downstream from the gearing to couple the tool such as an earth auger bit 4942.

Figure 50:
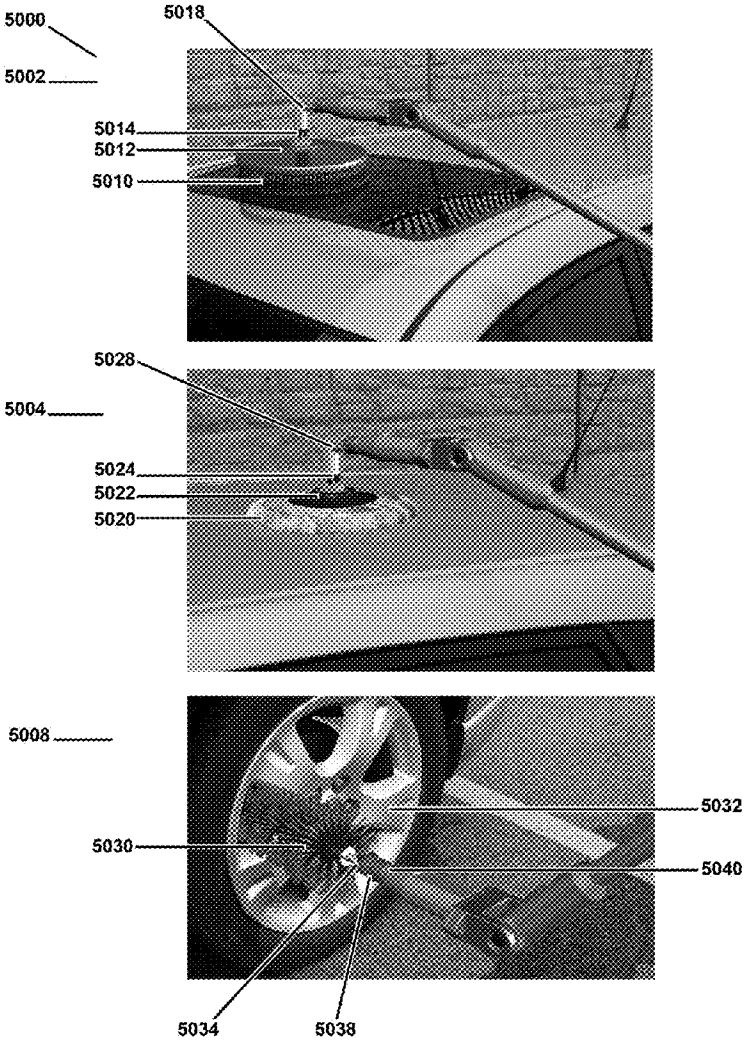
FIG. 50 depicts a range of direct drive tool attachments.

Referring now to FIG. 50, the power tool system may provide the user the ability to use a wide range of tools at a distance thereby providing an ability to do work from a standing position that would otherwise require a ladder. While some of the tool attachments may require additional mechanisms to reformat the drive characteristics and other contributing electromechanical elements to do their job, a number of the tool attachments may utilize the direct rotational drive of the power tool system power head with little or no modification save the addition of an attachment mechanism. Cleaning attachments 5000 for vehicles as well as many other commercial and home applications are among the direct drive tool attachments that form a compact family of products that are part of the power tool system family. The range of applications for cleaning implements, such as for vehicles, require a range of end effecters such as rotary circular brushes, rotary buffing and polishing pads, and specialty detailing brushes that can make the job much easier on today's larger vehicles and in many industrial settings. The power tool system cleaning family may include custom brushes for these particular industrial applications. Attachment mechanisms may include a standard three jaw chuck, either with a chuck key or keyless, a detent-action hex chuck or in some cases a chuck with reduction gearing such as an in-line planetary gearhead that reduces rpm and increase torque in response to certain tool requirements. With most cleaning tools a hex shaft coupling may be the preferred mechanism to transfer power in a drive train. There are many mechanisms for engaging the hex shaft of a tool shank and these are utilized by the power tool system to engage a wide range of such tools. It may be advantageous to provide power at ninety degrees inclination to the work piece. One of the tool chucks for the power tool system utilizes a ninety degree hex shaft chuck with a spring-release ball-detent retention of the hex shaft of the tool within the chuck itself. There may be many means of retaining the hex shaft of the tool including mechanical locks, magnetic latches, external locks, screw threads, and others. The hex shaft chuck assembly may be attached to the power tool system power head by a connection plate that provides registration features to align mechanical components and resist torque couples and slip free engagement of the power output shaft to the input shaft of the chuck assembly. Many special cleaning implements may be part of the system and all may utilize the hex shaft to provide high-torque rotational drive to the various cleaning implements. Surface cleaning 5002 may be addressed by a range of custom circular brushes 5010 that are either one-piece molded to the circular drive platform 5012 or assembled as a component system. These circular brushes may provide rotational scrubbing when attached to the right-angle drive 5018 of the direct coupled hex chuck 5014. Surface buffing and polishing 5004 may be addressed by a range of circular buffing and polishing pads 5020 that attach to a one-piece molded circular drive platform 5022. These circular pads provide rotational motion that applies and works the various compounds typically used in vehicle surface care. The range of hex shaft pads attach to the right-angle drive 5028 of the direct coupled hex chuck 5024. There are many other modes of cleaning wherein specialty brushes 5008 ease the task both for vehicle cleaning and in the commercial/industrial setting. The power tool system may utilize a wide range of custom brushes 5030 that may make it easy to clean convolute surfaces such as vehicle wheels 5032. These custom brushes may utilize a hex shaft central spine and attach to the power head drive via a hex chuck 5034. In these custom cleaning applications the orientation of the cleaning head may be important and the right angle drive may be replaced with an adjustable angle drive 5038 utilizing a ring bevel gear coupling a double bevel gear on the input and output shaft as described herein. The range of hex shaft cleaning tools may attach to the right-angle drive 5038 of the direct coupled hex chuck 5034.

Generally speaking, in an embodiment, a user may obtain the power base and functional modules separately. For example, a retailer may sell the power base separately from the functional modules. In another example, a tool rental center may rent the power base and functional modules separately, if for example, a user may already have a power base and have need only for a particular functional module. In another example, the functional modules may be purchased as needed enabling a user to lower the cost of ownership. In an embodiment, the multi-functional power tool system may be useful residentially, industrially, commercially, may be rented, may be leased, and the like.

In an embodiment, the power base and one or more functional modules may be obtained as a kit. For example, a power base may be packaged for sale with a module, such as a power base with a pruning shear, a power base with a gutter cleaning device comprising impellers, a power base and a powered paint roller, and the like. In an embodiment, a power base may be packaged for sale with more than one functional module. The functional modules in the kit may be related. For example, a landscape/gardening kit may comprise a power base and functional modules such as a pruning shear, fruit picker, broadcast spreader, and the like. The functional modules in the kit may be unrelated. For example, a kit may comprise a power base and functional modules such as a gutter cleaning device comprising impellers, drill/driver with remote interchangeable bits, a weed whacker, and the like.

Any and all of the functional modules may be attached to a power head via a quick-release coupling. Any and all of the functional modules may be augmented with, attached to, and/or used in conjunction with a digital wireless video/still camera or any other kind of electronic camera. Such a camera may provide a user with a view of an operational site at which a functional module is being employed. Many examples of this may be described herein and elsewhere, and various other examples of this will be understood.

While the invention has been disclosed in connection with the preferred embodiments shown and described in detail, various modifications and improvements thereon will become readily apparent to those skilled in the art. Accordingly, the spirit and scope of the present invention is not to be limited by the foregoing examples, but is to be understood in the broadest sense allowable by law.

All documents referenced herein are hereby incorporated by reference.

What is claimed is:

1. A method of a multi-functional power tool system, comprising:

mounting a functional module to a mounting plate of a power head, the power head configured to mount various functional modules;

attaching the power head to a power base that provides electrical power for the functional module, wherein the power head is adapted to detachably engage at least two different functional modules and wherein a pole is disposed between the power base and the power head;

powering the functional module by directing electrical power from the power base through a drive of the power head; and controlling the multi-functional power tool system using a control disposed in the power base, wherein the functional module is connected to a rotational drive of the power head by a mechanical attachment mechanism, wherein the mechanical attachment comprises at least one of a three-jaw chuck with a chuck key, a keyless three-jaw chuck, a detent-action hex chuck, a chuck with reduction gearing, an in-line planetary gearhead, a ninety degree hex shaft chuck with a spring-release ball-detent retention of the hex shaft of the tool within the chuck itself, and a ninety degree hex shaft chuck with a ball detent retention of the hex shaft of the tool within the chuck itself; and wherein the functional module comprises a hex shaft for attaching to the ninety degree hex shaft chuck.

2. The method of claim 1, wherein the functional module is at least one of a cleaning module, a gutter cleaning module, a holding and fastening module, a finishing and painting module, an inspection module, and a landscape/garden module.

3. The method of claim 1, wherein the mounting plate utilizes a quick release connection.

4. The method of claim 1, wherein the functional module attaches to an adjustable angle drive utilizing a ring bevel gear coupling a double bevel gear on the input and output shaft.

5. The method of claim 1, wherein the mechanical attachment is coupled to the power tool system power head by a connection plate that provides registration features to align mechanical components and resist torque couples and slip free engagement of the power output shaft to the input shaft of the mechanical attachment.

6. The method of claim 1, wherein an in-line gearbox assembly is attached to the power head by a connection plate that provides registration features to align mechanical components and resist torque couples and slip free engagement of the power output shaft to the input shaft of the mechanical attachment.

7. A multi-functional power tool system, comprising:

a functional module mounted to a mounting plate of a power head, the power head configured to mount various functional modules;

a power base attached to the power head to provide electrical power to the power head, wherein the power head is adapted to detachably engage at least two different functional modules and wherein a pole is disposed between the power base and the power head;

a drive of the power head for powering the functional module with electrical power from the power base; and a control disposed in the power base for controlling the multi-functional power tool system, wherein the functional module is connected to a rotational drive of the power head by a mechanical attachment mechanism, wherein the mechanical attachment comprises at least one of a three-jaw chuck with a chuck key, a keyless three-jaw chuck, a detent-action hex chuck, a chuck with reduction gearing, an in-line planetary gearhead, a ninety degree hex shaft chuck with a spring-release ball-detent retention of the hex shaft of the tool within the chuck itself, and a ninety degree hex shaft chuck with a ball detent retention of the hex shaft of the tool within the chuck itself, and wherein the functional module comprises a hex shaft for attaching to the ninety degree hex shaft chuck.

8. The system of claim 7, wherein the functional module is at least one of a cleaning module, a gutter cleaning module, a holding and fastening module, a finishing and painting module, an inspection module, and a landscape/garden module.

9. The system of claim 7, wherein the mounting plate utilizes a quick release connection.

10. The system of claim 7, wherein the functional module attaches to an adjustable angle drive utilizing a ring bevel gear coupling a double bevel gear on the input and output shaft.

11. The system of claim 7, wherein the mechanical attachment is coupled to the power tool system power head by a connection plate that provides registration features to align mechanical components and resist torque couples and slip free engagement of the power output shaft to the input shaft of the mechanical attachment.

12. The system of claim 7, wherein an in-line gearbox assembly is attached to the power head by a connection plate that provides registration features to align mechanical components and resist torque couples and slip free engagement of the power output shaft to the input shaft of the mechanical attachment.

* * * * *